US010654305B2

(12) United States Patent
Shimizu

(10) Patent No.: US 10,654,305 B2
(45) Date of Patent: May 19, 2020

(54) SHEET BUNDLE BINDING APPARATUS AND IMAGE FORMING SYSTEM INCLUDING SHEET BUNDLE BINDING APPARATUS

(71) Applicants: NISCA CORPORATION, Yamanashi (JP); CANON FINETECH NISCA INC., Misato (JP)

(72) Inventor: Tatsuya Shimizu, Minamikoma-gun (JP)

(73) Assignee: Canon Finetech Nisca Inc., Saitama (JP)

( * ) Notice: Subject to any disclaimer, the term of this patent is extended or adjusted under 35 U.S.C. 154(b) by 105 days.

(21) Appl. No.: 15/560,289

(22) PCT Filed: Apr. 13, 2016

(86) PCT No.: PCT/JP2016/001998
§ 371 (c)(1),
(2) Date: Sep. 21, 2017

(87) PCT Pub. No.: WO2016/166974
PCT Pub. Date: Oct. 20, 2016

(65) Prior Publication Data

US 2018/0072084 A1 Mar. 15, 2018

(30) Foreign Application Priority Data

Apr. 14, 2015 (JP) ..... 2015-082872
Apr. 14, 2015 (JP) ..... 2015-082873

(51) Int. Cl.
*B65H 31/34* (2006.01)
*B65H 31/30* (2006.01)
(Continued)

(52) U.S. Cl.
CPC ..... *B42C 1/12* (2013.01); *B42B 5/00* (2013.01); *B42C 1/00* (2013.01); *B65H 29/20* (2013.01);
(Continued)

(58) Field of Classification Search
CPC ..... B65H 31/3036; B65H 31/30; B65H 2301/51616; B65H 2301/43828;
(Continued)

(56) References Cited

U.S. PATENT DOCUMENTS 5,622,359 A 4/1997 Kuwano et al.
7,386,271 B2 6/2008 Kuwata et al.
(Continued)

FOREIGN PATENT DOCUMENTS

CN 1677259 A 10/2005
CN 103582570 A 2/2014
(Continued)

OTHER PUBLICATIONS

Search Report dated Oct. 2, 2018, in European Patent Application No. 16779769.5.
(Continued)

*Primary Examiner* — Jennifer E Simmons
(74) *Attorney, Agent, or Firm* — Venable LLP

(57) ABSTRACT

Provided is a binding apparatus enabling easy removal of a sheet bundle, which has been subjected to binding, from clamping teeth. The binding apparatus includes: a sheet placement portion on which sheets are placed; an alignment unit configured to align the sheets placed on the sheet placement portion; a binding member configured to bind the sheets placed on the sheet placement portion by deforming the sheets without using a staple; and a separating member configured to apply a rotational force to the sheets which are bound by the binding member to separate the sheets and the
(Continued)

binding member from each other, the alignment unit and the separating member being constructed by different members.

12 Claims, 33 Drawing Sheets

(51) Int. Cl.

| | |
|---|---|
| ***B42C 1/12*** | (2006.01) |
| ***B65H 37/04*** | (2006.01) |
| ***B65H 29/20*** | (2006.01) |
| ***B42C 1/00*** | (2006.01) |
| ***B42B 5/00*** | (2006.01) |

(52) U.S. Cl.
CPC ..... *B65H 31/3036* (2013.01); *B65H 31/3081* (2013.01); *B65H 31/34* (2013.01); *B65H 37/04* (2013.01); *B65H 2801/06* (2013.01)

(58) Field of Classification Search
CPC .. B65H 2301/42266; B65H 2201/0754; B31F 5/02; B31F 2201/0754; G03G 2215/00852
See application file for complete search history.

(56) References Cited

U.S. PATENT DOCUMENTS

| | | | | |
|---|---|---|---|---|
| 9,278,571 | B2 | 3/2016 | Abe | |
| 9,409,740 | B2 | 8/2016 | Kubo et al. | |
| 2009/0066000 | A1* | 3/2009 | Iguchi | B65H 31/3081 270/58.08 |
| 2011/0236158 | A1 | 9/2011 | Shiraishi | |
| 2011/0304089 | A1 | 12/2011 | Kimura | |
| 2012/0032388 | A1* | 2/2012 | Jung | B65H 31/34 270/58.08 |
| 2014/0161565 | A1 | 6/2014 | Obuchi et al. | |
| 2015/0003939 | A1 | 1/2015 | Abe | |
| 2015/0014913 | A1 | 1/2015 | Obuchi et al. | |
| 2015/0037119 | A1 | 2/2015 | Tanaka et al. | |
| 2016/0136917 | A1 | 5/2016 | Abe | |

FOREIGN PATENT DOCUMENTS

| | | | |
|---|---|---|---|
| JP | 2011-190021 | A | 9/2011 |
| JP | 2011-207563 | A | 10/2011 |
| JP | 2011-256008 | A | 12/2011 |
| JP | 2015-016973 | A | 1/2015 |
| JP | 2015-020339 | A | 2/2015 |
| JP | 2015-027915 | A | 2/2015 |

OTHER PUBLICATIONS

Office Action dated Jan. 4, 2019, in Chinese Patent Application No. 201680021736.4.
Office Action dated Mar. 4, 2019, in Japanese Patent Application No. 2015-082873.
Search Report dated Jan. 11, 2019, in European Patent Application No. 16779769.5.
International Preliminary Report on Patentability dated Oct. 26, 2017, in International Application No. PCT/JP2016/001998.

* cited by examiner

MULTI-BINDING

RIGHT CORNER BINDING

LEFT CORNER BINDING

MANUAL BINDING

ECO-BINDING

ENLARGED VIEW OF ECO-BINDING PORTION

ENLARGED CROSS-SECTION TAKEN ALONG LINE A–A

SHEET BUNDLE BINDING APPARATUS AND IMAGE FORMING SYSTEM INCLUDING SHEET BUNDLE BINDING APPARATUS

TECHNICAL FIELD

The present invention relates to, for example, a sheet bundle binding apparatus configured to automatically perform stapleless binding to a plurality of sheets having been conveyed from an image forming apparatus so as to be formed into a bundle, and also relates to an image forming system including the sheet bundle binding apparatus.

BACKGROUND ART

Hitherto, there has been used a stapleless binding apparatus having the following configuration. The stapleless binding apparatus stacks a plurality of sheets and sandwiches the plurality of sheets with a strong pressure between a pair of clamping teeth each having a corrugated shape, to thereby clamp the sheets and bind a sheet bundle without use of a metal staple. This stapleless binding apparatus has a problem in that the sheet bundle adheres to one of the clamping teeth when the clamping teeth are to be separated.

In Patent Literature 1, there is disclosed a sheet bundle binding apparatus having the following configuration. In the sheet bundle binding apparatus, side alignment members configured to uniformly align a sheet bundle on a processing tray in a direction orthogonal to a sheet delivery direction are used to kick or thrust out a sheet bundle, which has been subjected to binding, from a side to separate the sheet bundle from a pressing surface of a stapleless binding portion. The side alignment members are driven by an alignment motor so as to once perform a back-swing motion to positions away from positions of being engaged with sheet side edges. After that, the side alignment members move to a sheet center side to kick the sheet bundle. Further, in Patent Literature 2, there is disclosed a post-processing mechanism having the following configuration. The post-processing mechanism stacks sheets from a sheet delivery port of an image forming apparatus onto a processing tray and allows an operator to select which of staple binding and stapleless binding to be performed to the sheet bundle.

CITATION LIST

Patent Literature

PTL 1: Japanese Patent Application Laid-Open No. 2015-20339

PTL 2: Japanese Patent Application Laid-Open No. 2011-190021

SUMMARY OF INVENTION

Technical Problem

The present invention has an object to enable easy removal of a sheet bundle, which has been subjected to binding, from the clamping teeth.

Solution to Problem

In order to achieve the above-mentioned object, according to one embodiment of the present invention, there is provided a binding apparatus including: a sheet placement portion on which sheets are placed; an alignment unit configured to align the sheets placed on the sheet placement portion; a binding member configured to bind the sheets placed on the sheet placement portion by deforming the sheets without using a staple; and a separating member configured to apply a rotational force to the sheets which are bound by the binding member to separate the sheets and the binding member from each other, the alignment unit and the separating member being constructed by different members.

DESCRIPTION OF EMBODIMENTS

Figure 1:
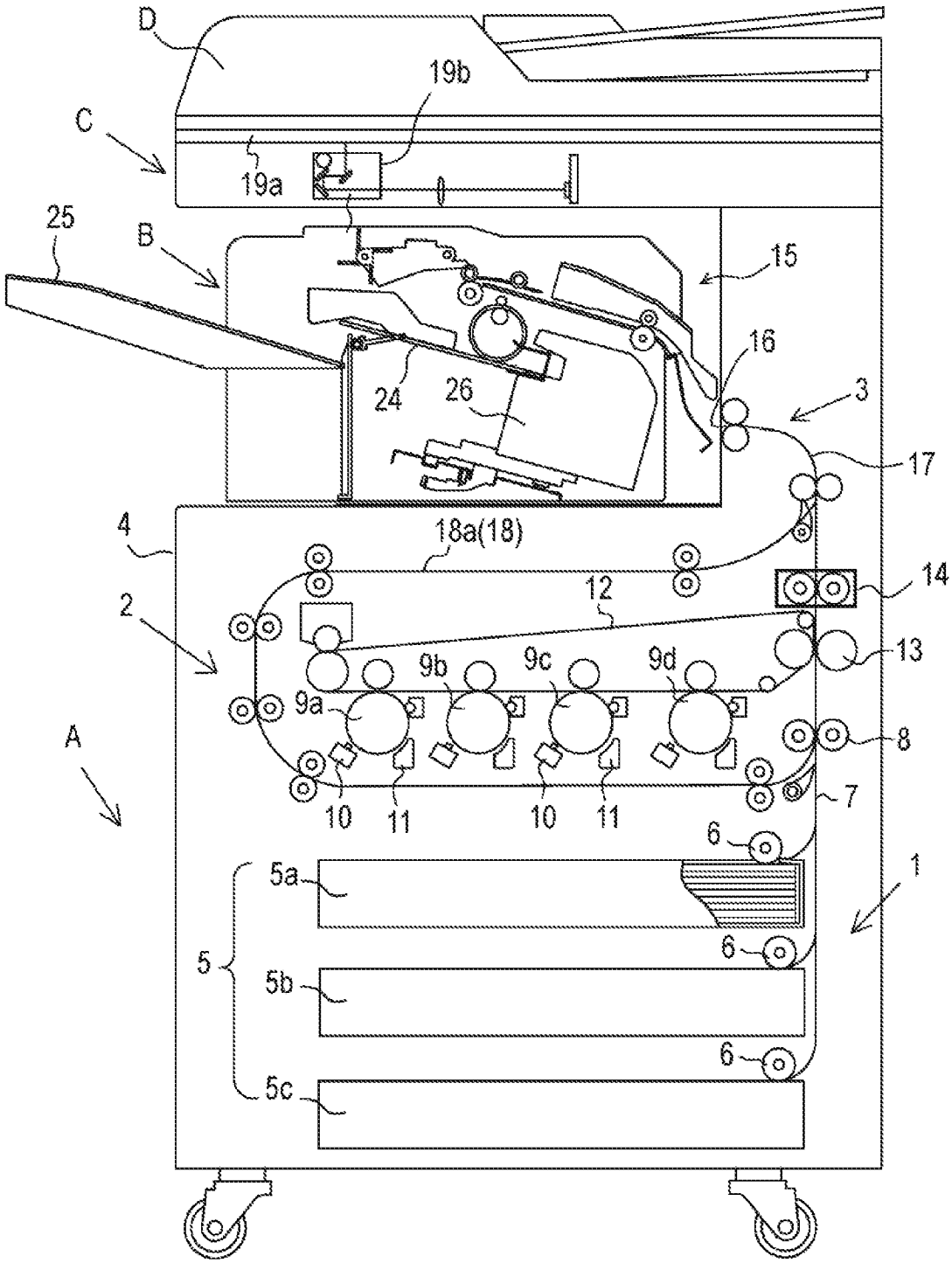
FIG. 1 is an explanatory view for illustrating an overall configuration of an image forming system according to one embodiment of the present invention.

Now, the present invention is described in detail with reference to the embodiments illustrated in the drawings. The present invention relates to a sheet bundle binding mechanism configured to perform binding to a sheet bundle which has been aligned and stacked after being subjected to image formation in an image forming system.

Herein, the term "offset conveyance of sheet bundle" represents positional movement or widthwise movement of a bundle of sheets, which have been fed from a sheet delivery port, in a direction orthogonal to or intersecting a sheet conveyance direction. The term "offset amount" represents the movement amount of the positional movement. Further, the "alignment of sheet bundle" represents positioning of sheets, which have been fed from the sheet delivery port, in accordance with a reference, which is a center reference or a one-side reference. Thus, the term "align and thereafter offset sheets" represents that sheets are positioned in accordance with the reference and thereafter are entirely moved in the direction orthogonal to the conveyance direction of the sheets.

The image forming system illustrated in FIG. 1 includes an image forming unit A, an image reading unit C, and a post-processing unit B. The image reading unit C reads an original image, and the image forming unit A forms an image on a sheet based on read image data. The post-processing unit B, which corresponds to a sheet bundle binding apparatus to be referred hereinafter, aligns and stacks sheets having been subjected to image formation, performs binding to the sheets, and then stores the sheets on a stack tray 25 on downstream.

The post-processing unit B is provided as a unit in a sheet delivery space (stack tray space) 15 formed in a housing of the image forming unit A. Further, the post-processing unit B has an inner finisher structure including a post-processing mechanism configured to align and stack sheets for image formation which have been delivered to the sheet delivery port 16, perform binding to the sheets, and thereafter store the sheets on the stack tray 25 arranged on downstream. This embodiment is not limited to the above-mentioned configuration. The image forming unit A, the image reading unit C, and the post-processing unit B may be constructed to have an independent stand-alone structure, and the units may be connected with network cables to form a system.

[Sheet Bundle Binding Apparatus (Post-processing Unit)]

Figure 2:
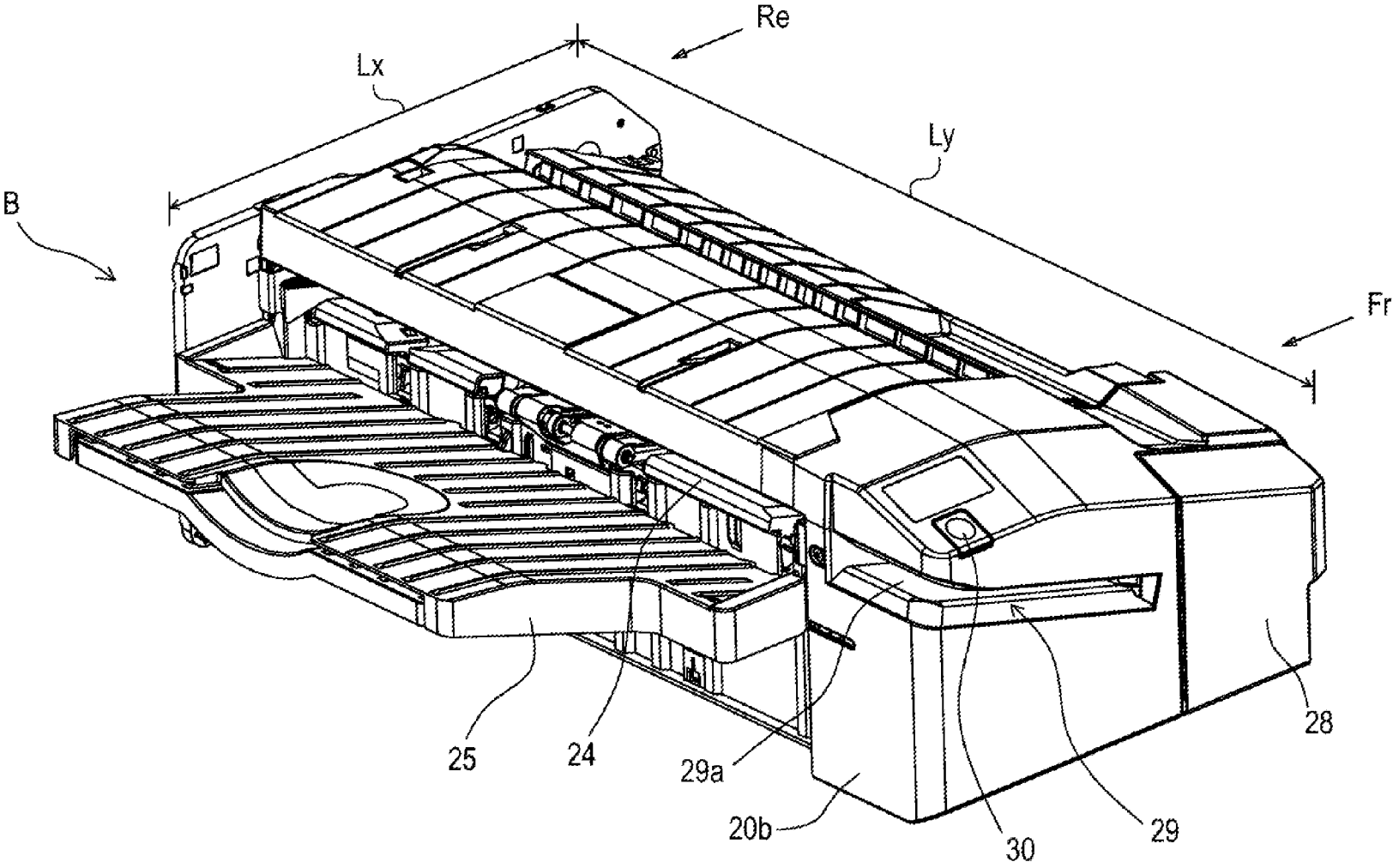
FIG. 2 is an explanatory perspective view for illustrating an overall configuration of a post-processing apparatus in the image forming system of FIG. 1.
Figure 3:
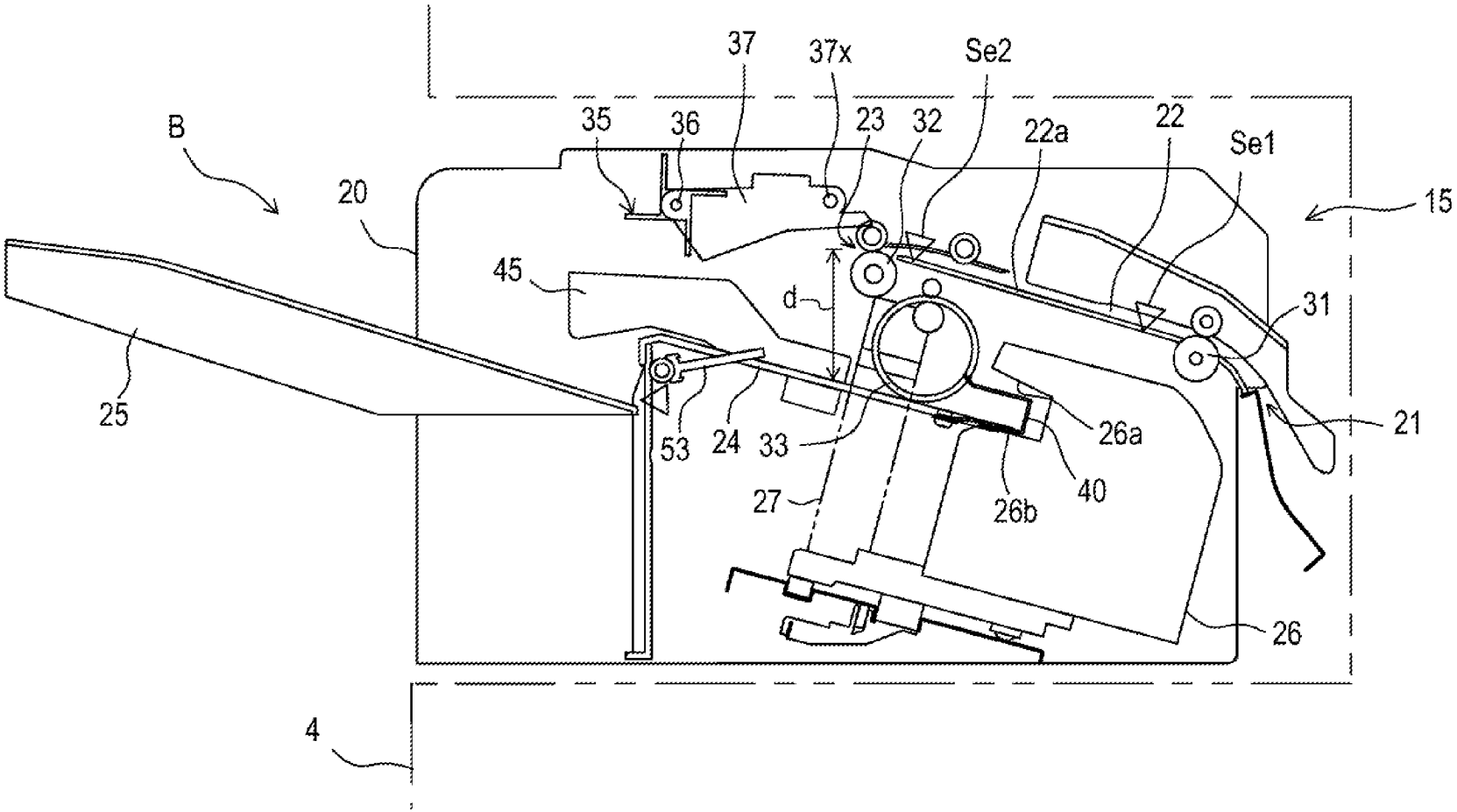
FIG. 3 is a side sectional view of the apparatus of FIG. 2 (front side of the apparatus).
Figure 4A:
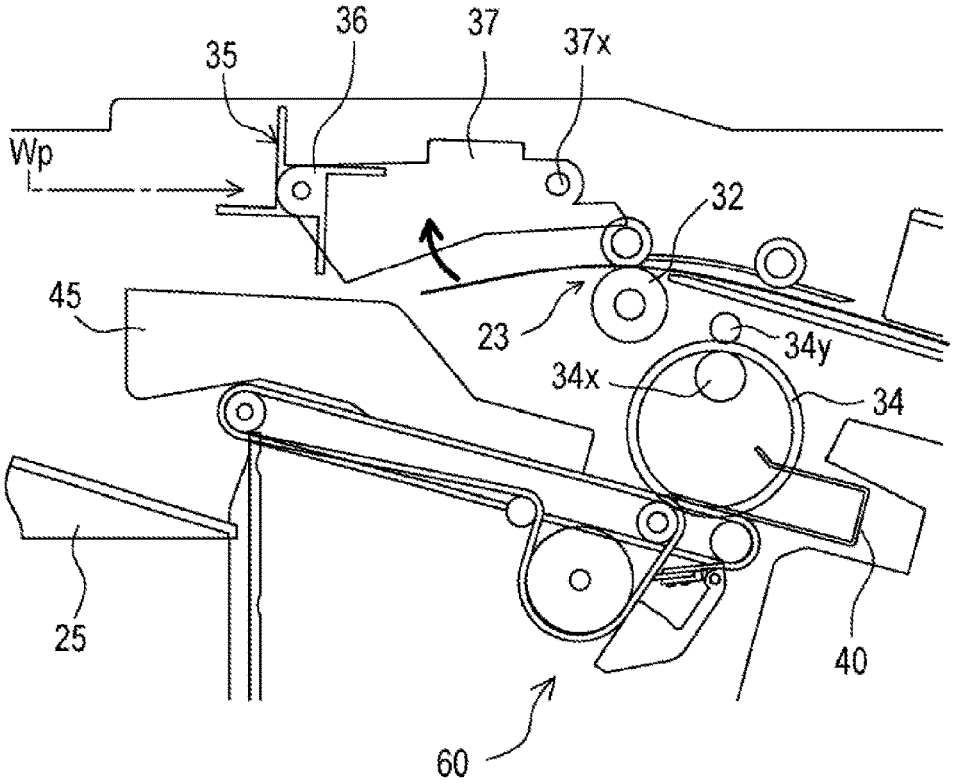
FIG. 4A is an explanatory view of a sheet carry-in mechanism in the apparatus of FIG. 2, and is an illustration of a state in which paddle rotary members are at waiting positions.
Figure 4B:
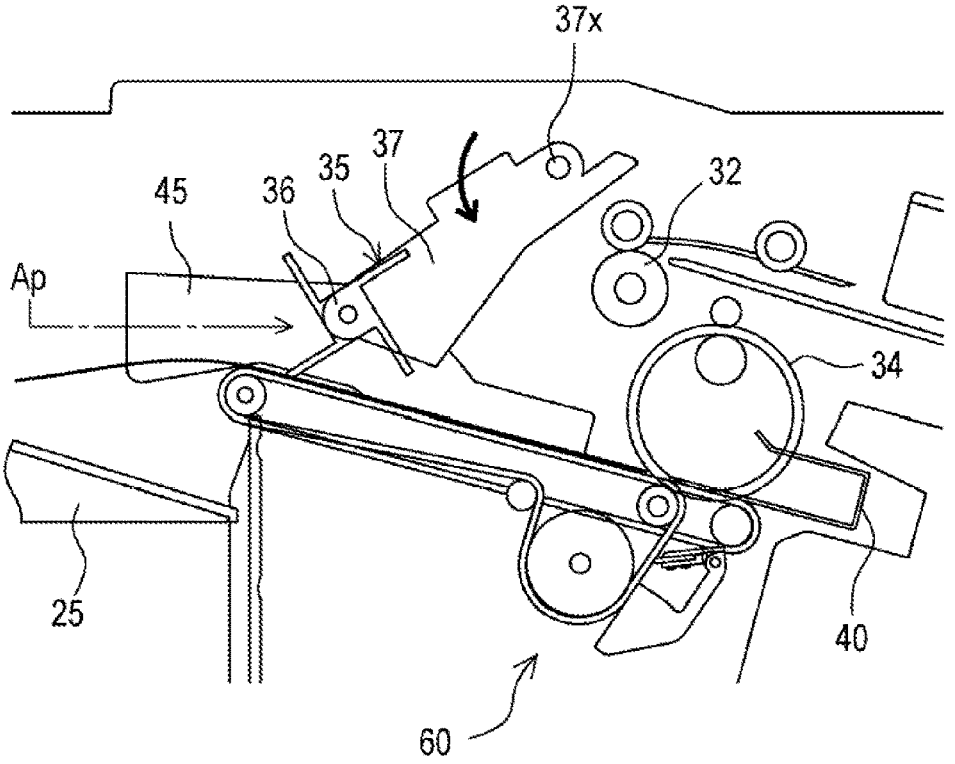
FIG. 4B is an explanatory view of the sheet carry-in mechanism in the apparatus of FIG. 2, and is an illustration of a state in which the paddle rotary members are at engagement positions.

FIG. 2 is an illustration of a configuration of the post-processing unit B in perspective view. FIG. 3 is an illustration of a configuration of the post-processing unit B in sectional view. The post-processing unit B includes an apparatus housing 20, a sheet carry-in passage 22 arranged in the housing, a processing tray 24 arranged on downstream of a sheet delivery port 23 of the sheet carry-in passage 22, and a stack tray 25 arranged on downstream of the processing tray 24.

At the processing tray 24, there are arranged a sheet carry-in portion 35 configured to carry sheets therein, a sheet regulation portion 40 configured to stack the fed sheets to form a bundle, and a sheet alignment mechanism 45. Together with the above-mentioned components, at the processing tray 24, there are arranged a staple binding portion 26 (first binding portion) configured to perform staple binding to a sheet bundle and a stapleless binding portion 27 (second binding portion) configured to perform stapleless binding to a sheet bundle. Details of each configuration are described in the following.

[Apparatus Housing]

The apparatus housing 20 includes an apparatus frame 20*a* and an outer casing 20*b*. The apparatus frame 20*a* has a frame structure configured to support each of mechanism portions such as a passage mechanism, a tray mechanism, and a conveyance mechanism. The illustrated outer casing 20*b* has a monocoque structure in which side frames 20*c* and 20*d* are integrated to the outer casing 20*b*, and a binding mechanism, the conveyance mechanism, the tray mechanism, and a driving mechanism are arranged on the right and left pair of side frames 20*c* and 20*d* being opposed to each other.

The outer casing 20*b* has the monocoque structure in which the left side frame 20*d*, the right side frame 20*c*, and a stay frame (bottom frame 20*e*) connecting both the side frames 20*c* and 20*d* are integrated through resin molding. A part of the outer casing 20*b* (an apparatus front side) is exposed so as to enable operation from an outside.

An outer periphery of the frame assembly is covered with the outer casing 20*b*, and the outer casing 20*b* is provided in a sheet delivery space 15 of the image forming unit A. In that state, a part of the outer casing 20*b* on the apparatus front side is exposed so as to enable operation from the outside. On the front side of the outer casing 20*b*, there are provided an opening 28 for mounting a staple cartridge, a manual feed set portion 29, and a manual operation button 30. The illustrated manual operation button 30 is a switch provided with an indication lamp.

A length dimension Lx of the outer casing 20*b* in a sheet delivery direction and a length dimension Ly of the outer casing 20*b* in a direction orthogonal to the sheet delivery direction are set based on a maximum size sheet as a reference, and are smaller than those of the sheet delivery space 15 of the image forming unit A.

[Sheet Carry-in Passage (Sheet Delivery Passage)]

In the apparatus housing 20, there is arranged a sheet carry-in passage 22 (hereinafter referred to as "sheet delivery passage") having a carry-in port 21 and a sheet delivery port 23 as illustrated in FIG. 3. The sheet delivery passage 22 in FIG. 3 is configured to receive a sheet from a horizontal direction, convey the sheet in a substantially horizontal direction, and discharge the sheet through the sheet delivery port 23. The sheet delivery passage 22 is formed of a suitable paper guide (plate) 22*a*, and has a built-in feeder mechanism configured to convey the sheet.

This feeder mechanism includes conveyance roller pairs which are arranged at a predetermined interval in accordance with a passage length. In the illustrated feeder mechanism, a feed roller pair 31 is arranged in the vicinity of the carry-in port 21, and a sheet delivery roller pair 32 is arranged in the vicinity of the sheet delivery port 23. On the sheet delivery passage 22, there is arranged a sheet sensor Se1 configured to detect a leading edge and/or a trailing edge of a sheet.

The sheet delivery passage 22 is formed of a straight passage extending across the apparatus housing 20 in the substantially horizontal direction. The straight passage is employed to avoid stress on a sheet caused by a curved passage, and the passage is formed to have a straightness which is allowable in view of an apparatus layout. The carry-in roller pair 31 and the sheet delivery roller pair 32 are connected to the same drive motor M1 (hereinafter referred to as "conveyance motor"), and convey a sheet at equal peripheral speed.

[Processing Tray]

Description is made with reference to FIG. 3. On downstream of the sheet delivery port 23 of the sheet delivery passage 22, the processing tray 24 is arranged so as to form a level difference d. In order to stack sheets, which are delivered from the sheet delivery port 23, one on another to form a bundle, the processing tray 24 has a sheet placement surface 24*a* configured to support at least a part of sheets. The illustrated post-processing unit B employs a structure of supporting the sheet leading edge side with the stack tray 25 and supporting the sheet trailing edge side with the processing tray 24 (bridge support structure). With this, the dimension of the tray is reduced.

The processing tray 24 is configured to stack sheets which are delivered from the sheet delivery port 23 to form a bundle, align the sheets to take a predetermined posture, then perform the binding processing to the sheets, and discharge the processed sheet bundle to the stack tray 25 on downstream. Therefore, "the sheet carry-in mechanism 35", "the sheet alignment mechanism 45", "the binding mechanisms 26 and 27", and "the sheet bundle carry-out mechanism 60" are incorporated to the processing tray 24.

[Sheet Carry-in Mechanism (Sheet Carry-in Portion)]

The processing tray 24 is arranged so as to form the level difference d with respect to the sheet delivery port 23. It is necessary to provide the sheet carry-in portion 35 configured to smoothly convey a sheet in a correct posture to the processing tray 24. The illustrated sheet carry-in portion 35 (friction rotary member) includes paddle rotary members 36 which are lifted up and down. After a sheet trailing edge is discharged to the tray from the sheet delivery port 23, the paddle rotary members 36 convey the sheet in a direction opposite to the sheet delivery direction, that is, in a right direction of FIG. 3, and bring the sheet into abutment against the sheet edge regulation portion 40 to align or position the sheet.

Thus, at the sheet delivery port 23, there is arranged a lifting arm 37 which is axially supported on the apparatus frame 20*a* so as to be swingable about a support shaft 37*x*. The paddle rotary members 36 are axially supported at a distal end portion of the lifting arm 37 so as to be rotatable. A pulley (not shown) is mounted to the support shaft 37*x*, and the conveyance motor M1 is connected to the pulley.

A lifting motor M3 (hereinafter referred to as "paddle lifting motor") is connected to the lifting arm 37 through intermediation of a spring clutch (torque limiter), and rotation of the motor causes the lifting arm 37 to be lifted between an upper waiting position Wp and a lower actuating position (sheet engagement position) Ap.

The spring clutch causes the lifting arm 37 to be lifted up from the actuating position Ap to the waiting position Wp by rotation of the paddle lifting motor M3 in one direction. After the lifting arm 37 is brought into abutment against a locking stopper (not shown), the spring clutch causes the lifting arm 37 to wait at the waiting position. Further, the spring clutch is loosened by rotation of the paddle lifting motor M3 in an opposite direction. The lifting arm 37 lowers by its own weight from the waiting position Wp to the lower actuating position Ap and engages with an uppermost sheet on the processing tray 24.

Figure 5:
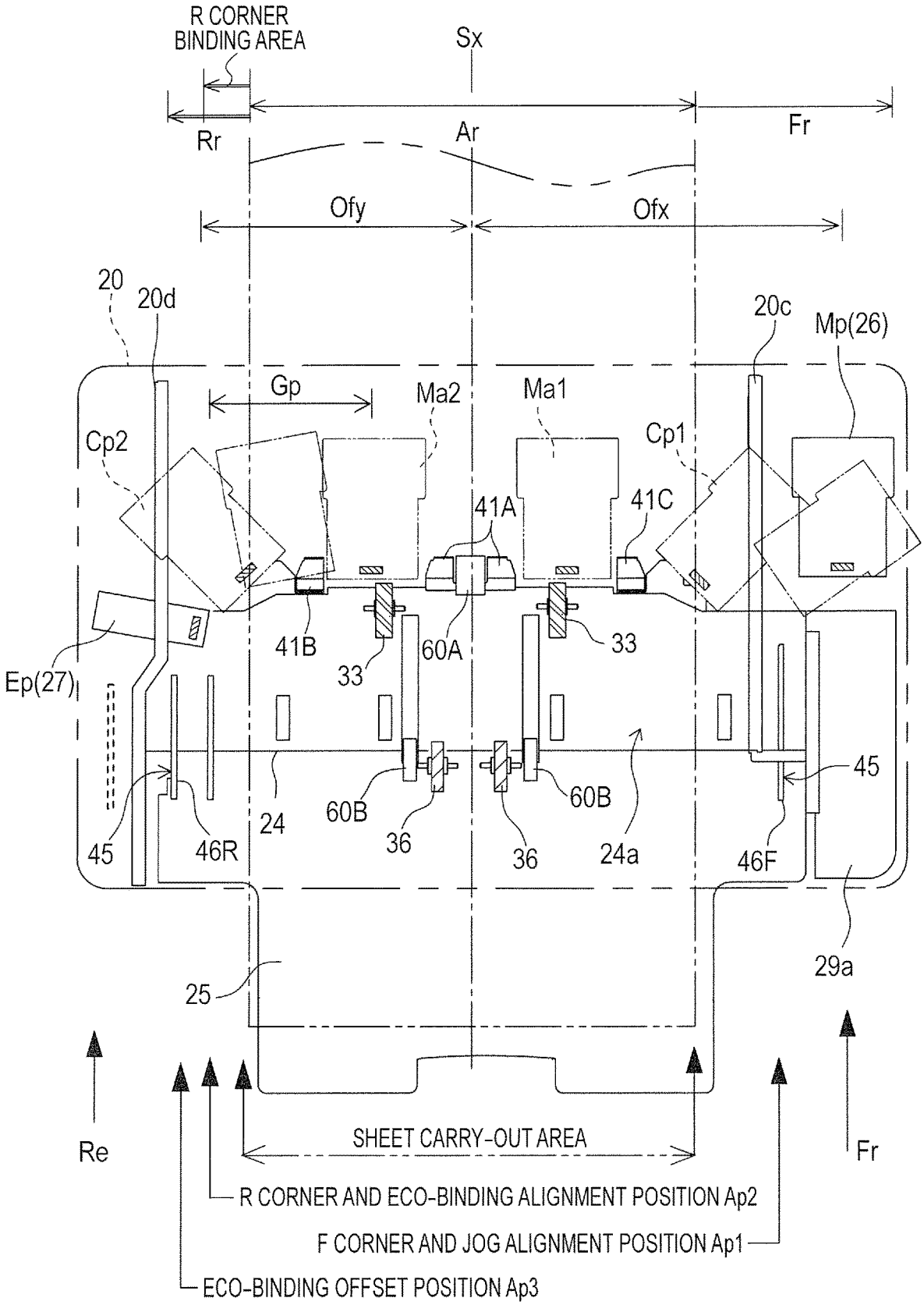
FIG. 5 is an explanatory view for illustrating arrangement relations of respective areas and alignment positions in the apparatus of FIG. 2.

In the illustrated apparatus, a pair of paddle rotary members 36 are arranged apart from each other by a predetermined distance in bilateral symmetry with a sheet center as a reference (center reference Sx), as illustrated in FIG. 5. Other than the above-mentioned configuration, three paddle rotary members may be arranged at the sheet center and both sides thereof, or one paddle rotary member may be arranged at the sheet center.

Each of the paddle rotary members 36 may be constructed by a flexible rotary member such as a plate-like member made of rubber or by a blade member made of plastic. Other than the above-mentioned paddle rotary members, the sheet carry-in portion 35 may be constructed by a friction rotary member such as a roller member or a belt member. The illustrated apparatus has the mechanism configured to lift down the paddle rotary members 36 from the upper waiting positions Wp to the lower actuating positions Ap after the sheet trailing edge is discharged from the sheet delivery port 23. However, the following lifting mechanism may also be employed.

For example, when the sheet leading edge is discharged from the sheet delivery port 23, a lifting mechanism which is different from the illustrated lifting mechanism lifts down the friction rotary member from the waiting position to the actuating position, and at the same time, rotates the friction rotary member in the sheet delivery direction. At a timing at which the sheet trailing edge is discharged from the sheet delivery port 23, the rotary member is reversely rotated in a direction opposite to the sheet delivery direction. With this, the sheet discharged from the sheet delivery port 23 can be conveyed to a predetermined position of the processing tray 24 at high speed without causing skew.

[Raking Rotary Member (Raking Conveyance Portion)]

When a sheet is conveyed to the predetermined position of the processing tray 24 with the sheet carry-in mechanism 35 (paddle rotary members) arranged at the sheet delivery port 23, it is necessary to provide a raking conveyance portion 33 configured to guide a sheet leading edge to the regulation stopper 40 on downstream for a curled sheet or a skewed sheet.

In the illustrated apparatus, there are arranged raking rotary members (raking conveyance portion) 33 configured to apply a conveyance force, which is directed toward the regulation member side, to the uppermost sheet of sheets which are placed below the sheet delivery roller pair 32 and on upstream of the sheet edge regulation stopper 40. For the illustrated raking rotary members 33, ring-shaped belt members 34 (hereinafter referred to as "raking belts") are arranged above a distal end portion of the processing tray 24. The raking belts 34 are engaged with an uppermost sheet on the sheet placement surface and are rotated in a direction of conveying the sheet toward the regulation member side.

Thus, the raking belts 34 are made of a flexible material such as rubber. Further, each of the raking belts 34 is constructed by a belt member such as a knurled belt having a high frictional force, and is nipped and supported between a rotary shaft 34*x* and an idle shaft 34*y* connected to a drive motor. The drive motor for the illustrated raking belts 34 is in common with the conveyance motor M1. In FIG. 3, a rotational force in a counterclockwise direction is applied from the rotary shaft 34*x*. Together with this, the raking belts 34 bring a leading edge of a sheet, which is fed along the uppermost sheet placed on the processing tray 24, into abutment against the regulation stopper 40 on downstream, while pressing the sheet leading edge.

The raking belts 34 are configured to move up and down above the uppermost sheet on the tray by a belt shift motor M5 (hereinafter referred to as "knurled member lifting motor"). The lifting mechanism is omitted. At a timing at which the sheet leading edge enters a position between belt surfaces and the uppermost sheet, the raking belts 34 are lifted down to be engaged with the fed sheet. Further, when the raking belts 34 convey the sheet from the processing tray 24 to the stack tray 25 on downstream with the sheet bundle carry-out portion 60, the knurled member lifting motor M5 is controlled to cause the raking belts 34 to separate from the uppermost sheet and wait above the uppermost sheet.

[Sheet Alignment Mechanism]

At the processing tray 24, there is arranged the sheet alignment mechanism 45 configured to position the fed sheet to a predetermined position (processing position). The illustrated sheet alignment mechanism 45 includes "the sheet edge regulation portion 40" and "the sheet alignment mechanism 45". The sheet edge regulation portion 40 is configured to regulate a position of an edge surface (leading edge surface or trailing edge surface) of the sheets, which have been delivered from the sheet delivery port 23, in the sheet delivery direction. The sheet alignment mechanism 45 is configured to perform widthwise alignment with respect to the sheets in the direction orthogonal to the sheet delivery direction, that is, in the sheet side direction. In the following, description is made in the stated order.

[Sheet Edge Regulation Portion]

The illustrated sheet edge regulation portion 40 includes trailing edge regulation members 41 configured to regulate the trailing edges in the sheet delivery direction through abutment. Each of the trailing edge regulation members 41 includes a regulation surface 41*a* configured to regulate the trailing edges of the sheets, which are fed along the sheet placement surface 24*a* on the processing tray 24, in the sheet delivery direction through abutment. The trailing edge regulation members 41 are configured to bring the trailing edges of the sheets, which are conveyed by the raking conveyance portion 33, into abutment against the regulation surfaces 41*a* to stop the sheets.

When multi-binding is performed by the stapler portion 26, the stapler unit 26 moves along the sheet trailing edges in the direction orthogonal to the sheet delivery direction. In order to avoid interference with the movement of the unit, the trailing edge regulation members 41 (1) employ a mechanism configured to cause the trailing edge regulation members 41 to enter or retreat with respect to a movement path or a motion trajectory of the binding unit, (2) employ a mechanism configured to move integrally with the binding unit, or (3) are constructed by a bent piece having, for example, a channel shape to be arranged in a binding space formed of a head and an anvil of the binding unit.

Each of the illustrated trailing edge regulation members 41 is constructed by a plate-like bent member having a U-shaped or channel-shaped cross-section to be arranged in the binding space for the staple binding portion 26. First members 41A are arranged at a sheet center with a minimum size sheet as a reference, and a second member 41B and a third member 41C are arranged apart on right and left of the first members 41A (see FIG. 5). With this, the staple binding unit 26 can be moved in a sheet width direction.

Figure 7:
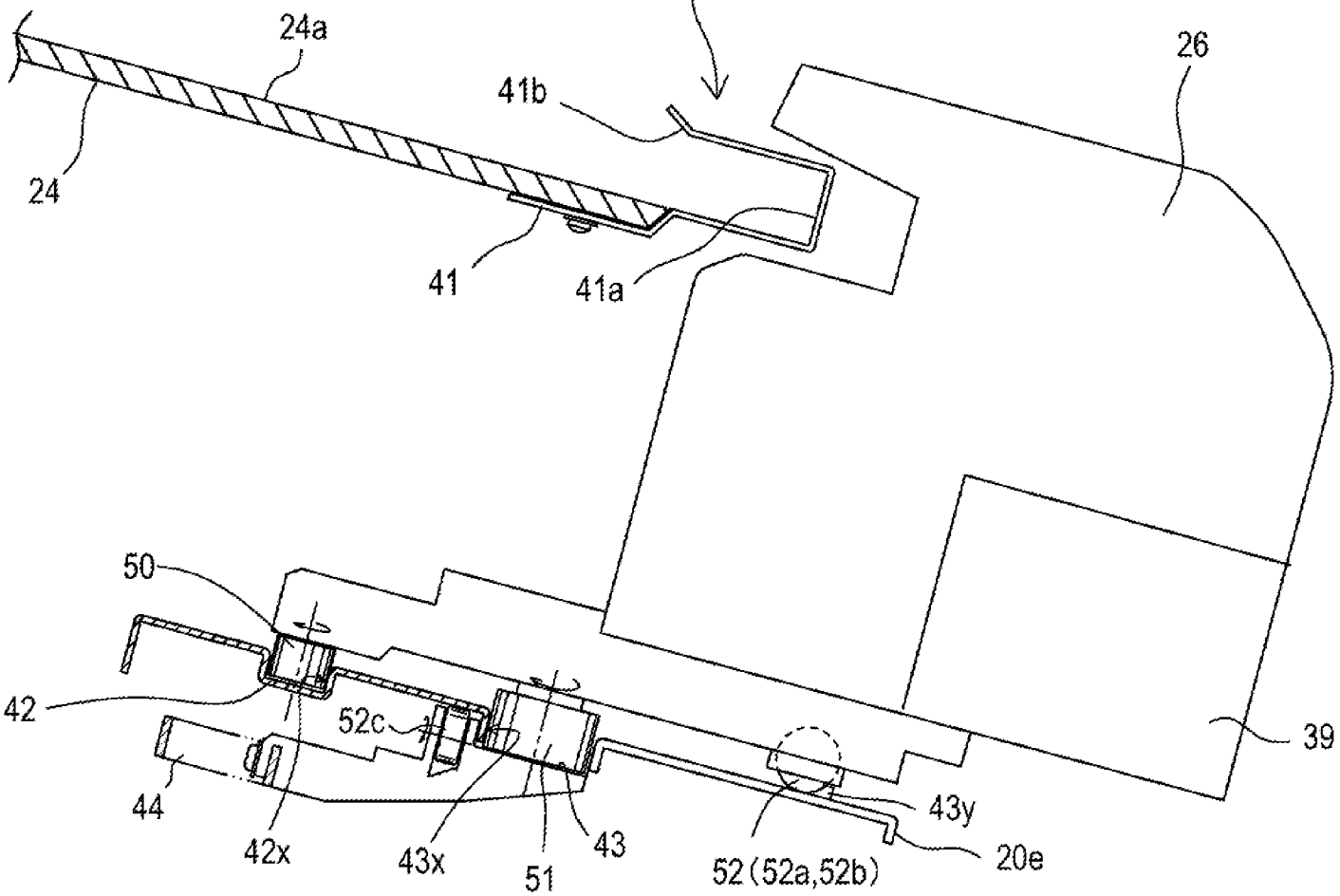
FIG. 7 is an explanatory view of a moving mechanism for a stapler unit.

As illustrated in FIG. 5 and FIG. 7, a plurality of trailing edge regulation members 41 each formed of a bent piece having a channel shape are fixed to the processing tray 24. Specifically, distal end portions of the members are fixed to a back wall of the tray by screws. Each trailing edge regulation member 41 has the regulation surface 41*a*. At a bent distal end portion of each edge regulation member 41, an inclined surface 41*b* configured to guide the sheet edges to the regulation surface is continuously provided.

[Side Alignment Mechanism]

At the processing tray 24, there is arranged the sheet alignment mechanism 45 (hereinafter referred to as "side alignment members") configured to position sheets, which have been brought into abutment against the trailing edge regulation members 41, in the direction orthogonal to the sheet delivery direction, that is, in the sheet width direction.

The configuration of the sheet alignment mechanism 45 differs based on whether the sheet on the processing tray 24 is to be aligned with the center reference or with the one-side reference. In the apparatus illustrated in FIG. 5, the sheets are delivered from the sheet delivery port 23 with the center reference, and are aligned on the processing tray with the center reference. The sheet bundle aligned in a form of a bundle with the center reference is bound in accordance with binding processing. When the multi-binding is performed, the sheet bundle taking the aligned posture is subjected to binding by the stapler unit 26 at binding positions Ma1 or Ma2. When right or left corner binding is performed, the sheet bundle is offset by a predetermined amount in the right or left direction, and subjected to binding by the stapler units 26 at binding positions Cp1 or Cp2.

Thus, in the sheet alignment mechanism 45, a pair of side alignment members 46 (46F and 46R) are arranged so as to be opposed to each other on right and left. Each of the pair of side alignment members 46 protrudes upward from the sheet placement surface 24*a* of the processing tray 24 and has a regulation surface 46*x* to be engaged with a side edge of the sheets. The pair of right and left side alignment members 46 are arranged at the processing tray 24 so as to be reciprocable by a predetermined stroke. The stroke is set in accordance with a size difference between a maximum size sheet and a minimum size sheet and an offset amount by which the aligned sheet bundle is moved rightward or leftward (offset conveyance). That is, the movement stroke of the left side alignment member 46R and the right side alignment member 46F is set in accordance with the movement amount for alignment of the sheets and the offset amount of the aligned sheet bundle.

Figure 6:
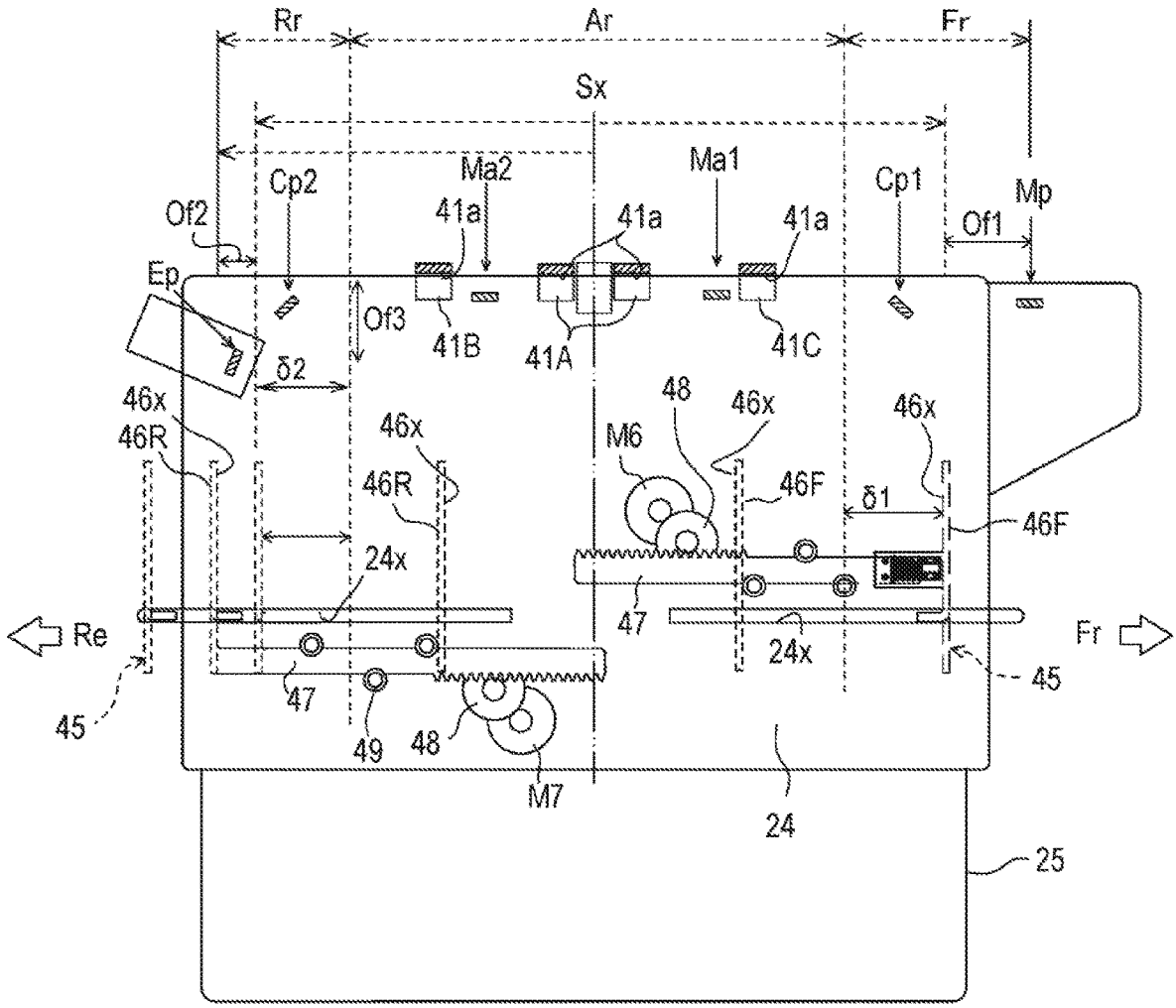
FIG. 6 is an explanatory view of a configuration of a side alignment mechanism in the apparatus of FIG. 2.

Thus, the side alignment members 46 include, as illustrated in FIG. 6, the right side alignment member 46F on the apparatus front side and the left side alignment member 46R on the apparatus rear side. The both side alignment members 46 are supported on the tray member so that the regulation surfaces 46*x* to be engaged with sheet side edges move relative to each other in an approaching direction or a separating direction. Slit grooves 24*x* are formed in the processing tray 24 so as to penetrate through front and back surfaces, and the side alignment members 46 having the regulation surfaces 46*x* to be brought into engagement with sheet side edges are slidably fitted to the tray upper surface through the slits.

Each of the side alignment members 46F and 46R is supported on the tray back surface side so as to be slidable with a plurality of guide rollers 49, which may be rail members. A rack 47 is integrally formed with each of the side alignment members 46F and 46R. Alignment motors M6 and M7 are connected to the right and left racks 47, respectively, through intermediation of pinions 48. The left alignment motor M7 and the right alignment motor M6 are each constructed by a stepping motor. Positions of the left side alignment member 46R and the right side alignment member 46F are detected by position sensors (not shown). Each regulation member can be moved rightward or leftward by a designated movement amount with the detected value as a reference.

There may also be employed a configuration in which, without use of the illustrated rack-pinion mechanism, each of the side alignment members 46F and 46R is fixed to a timing belt, and the belt is connected through a pulley to a motor configured to reciprocate the belt rightward and leftward.

A control portion 75 constructed by a control CPU 75 controls the right and left side alignment members 46 to wait at predetermined waiting positions, which are +α positions with respect to the width size of the sheet, based on sheet size information provided by the image forming unit A. In this state, the control portion 75 starts the alignment operation at a timing at which the sheet edge is brought into abutment against the sheet edge regulation members 41 after the sheet is fed to the processing tray 24. During this alignment operation, the left alignment motor M7 and the right alignment motor M6 are rotated by equal amount in opposite directions, that is, in approaching directions. Thus, the sheets having been fed to the processing tray 24 are positioned with the sheet center as a reference and stacked to form a bundle. Through repetition of the carry-in operation and the alignment operation for the sheets, the sheets are aligned and stacked to form a bundle on the processing tray 24. At this time, the sheets are positioned with the center reference.

The sheets having been stacked on the processing tray 24 with the center reference can be subjected to binding to the sheet trailing edge or leading edge at a plurality of positions at predetermined intervals in that posture, that is, subjected to the multi-binding. When a sheet corner is to be subjected to binding, one of the left side alignment member 46R and the right side alignment member 46F is moved to a position at which a sheet side edge matches with the designated binding position, and then is caused to stop thereat. Then, the side alignment member on the opposite side is moved in the approaching direction. The movement amount in the approaching direction is calculated in accordance with a sheet size. With this, when the right corner binding is to be performed, the sheets having been fed to the processing tray 24 are aligned so that the right side edge matches with the binding position. When binding at the left corner binding position, the sheets having been fed to the processing tray 24 are aligned so that the left side edge matches with the binding position.

When the sheet bundle having been aligned at a predetermined position on the processing tray 24 is to be offset for "eco-binding", there may be employed any of (1) a driving control of moving the alignment member on the rear side in the moving direction by a preset amount in the direction orthogonal to the conveyance direction under a state in which the alignment member on the front side in the moving direction retreats to a position away from a planned offset position, and (2) a driving control of moving the right and left alignment members by equal amounts in the direction orthogonal to the conveyance direction.

For the left side alignment member 46R with the alignment motor M7 and the right side alignment member 46F with the alignment motor M6, there are arranged position sensors (not shown) such as encode sensors to detect positions of the side alignment members 46. Further, the alignment motors M6 and M7 may be constructed by stepping motors, and home positions of the side alignment members 46 may be detected by the position sensors (not shown) to thereby perform PWM control to the motors. Accordingly, the left side alignment member 46R and the right side alignment member 46F can be controlled with a relatively simple control configuration.

[Sheet Bundle Carry-out Mechanism]

Description is made of the sheet bundle carry-out mechanism (sheet bundle carry-out portion 60) illustrated in FIG. 11A to FIG. 11D. At the processing tray 24, there is arranged a sheet bundle carry-out mechanism configured to discharge the sheet bundle, which has been subjected to binding with the first binding portion 26 or the second binding portion 27, to the stack tray 25 on downstream. At the processing tray 24 described with reference to FIG. 5, there are arranged first sheet trailing edge regulation members 41A at the sheet center Sx. The second sheet trailing edge regulation member 41B and the third sheet trailing edge regulation member 41C are arranged apart on right and left of the first sheet trailing edge regulation members 41A. After the sheet bundle locked at the regulation members 41 has been subjected to the binding by the binding portion 26 or the binding portion 27, the sheet bundle is discharged to the stack tray 25 on downstream.

Thus, at the processing tray 24, there is arranged the sheet bundle carry-out portion 60 along the sheet placement surface 24*a*. The illustrated sheet bundle carry-out portion 60 includes a first conveyance member 60A and second conveyance members 60B. A relay conveyance is performed to allow the first conveyance member 60A to convey along a first section Tr1 on the processing tray 24 and allow the second conveyance members 60B to convey along a second section Tr2. Through the relay conveyance of the sheets with the first conveyance member 60A and the second conveyance members 60B, the mechanisms of the conveyance members may have different structures. The member which conveys the sheet bundle from a start point which is substantially the same as that of the sheet trailing edge regulation portion 40 is constructed by a member with less swing, that is, by an elongated support member. The members which cause the sheet bundle to fall on the stack tray 25 at an end point of the conveyance needs to be small because the member travels on a loop trajectory.

Figure 11A:
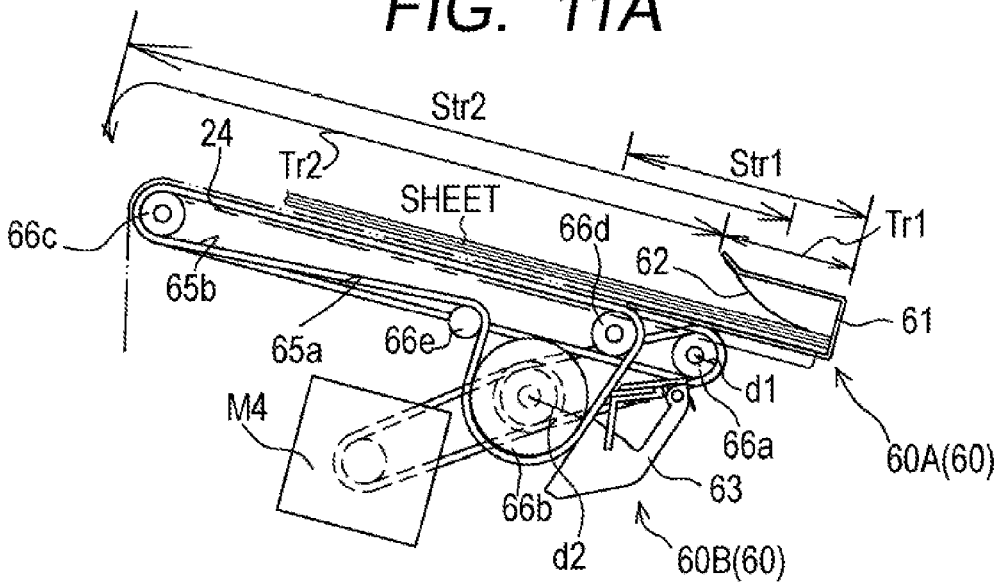
FIG. 11A is an explanatory view of a sheet bundle carry-out mechanism in the apparatus of FIG. 2, and is an illustration of a waiting state.

The first conveyance member 60A includes a first carry-out member 61 formed of a bent piece having a channel-shaped cross-section. The first carry-out member 61 has a locking surface 61*a* configured to lock a trailing edge surface of a sheet bundle and a sheet surface pressing member 62, which is an elastic film member such as a Mylar piece, configured to press an upper surface of the sheets locked by the locking surface 61*a*. The first conveyance member 60A includes the channel-shaped bent piece as illustrated in FIG. 11A, and hence, when the first conveyance member 60A is fixed to a carrier member 65*a* which is a belt, the first conveyance member 60A is less liable to swing and travels integrally with the belt to move or thrust out the trailing edge of the sheet bundle in the conveyance direction. The first conveyance member 60A reciprocates by the stroke Str1 on a substantially linear trajectory without traveling on a curved loop trajectory.

Each of the second conveyance members 60B includes a second carry-out member 63 having a claw shape, and has a locking surface 63*a* configured to lock the trailing edge surface of the sheet bundle and a sheet surface pressing member 64 configured to press an upper surface of the sheet bundle. The sheet surface pressing member 64 is axially supported on the second carry-out member 63 so as to be swingable and has a sheet surface pressing surface 64*a*. The sheet surface pressing surface 64*a* is urged by an urging spring 64*b* so as to press the upper surface of the sheet bundle.

Figure 11B:
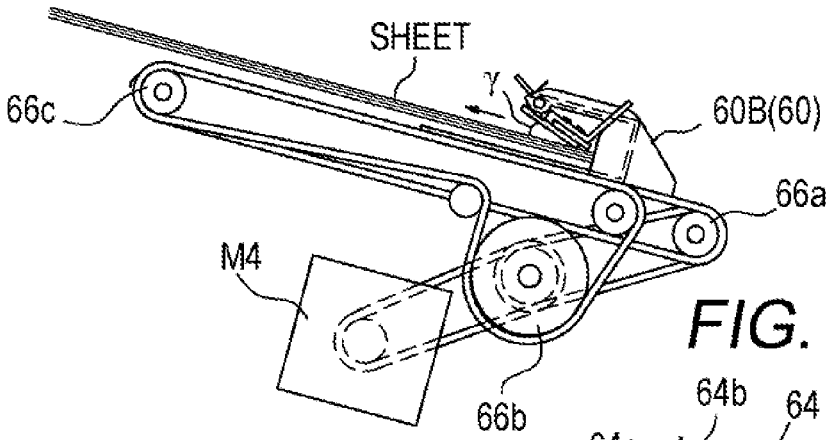
FIG. 11B is an explanatory view of the sheet bundle carry-out mechanism in the apparatus of FIG. 2, and is an illustration of a relay conveyance state.
Figure 11C:
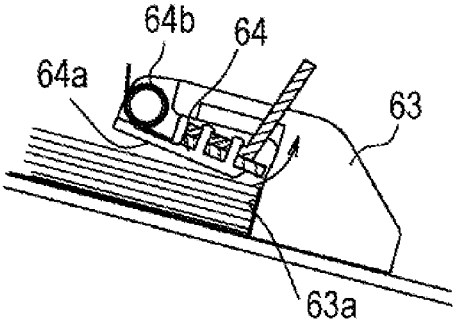
FIG. 11C is an explanatory view of the sheet bundle carry-out mechanism in the apparatus of FIG. 2, and is an illustration of a structure of a second conveyance member.
Figure 11D:
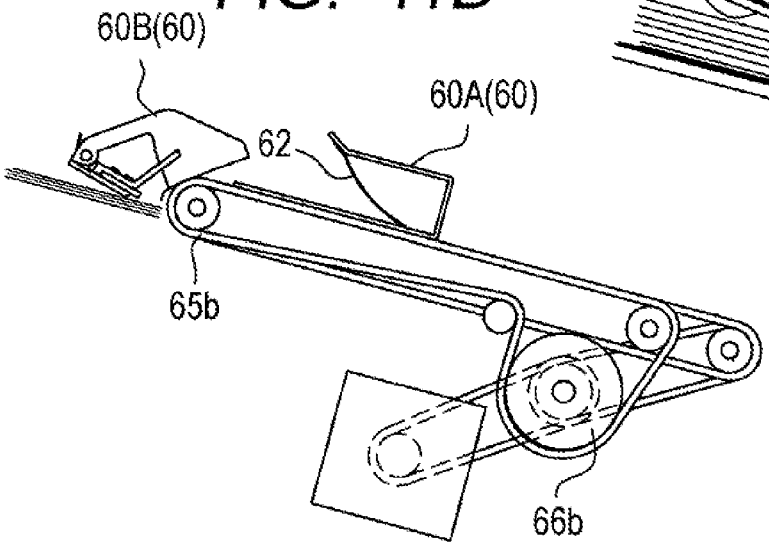
FIG. 11D is an explanatory view of the sheet bundle carry-out mechanism in the apparatus of FIG. 2, and is an illustration of a state in which a sheet bundle has been delivered to a stack tray.

The sheet surface pressing surface 64*a* is constructed by an inclined surface inclined toward the traveling direction as illustrated in FIG. 11C. When the sheet moves in the direction indicated by the arrow of FIG. 11B, the sheet surface pressing surface 64*a* engages with the trailing edge of the sheet at a nipping angle γ. At this time, the sheet surface pressing surface 64*a* is displaced upward in the arrow direction, that is, the counterclockwise direction in FIG. 11B against the urging spring 64*b*. Then, as illustrated in FIG. 11C, the sheet surface pressing surface 64*a* presses the upper surface of the sheet bundle toward the sheet placement surface side by an action of the urging spring 64*b*.

From the base end portion to the outlet end portion of the sheet placement surface 24*a*, the first carry-out member 61 reciprocates with the first carrier member 65*a*, and the second carry-out members 63 reciprocate with the second carrier members 65*b*. Thus, at the sheet placement surface 24*a*, there are arranged driving pulleys 66*a* and 66*b* and a driven pulley 66*c* at positions apart by the conveyance stroke. Idle pulleys 66*d* and 66*e* are also illustrated.

The first carrier member 65*a* is stretched around the driving pulley 66*a* and the driven pulley 66*c*. The illustrated first carrier member 65*a* is a toothed belt. The second carrier members 65*b* (toothed belts) are stretched around the driving pulleys 66*b* and the driven pulley 66*c* through intermediation of the idle pulleys 66*d* and 66*e*. The drive motor M4 is connected to the driving pulleys 66*a* and 66*b*. The first driving pulley 66*a* is formed to have a small diameter, and each of the second driving pulleys 66*b* is formed to have a large diameter. With this, rotation of the motor is transmitted to drive the first carrier member 65*a* at low speed and drive the second carrier members 65*b* at high speed.

The common drive motor M4 drives the first conveyance member 60A to travel at low speed and drives the second conveyance members 60B to travel at high speed through intermediation of a speed reduction mechanism. The speed reduction mechanism may be, for example, a combination of belts and pulleys, or gear connection. Each of the second driving pulleys 66*b* includes a cam mechanism configured to cause delay in drive transmission. This is because the movement stroke Str1 of the first conveyance member 60A and the movement stroke Str2 of the second conveyance members 60B are different from each other, and for the purpose of adjusting the waiting positions of the members.

Figure 25A:
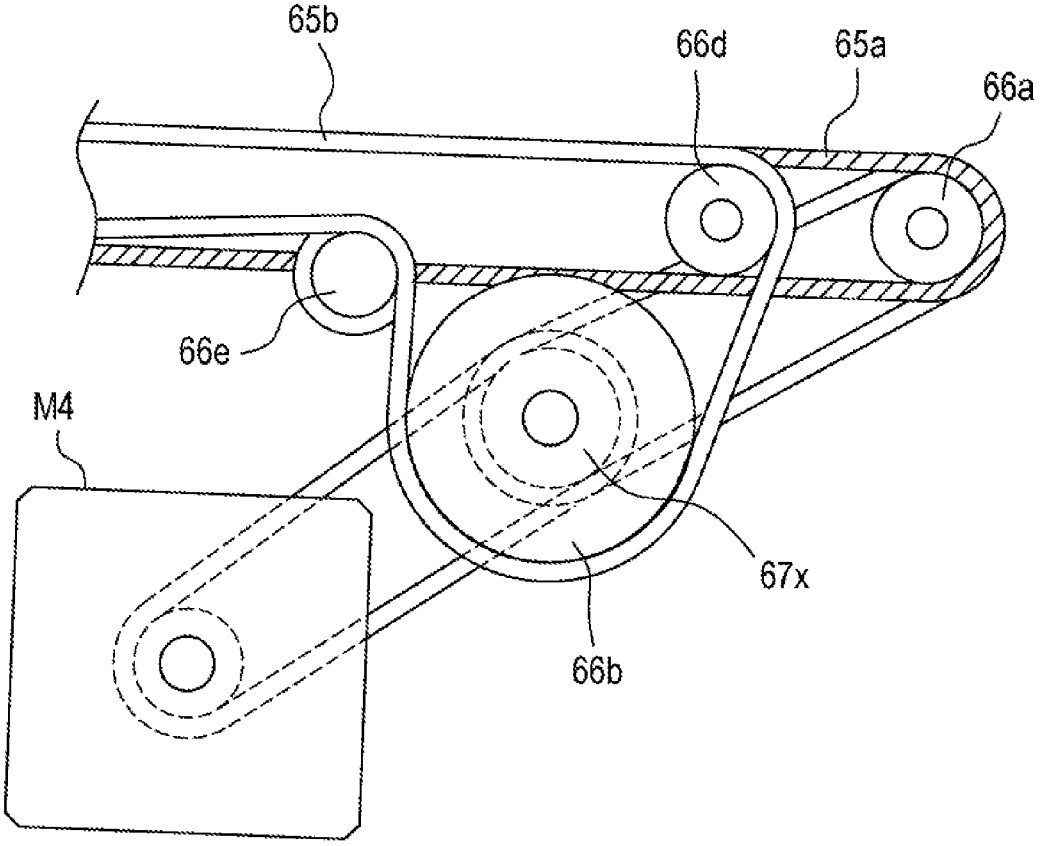
FIG. 25A is an explanatory view of a driving mechanism for the sheet bundle carry-out mechanism, and is an enlarged view for illustrating relevant parts.

The cam structure is described with reference to FIG. 25A to FIG. 25C. The rotation of a rotary shaft of the drive motor M4 is transmitted to the driving pulley 66*a* of the first carrier member (first belt) 65*a* through intermediation of a transmission belt. Thus, forward and reverse rotations of the drive motor M4 are directly transmitted to the first belt 65*a*. The forward rotation of the drive motor M4 causes the first belt 65*a* to travel in the sheet bundle carry-out direction, and the reverse rotation of the drive motor M4 causes the first belt 65*a* to travel in a returning direction.

The rotation of the rotary shaft of the drive motor M4 is transmitted to a rotary shaft 67*x* through intermediation of the transmission belt. Further, the rotation of the rotary shaft 67*x* is transmitted to the driving pulleys 66*b* for the second carrier members (second belts) 65*b* through intermediation of transmission cams including protrusion cams 67*a* and recess cams 67*b*. The transmission cams cause the rotation of the rotary shaft 67*x* by the drive motor M4 to be transmitted to the driving pulleys 66*b* with delay by a predetermined angle.

Figure 25B:
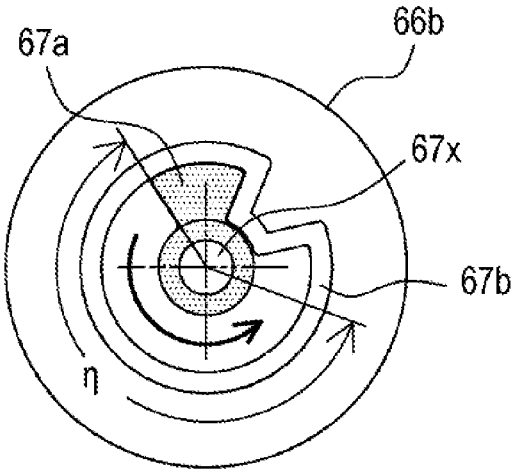
FIG. 25B is an explanatory view of the driving mechanism for the sheet bundle carry-out mechanism, and is an illustration of a state of a rotary shaft and transmission cams of the sheet bundle carry-out mechanism at the time of activation.
Figure 25C:
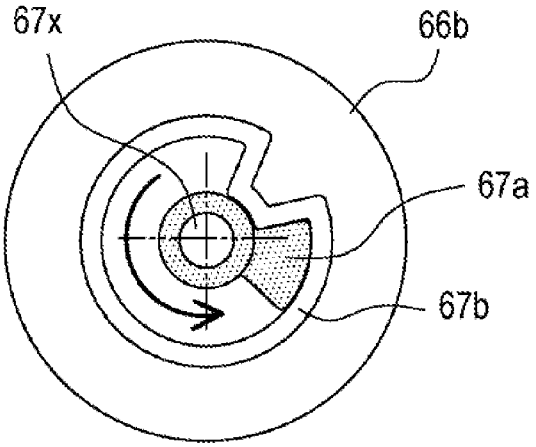
FIG. 25C is an explanatory view of the driving mechanism for the sheet bundle carry-out mechanism, and is an illustration of a state of the rotary shaft and the transmission cams after rotation by a predetermined angle.

FIG. 25B is an illustration of a state of the transmission cams interlocked with the rotary shaft 67*x* at the time of activation of the drive motor M4. FIG. 25C is an illustration of a state of the transmission cams after the drive motor M4 is rotated by a predetermined angle. As illustrated in FIG. 25B and FIG. 25C, the rotary shaft 67*x* which receives the rotation of the rotary shaft of the drive motor M4 has protrusion cams 67*a* integrally formed thereon. The driving pulleys 66*b* have recess cams 67*b* engaged with the protrusion cams 67*a*. The transmission cams are constructed by the protrusion cams 67*a* and the recess cams 67*b*. The protrusion cams 67*a* and the recess cams 67*b* have a play angle η therebetween so that the protrusion cams 67*a* and the recess cams 67*b* are engaged with each other not within a predetermined angle range but engaged after rotation by a predetermined angle. In FIG. 25B, a state at the time of activation of the rotary shaft 67*x* interlocked with the rotary shaft of the drive motor M4 is illustrated. The protrusion cam 67*a* and the recess cam 67*b*, which are rotated in the counterclockwise direction, have the play angle η therebetween. Therefore, the protrusion cams 67*a* are brought into the state of FIG. 25C after rotation by the play angle η. The rotation of the rotary shaft 67*x* is transmitted to the recess cams 67*b*, thereby causing the driving pulleys 66*b* to start rotation.

This similarly applies to the case where the second belts 65*b* return through the reverse rotation of the rotary shaft of the drive motor M4. The second belts 65*b* start traveling with delay by a predetermined angle or distance with respect to the first belt 65*a* and return to a position with delay by a predetermined distance.

Thus, the second conveyance members 60B fixed to the second belts 65*b* start movement with delay by a predetermined distance with respect to the first conveyance member 60A fixed to the first belt 65*a* to return to a position with delay by a predetermined time period. As a result, the waiting positions of the second conveyance members 60B can be set different with respect to a rotation timing of the drive motor M4. With this, when the second conveyance members 60B are caused to wait on a back surface side or a bottom portion of the processing tray 24, the positions can be adjusted.

With the above-mentioned configuration, the first conveyance member 60A reciprocates on a straight trajectory by the first stroke Str1 from the trailing edge regulation position of the processing tray 24, and the first section Tr1 is set within the first stroke Str1. The second conveyance members 60B reciprocate on a semi-loop trajectory by the second stroke Str2 from the first section Tr1 to the outlet end of the processing tray 24, and the second section Tr2 is set within the second stroke Str2.

The first conveyance member 60A moves at a velocity V1 from the sheet trailing edge regulation position to downstream (from FIG. 11A to FIG. 11B) by the rotation of the drive motor M4 in one direction, and pushes the trailing edge of the sheet bundle with the locking surface 61*a* of the first conveyance member 60A to convey the sheet bundle. With the delay by a predetermined time period with respect to the first conveyance member 60A, the second conveyance members 60B protrude from the waiting positions on the back surface side of the processing tray (FIG. 11A) to above the sheet placement surface, and travel at a velocity V2 in the same direction to follow the first conveyance member 60A. At this time, the velocities are set to satisfy V1<V2.

Thus, the sheet bundle on the processing tray is relayed from the first conveyance member 60A to the second conveyance members 60B.

FIG. 11B is an illustration of the relay conveyance state. The sheet bundle which travels at the velocity V1 is caught up by the second conveyance members 60B which travel at the velocity V2. That is, after the first conveyance member 60A passes through the first section Tr1, the first conveyance member 60A is caught up by the second conveyance members 60B, and the second conveyance members 60B engage with the sheet trailing edge surface to convey the sheet bundle along the second section Tr2 to downstream.

When the second conveyance members 60B are brought into abutment at the relay point against the sheet bundle which travels at the velocity V1, the sheet surface pressing members 64 press the upper surface of the sheet bundle with the sheet surface pressing surfaces 64*a*, and discharge the sheet bundle to the stack tray 25 while holding the sheet bundle trailing edge so as to nip the sheet bundle between the sheet surface pressing surfaces 64*a* and the carrier member (belt) 65*a* (the belts 65*b*).

[Binding Method (Binding Position)]

The sheets having been delivered to the carry-in port 21 of the sheet delivery passage 22 are aligned and stacked on the processing tray 24, and are positioned or aligned at a preset position and in a preset posture with the sheet edge regulation member 40 and the side alignment members 46. The binding is performed with respect to the sheet bundle on the processing tray 24, and then the sheet bundle is discharged to the stack tray 25 on downstream. The binding method in this case is described.

For the binding methods, the illustrated apparatus includes, at the processing tray 24, "the first binding portion 26 configured to perform staple binding to a sheet bundle" and "the second binding portion 27 configured to perform stapleless binding to a sheet bundle". The control portion 75 has a first feature of subjecting a sheet bundle to the binding by the first binding portion 26 or the second binding portion 27, which has been selected, and thereafter discharge the sheet bundle to downstream. This feature is employed based on the following reason. When the sheet bundle is subjected to the binding using a staple, book binding which causes the sheet bundle to be less liable to separate can be performed. However, depending on the usage intended by a user, there is a case where the convenience in easily separating the bound sheet bundle is required. Further, there is a case where, when a used sheet bundle is to be shredded through use of a shredder, a metal staple may cause a problem in recycle of used sheets. Thus, this feature is intended to enable selected use of the "staple" binding portion and the "stapleless" binding portion.

The illustrated apparatus has a second feature of performing binding to sheets which have been prepared outside the apparatus or outside of the system (hereinafter referred to as "manual staple processing") in addition to a series of post-processing operations of feeding sheets from the sheet carry-in passage (sheet delivery passage) 22, aligning and stacking the sheets, and thereafter performing the binding.

Therefore, the manual feed set portion 29 configured to allow a sheet bundle to be set from an outside is arranged in the outer casing 20*b*. A manual feed set surface 29*a* configured to enable setting of the sheet bundle is formed in the casing, and the staple binding portion or the stapler unit 26 is moved from a sheet carry-in area Ar of the processing tray 24 to a manual feed area Fr.

With reference to FIG. 8, FIG. 9, and FIG. 10A to FIG. 10C, each binding method is described. In the illustrated apparatus, there are set "multi-binding positions Ma1 and Ma2" for binding to a plurality of positions of sheets with staples, "corner binding positions Cp1 and Cp2" for bundle binding to a sheet corner, "a manual binding position Mp" for binding to sheets which are manually set, and "a stapleless binding position Ep" for stapleless binding to a sheet corner. A positional relationship of the binding positions is described.

[Multi-binding]

Figure 9:
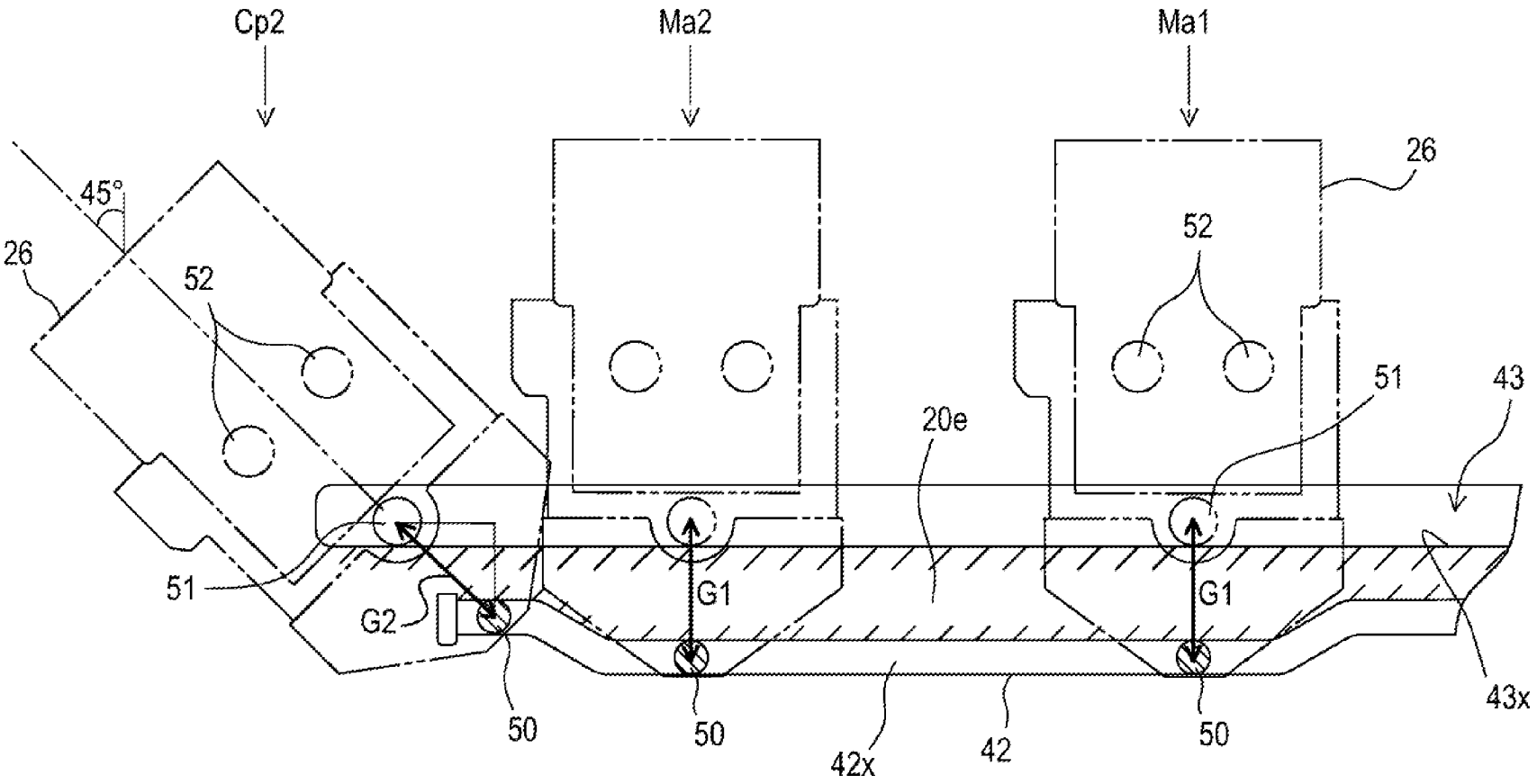
FIG. 9 is an explanatory view of multi-binding and left corner binding of the stapler unit.
Figure 12A:
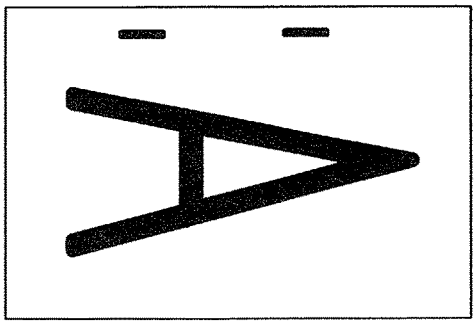
FIG. 12A is an illustration of a binding method for a sheet bundle.

As illustrated in FIG. 5, in the multi-binding, binding is performed with respect to an edge (a trailing edge of the sheet bundle in FIG. 5) of a sheet bundle which is positioned by the sheet edge regulation members 41 and the side alignment members 46 on the processing tray 24 (hereinafter referred to as "aligned sheet bundle"). In FIG. 9, there are set the binding positions Ma1 and Ma2 for binding at two positions with an interval. The stapler unit 26 moves from a home position to the binding position Ma1 and to the binding position Ma2 in the stated order to perform binding, respectively. The multi-binding positions Ma1 and Ma2 are not limited to the two positions. The binding positions may be three positions, or four or more positions. FIG. 12A is an illustration of a state after the multi-binding.

[Corner Binding]

Figure 12B:
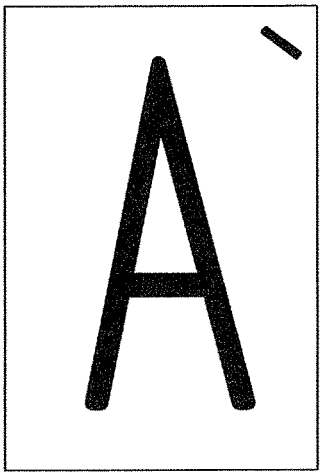
FIG. 12B is an illustration of a binding method for a sheet bundle.
Figure 12C:
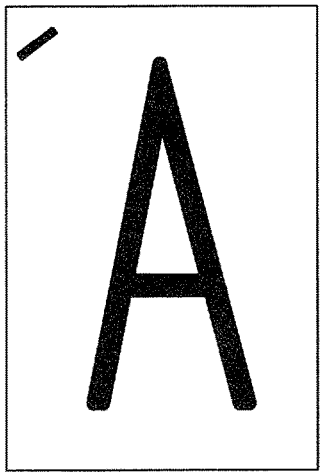
FIG. 12C is an illustration of a binding method for a sheet bundle.

In the corner binding, there are set two binding positions on the right and left. At the right corner position Cp1, binding is performed to a right corner of the aligned sheet bundle stacked on the processing tray 24. At the left corner binding position Cp2, binding is performed to a left corner of the aligned sheet bundle. In this case, binding is performed with a staple inclined at a predetermined angle (about 30 degrees to about 60 degrees). The stapler unit 26 is mounted to the apparatus frame so that the entire unit is inclined at a predetermined angle at the corner binding position. FIG. 12B and FIG. 12C are illustrations of states after the corner binding.

In the illustrated specification of the apparatus, there are illustrated a case where any one of the right and left of the sheet bundle is selected and subjected to binding, and a case where binding is performed with a staple inclined at a predetermined angle. Not limited to the above-mentioned cases, there may also be employed a configuration of performing the corner binding only to any one of the right and left, and a configuration of performing binding with a staple oriented parallel to the sheet edge without inclination of the staple.

[Manual Binding]

Figure 12D:
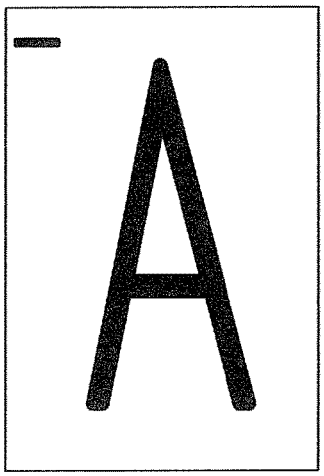
FIG. 12D is an illustration of a binding method for a sheet bundle.
Figure 12E:
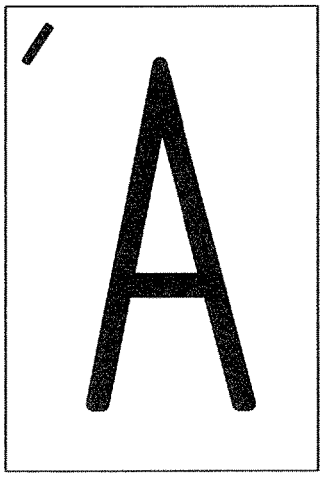
FIG. 12E is an illustration of a binding method for a sheet bundle.
Figure 12F:
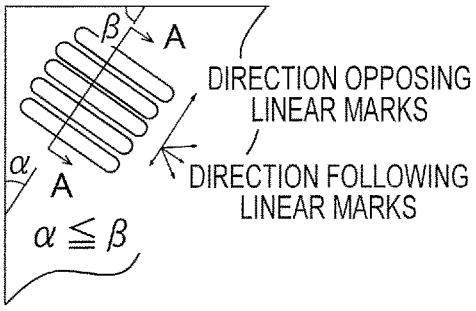
FIG. 12F is an illustration of an eco-binding portion in enlarged view.
Figure 12G:
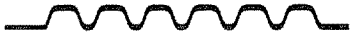
FIG. 12G is an illustration of a cross-section taken along the line A-A of FIG. 12F.

The manual binding position Mp is arranged at the manual feed set surface 29*a* formed in the outer casing 20*b* (in a part of the apparatus housing). The manual feed set surface 29*a* is arranged at a height position of forming a plane which is substantially in flush with the sheet placement surface 24*a* of the processing tray 24, and at a position which is adjacent to the sheet placement surface 24*a* in side-by-side arrangement through intermediation of the side frame 20*c*. The sheet placement surface 24*a* of the illustrated processing tray 24 and the manual feed set surface 29*a* support the sheets in a substantially horizontal posture and are arranged at substantially equal height positions. FIG. 12D is an illustration of the state after the manual binding.

In FIG. 5, the manual feed set surface 29*a* is arranged on the right side of the side frame 20*c*, and the sheet placement surface 24*a* is arranged on the left side of the side frame 20*c*. This manual binding position Mp is arranged on the same straight line as the multi-binding positions Ma1 and Ma2 which are arranged at the sheet placement surface 24*a*. This is because the common stapler unit 26 performs the binding at both the binding positions. Thus, at the processing tray 24, there are arranged the sheet carry-in area Ar, the manual feed area Fr on the apparatus front side of the processing tray 24, and the eco-binding area Rr on the apparatus rear side of the processing tray 24.

[Stapleless Binding Position]

As illustrated in FIG. 5, the stapleless binding position Ep (hereinafter referred to as "eco-binding position") is arranged so as to perform binding to a side edge portion (a corner portion) of sheets. The illustrated eco-binding position Ep is arranged at a position of performing binding to one position of the side edge portion of the sheet bundle in the sheet delivery direction, and the binding is performed at an angular position inclined by a predetermined angle with respect to the sheets. The eco-binding position Ep is arranged in an eco-binding area Rr which is apart from the sheet carry-in area Ar of the processing tray 24 to the apparatus rear side.

[Relationship of Binding Positions]

The multi-binding positions Ma1 and Ma2 are arranged on an inner side in the sheet carry-in area Ar on which sheets are fed to the processing tray 24 from the sheet delivery port 23. The corner binding positions Cp1 and Cp2 are arranged outside the sheet carry-in area Ar and at reference positions with the side alignment reference, which are apart by a predetermined distance on the right or left from the sheet delivery reference Sx with the center reference of the sheet. As illustrated in FIG. 6, on the outer side from the side edges of a maximum size sheet to be subjected to binding, the right corner binding position Cp1 is arranged at a position deviated to the right side from the sheet side edge by a predetermined amount (δ1), and the left corner binding position Cp2 is arranged at a position deviated to the left side from the sheet side edge by a predetermined amount (δ2). The deviation amounts are set to equal distances (δ1=δ2).

The multi-binding positions Ma1 and Ma2 and the manual binding position Mp are arranged so as to be substantially on a straight line. The corner binding positions Cp1 and Cp2 are set to inclination angles which are symmetric over the sheet delivery reference Sx, for example, to 45-degrees angle positions.

The manual binding position Mp is arranged outside the sheet carry-in area Ar and in the manual feed area Fr on the apparatus front side Fr. The eco-binding position Ep is arranged outside the sheet carry-in area Ar but in the eco-binding area Rr on the apparatus rear side Re.

The manual binding position Mp is arranged at a position which is offset by a predetermined amount (Of1) from the right corner binding position of the processing tray 24. The eco-binding position Ep is arranged at a position which is offset by a predetermined amount (Of2) from the left corner binding position of the processing tray 24. The multi-binding positions Ma1 and Ma2 are set based on the carry-out reference or the center reference of the processing tray 24 to which the sheets are fed. The corner binding position Cp is set based on the maximum size sheet. Further, the manual binding position Mp is set at a position which is further offset by a predetermined amount Of1 from the right and left corner binding positions to the apparatus front side. Similarly, the eco-binding position Ep is set at a position which is offset by a predetermined amount Of2 to the apparatus rear side. With this, well-ordered arrangement can be made without interference to sheet movement each other.

Sheet movement in each binding is described. When the multi-binding is to be performed, sheets are fed to the processing tray 24 with the center reference or with the one-side reference. The sheets are aligned in that state and subjected to the binding. After the binding, the sheets are discharged to downstream in that posture. When the corner binding is to be performed, the sheets are aligned at an alignment position on a designated side and subjected to binding. After the binding, the sheets are discharged to downstream in that posture. When the eco-binding is to be performed, the sheets having been fed to the processing tray are stacked to form a bundle, offset by the predetermined amount Of2 to the apparatus rear side, and subjected to the binding after the offset movement. After the binding, the sheets are offset by a predetermined amount, for example, by a shift amount which is equal to or smaller than the predetermined amount Of2 of the offset, and thereafter discharged to the downstream.

In the manual binding, an operator sets sheets to the manual feed set surface 29*a* which is apart from the processing tray 24 with an offset by the predetermined amount Of1 from the alignment reference located on the front side. With this, the set positions of the sheets are divided in the direction orthogonal to the conveyance direction to perform the plurality of types of binding. Accordingly, the processing can be performed with high processing speed and less sheet jam.

When the eco-binding is to be performed, the control portion 75 causes the sheets to be offset by a predetermined amount Of3 in the sheet delivery direction from the trailing end reference position to set the binding position Ep. This is for the purpose of avoiding interference between the stapler unit 26 and the eco-binding unit, which is the press-binding unit 27, for the left corner binding to the sheets. Thus, when the eco-binding unit 27 is mounted, similarly to the staple binding unit 26, to the apparatus frame 20 so as to be movable between the binding position and a retreated position retreated from the binding position, there is no need to cause the sheets to be offset by the predetermined amount Of3 in the sheet delivery direction.

Herein, the apparatus front side Fr refers to the front surface side of the outer casing 20*b*, which is set at the time of designing the apparatus and enables an operator to perform various types of operations. Typically, on the apparatus front side, there is arranged a control panel, a mounting cover or door for a sheet cassette, or an opening and closing cover for replenishment of staples for the stapler unit 26. The apparatus rear side Re refers to, for example, a side facing a wall surface of a building when the apparatus is installed under an installation condition in which a wall is to be located on a back surface side in design.

In the illustrated apparatus, the sheet carry-in area Ar is a reference. In an outside of the area, the manual binding position Mp is arranged on the apparatus front side Fr, and the eco-binding position Ep is arranged on the apparatus rear side Re. At this time, a distance Ofx between the reference (the sheet carry-in reference Sx) of the sheet carry-in area Ar and the manual binding position Mp is set to be larger than a distance Ofy between the carry-in reference Sx and the eco-binding position Ep (Ofx>Ofy). That is, it is set at a more apart position.

The manual binding position Mp is set to a position far apart from the sheet carry-in reference Sx of the processing tray 24, and the eco-binding position Ep is set to a position in proximity to and close to the carry-in reference. This is for the convenience in that, when the sheet bundle is set from outside to the manual binding position Mp, operation can be easily performed because it is apart from the processing tray 24. At the same time, the eco-binding position Ep is set to a position in proximity to or close to the carry-in reference Sx to perform binding at high speed (for improving productivity) through reduction of the moving amount of the sheets (the aligned sheet bundle) having been fed to the processing tray 24 upon offset movement to the binding position.

[Moving Mechanism of Stapler Unit]

The stapler unit 26 (first binding portion) includes, in a unit frame 26*a* (referred to as "first unit frame") thereof, a staple cartridge 39, a staple head 26*b*, and an anvil member 26*c*. The stapler unit 26 is supported on the apparatus frame 20*a* so as to reciprocate along an edge surface of sheets on the processing tray 24 by a predetermined stroke. In the following, a support structure for the stapler unit 26 is described.

Figure 8:
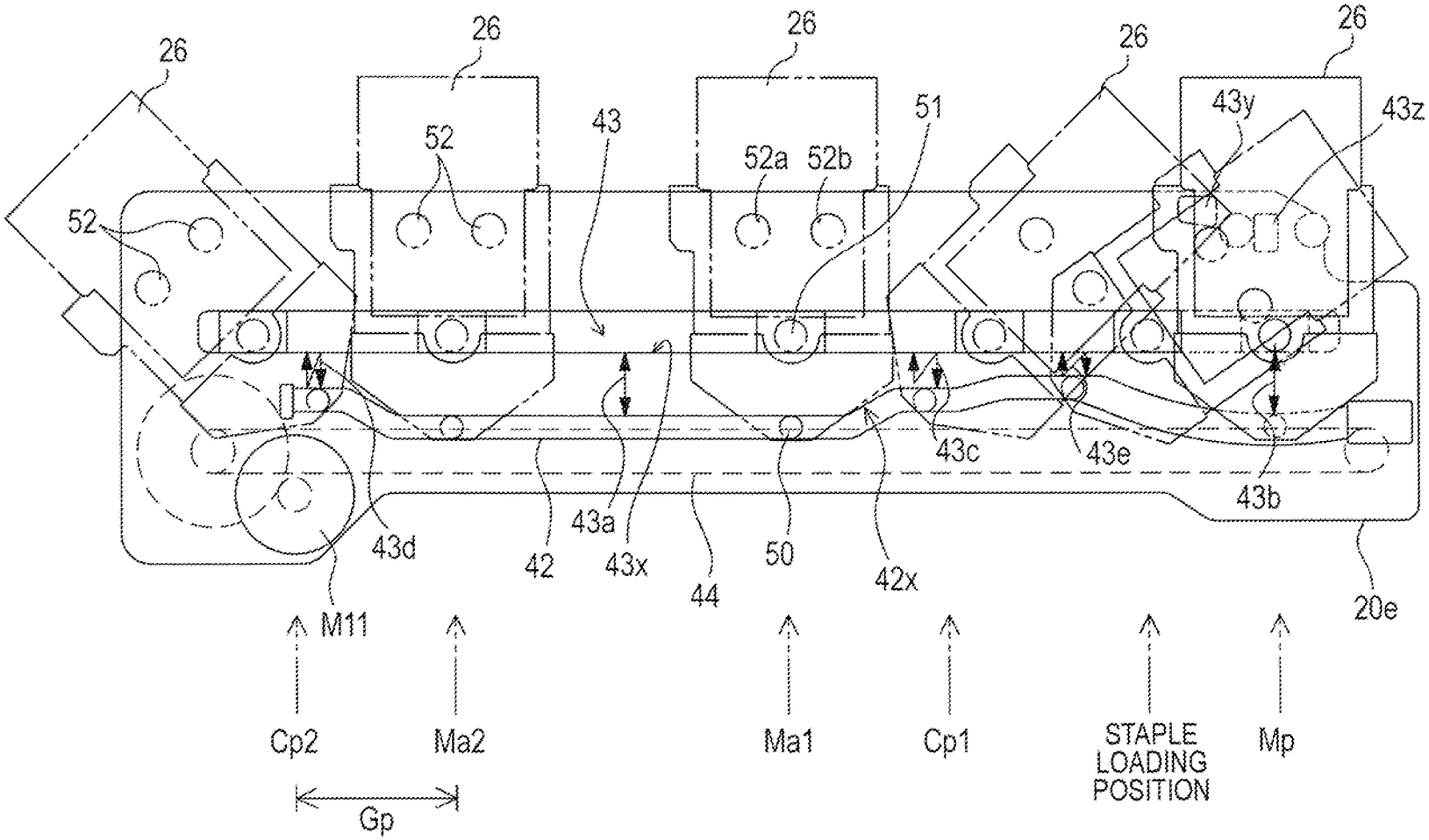
FIG. 8 is an explanatory view for illustrating binding positions of the stapler unit.

FIG. 7 is an illustration of a configuration of the stapler unit 26 which is mounted to the apparatus frame 20 in front view, and FIG. 8 is an illustration of a configuration in plane view thereof. FIG. 9 and FIG. 10A to FIG. 10C are explanatory partial views for illustrating a guide rail mechanism configured to guide the stapler unit.

As illustrated in FIG. 7, a chassis frame 20*e* (hereinafter referred to as "bottom frame") is arranged at the left side frame 20*d* and the right side frame 20*c* which construct the apparatus frame 20*a*. The stapler unit 26 is mounted to the bottom frame 20*e* so as to be movable by a predetermined stroke. At the bottom frame 20*e*, there are arranged a traveling guide rail 42 (hereinafter simply referred to as "guide rail") and a slide cam 43. A traveling rail surface 42*x* is formed in the guide rail. A traveling cam surface 43*x* is formed in the slide cam 43. The traveling rail surface 42*x* and the traveling cam surface 43*x* cooperate with each other to support the stapler unit 26 (hereinafter referred to as "moving unit" in this section) so that the stapler unit 26 is reciprocable by a predetermined stroke and, at the same time, control an angular posture of the stapler unit 26.

The rail surface 42*x* is formed on the traveling guide rail 42 and the cam surface 43*x* is formed on the slide cam 43 for reciprocating in a moving range (sheet carry-in area, manual feed area, and eco-binding area) SL of the moving unit (see FIG. 8). The traveling guide rail 42 is constructed by a rail member having a stroke SL along the trailing edge regulation members 41 of the processing tray 24. The illustrated guide rail 42 is constructed by an opening groove formed in the bottom frame 20*e*. The traveling rail surface 42*x* is formed at an opening edge of the opening groove. The traveling rail surface 42*x* is arranged in a relationship of being parallel to the trailing edge regulation members 41 of the processing tray 24 on the same straight line. Further, the slide cam 43 is arranged apart from the traveling rail surface 42*x* at an interval, and the illustrated slide cam 43 is constructed by a groove cam formed in the bottom frame 20*e*. The groove cam has the traveling cam surface 43*x*.

The moving unit 26 (stapler unit) is fixed to a traveling belt 44 connected to a drive motor (traveling motor) M11. The traveling belt 44 is wound around a pair of pulleys axially supported on the bottom frame 20*e*, and the drive motor is connected to one of the pulleys. Thus, the stapler unit 26 reciprocates by the stroke SL through forward and reverse rotation of the traveling motor M11.

The traveling rail surface 42*x* and the traveling cam surface 43*x* have intervals at parallel interval portions 43*a* and 43*b* (span G1) which are parallel to each other, at narrower swing interval portions 43*c* and 43*d* (span G2), and at a swing interval portion 43*e* (span G3) which has a still narrower interval. The intervals have a relationship satisfying span G1>span G2>span G3. Swing angles are changed as follows. In the span G1, the stapler unit 26 takes a posture of being parallel to a sheet trailing edge. In the span G2, the stapler unit 26 takes a posture of being inclined to any one of the right and left. In the span G3, the stapler unit 26 takes an angular posture of being further inclined.

The traveling guide rail 42 is not limited to the opening groove structure. There may be employed various structures such as a guide lot and a protrusion-ridge rib. The slide cam 43 is not limited to the groove cam. There may be employed various shapes such as a protrusion-ridge rib member as long as a cam surface configured to guide the moving unit 26 in a predetermined stroke direction is provided.

The moving unit 26 engages with the traveling guide rail 42 and the slide cam 43 as follows. As illustrated in FIG. 7, the moving unit 26 includes a first rolling roller 50 (rail fitting member) engaged with the traveling rail surface 42*x* and a second rolling roller 51 (cam follower member) engaged with the traveling cam surface 43*x*. Sliding rollers 52, which are engaged with a support surface of the bottom frame 20*e*, are formed on the moving unit 26 (the sliding rollers 52*a* and 52*b* each having a ball shape are arranged at two positions of the illustrated moving unit 26). Further, a guide roller 52*c*, which is engaged with a bottom surface of the bottom frame to prevent rise of the moving unit 26 from the bottom frame 20*e*, is formed on the moving unit 26.

The moving unit 26 is supported on the bottom frame 20*e* so as to be movable by the sliding rollers 52*a* and 52*b* and the guide roller 52*c*. Together with this, the first rolling roller 50 follows the rail surface 42*x* to travel while rotating along the traveling rail surface 42*x*, and the second rolling roller 51 follows the cam surface 43*x* to travel while rotating along the traveling cam surface 43*x*.

Figure 10B:
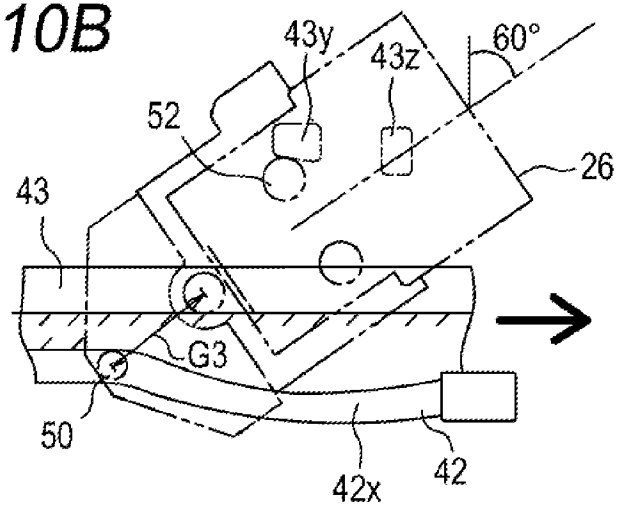
FIG. 10B is an illustration of a state of the stapler at a binding position, and is an illustration of a state at a staple loading position.
Figure 10C:
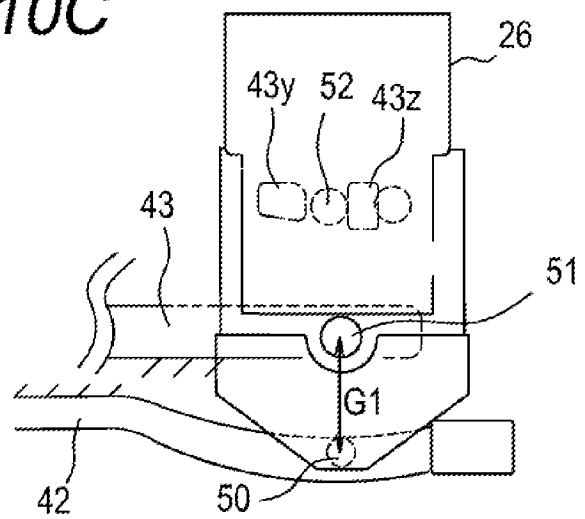
FIG. 10C is an illustration of a state of the stapler at a binding position, and is an illustration of a state at a manual binding position.

The parallel interval portion 43*a* (span G1) between the rail surface 42*x* and the cam surface 43*x* is formed at the illustrated position opposed to the multi-binding positions Ma1 and Ma2. The parallel interval portion 43*b* (span G1) is formed at the illustrated position opposed to the manual binding position Mp. In the span G1, as illustrated in FIG. 9 and FIG. 10C, the moving unit 26 is held in a posture of being orthogonal to the sheet edge without being swung. Thus, at the multi-binding positions Ma1 and Ma2 and the manual binding position Mp, the sheet bundle is subjected to binding with a staple parallel to the sheet edge.

Figure 10A:
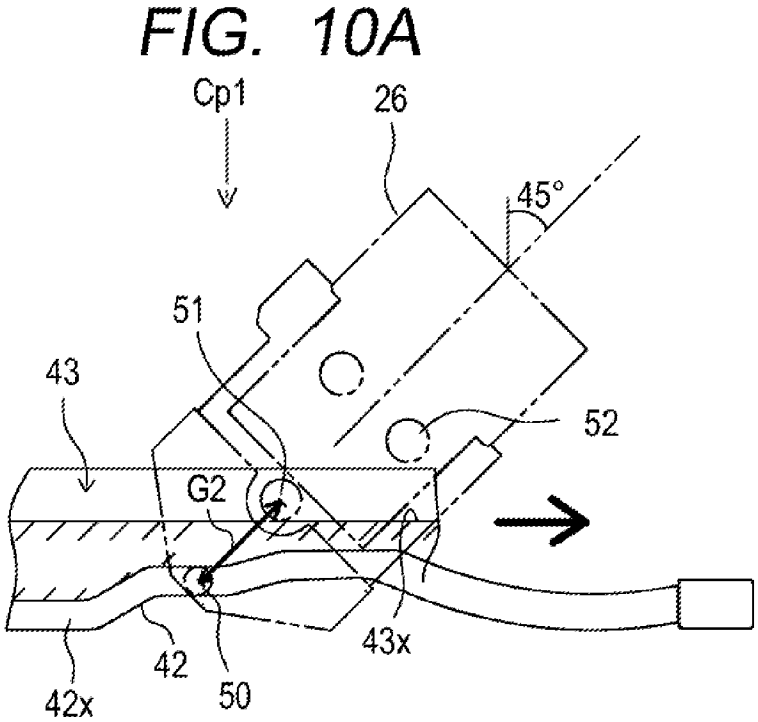
FIG. 10A is an illustration of a state of the stapler at a binding position, and is an illustration of a state at a right corner binding position.

The swing interval 43*e* (span G2) of the rail surface 42*x* and the cam surface 43*x* is formed at the illustrated position opposed to the right corner binding position Cp1. The swing interval 43*d* (span G2) is formed at the illustrated position opposed to the left corner binding position Cp2. As illustrated in FIG. 9 and FIG. 10A, the moving unit 26 is held in a right-inclined angle posture, for example, which is inclined at 45 degrees to the right, and a left-inclined angle posture, for example, which is inclined at 45 degrees to the left.

The swing interval 43*c* (span G3) of the rail surface 42*x* and the cam surface 43*x* is formed at the illustrated position opposed to the staple loading position. The span G3 is formed to have an interval shorter than the span G2. In this state, as illustrated in FIG. 10B, the moving unit 26 is held in a right-inclined angle posture, for example, which is inclined at 60 degrees. The moving unit 26 is changed in angle at the staple loading position to match the unit posture with an angular direction of mounting the staple cartridge 39 to the moving unit 26. The angle is set in relation to the opening and closing cover arranged on the outer casing.

In order to reduce the moving length when the angular posture of the moving unit 26 is deflected with the traveling rail surface 42*x* and the traveling cam surface 43*x*, in view of the compactness in layout, it is preferred that a second traveling cam surface or a stopper cam surface be provided to deflect the angle by cooperating with the traveling cam surface.

The illustrated stopper cam surface is described. As illustrated in FIG. 8, in order to change the unit posture at the right corner binding position Cp1 and the manual binding position Mp on the apparatus front side, stopper surfaces 43*y* and 43*z* to be engaged with a part of the moving unit 26 are arranged on the bottom frame 20*e*. The above-mentioned part illustrated in FIG. 8 is the sliding roller 52*a*. The moving unit 26 being inclined at the staple loading position needs to be corrected in inclination thereof at the manual binding position Mp. However, the change in angle only with the cam surface and the rail surface causes redundancy in movement stroke.

Therefore, when the moving unit 26 proceeds to the manual binding side under a state of being locked by the stopper surface 43*y*, the moving unit 26 returns from the inclined state to the original state. When the moving unit 26 is to be returned from the manual binding position Mp in the opposite direction, the stopper surface 43*z* forcibly causes the moving unit 26 to be inclined and oriented toward the corner binding position.

[Stapler Unit]

Figure 13A:
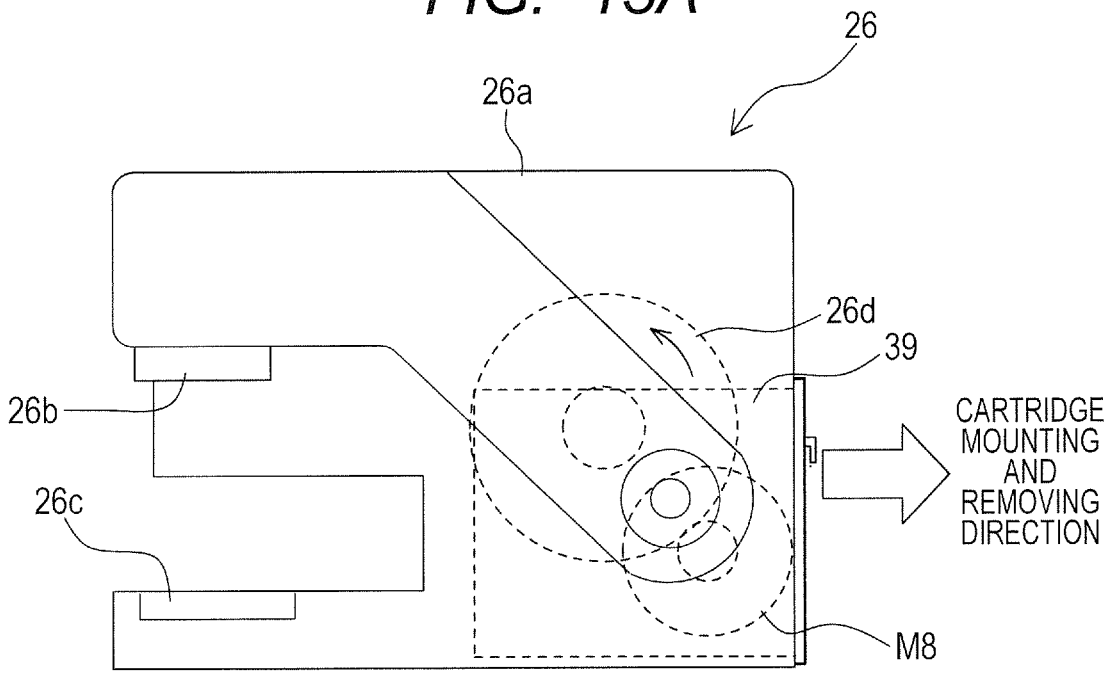
FIG. 13A is an explanatory view of a configuration of the stapler unit.

The stapler unit 26 has already been widely known as an apparatus configured to perform binding with a staple. One example of the stapler unit 26 is described with reference to FIG. 13A. The stapler unit 26 is constructed as a unit which is separated from the sheet bundle binding apparatus B (post-processing apparatus). The unit frame 26*a* having a box shape, a drive cam 26*d* axially supported on the frame so as to be swingable, and a drive motor M8 configured to rotate the drive cam 26*d* are mounted to the frame.

For the drive cam 26*d*, the staple head 26*b* and the anvil member 26*c* are arranged opposed to each other at the binding position. The staple head 26*b* is moved by the drive cam 26*d* and an urging spring (not shown) upward and downward between an upper waiting position and a lower staple position (anvil member). The staple cartridge 39 is removably mounted to the unit frame 26*a*.

The staple cartridge 39 stores straight blank staples, and the staples are fed to the head 26*b* by a staple feeding mechanism. A former member configured to bend the straight staple into a U-shape and a driver configured to press-fit the bent staple into the sheet bundle are built in an interior of the head portion 26*b*. The drive cam 26*d* is rotated by the drive motor M8 to accumulate a force in the urging spring. Then, when the rotation angle reaches a predetermined angle, the head portion 26*b* is forcefully lowered to the anvil member 26*c* side. Through the above-mentioned operations, the staple is bent into the U-shape and thereafter pierced into the sheet bundle by the driver. Tip portions of the staple are bent by the anvil member 26*c* so that the staple binding is completed.

The staple feeding mechanism is internally provided between the staple cartridge 39 and the staple head 26*b*. In the staple feeding portion, there is arranged a sensor, which is an emptiness sensor, configured to detect an absence of a staple. In the unit frame 26*a*, there is arranged a cartridge sensor (not shown) configured to detect whether or not the staple cartridge 39 is inserted.

For the illustrated staple cartridge 39, there is employed a cartridge having a box shape with a structure of storing staples, which are connected to form a band shape, in stack and a structure of storing the staples in roll.

In the unit frame 26*a*, there are arranged a circuit configured to control each sensor and a circuit board configured to control the drive motor M8. When the staple cartridge 39 is not stored, and in case that the staple cartridge 39 is empty of staples, a warning signal is given. This staple control circuit is configured to control the drive motor so that the staple operation based on a staple signal is performed. When the staple head 26*b* moves from the waiting position to the anvil position and returns again to the waiting position, an operation termination signal is transmitted.

[Press Binder Unit]

Figure 13B:
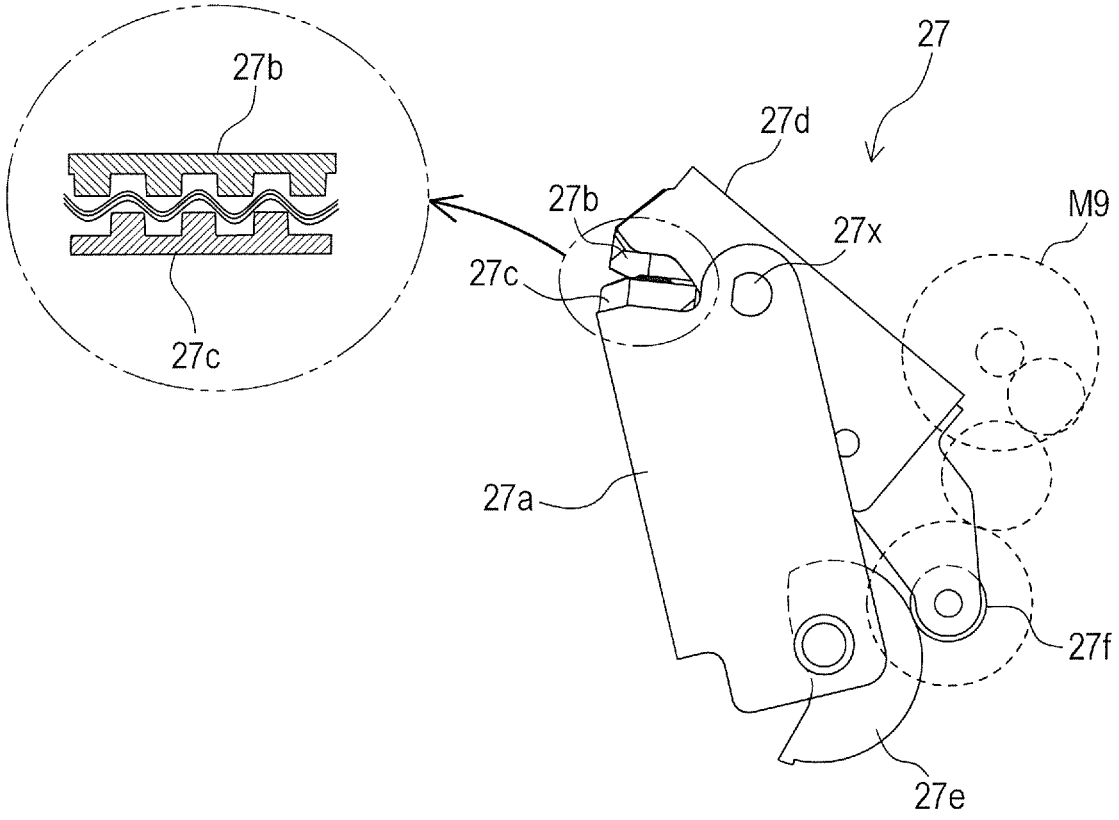
FIG. 13B is an explanatory view of a configuration of a press-binding unit.

With reference to FIG. 13B, a configuration of a press binder unit 27 is described. As a press binder mechanism, there has been known a bending and binding mechanism (see Japanese Patent Application Laid-Open No. 2011-256008) configured to bind several sheets by forming notch openings at a binding portion of the several sheets and folding one side thereof. Further, there has been known a press-binding mechanism in which clamping teeth 27*b* and 27*c* each having a corrugated surface are formed so as to come in press-contact with and separate from each other, freely, and by which a sheet bundle is deformed with pressure between the clamping teeth 27*b* and 27*c* so that the sheet bundle is bound.

FIG. 13B is an illustration of the press binder unit 27. A movable frame member 27*d* is axially supported on the base frame member 27*a* so as to be swingable, and both the frame members are swung about a support shaft 27*x* so that the frame members can come into press-contact with and separate from each other. A follower roller 27*f* is arranged at the movable frame member 27*d*. A drive cam 27*e* arranged at the base frame 27*a* is engaged with the follower roller 27*f*.

A drive motor M9 arranged at the base frame member 27*a* is connected to the drive cam 27*e* through intermediation of the speed reduction mechanism. Rotation of the motor causes the drive cam 27*e* to rotate, and a cam surface of the drive cam 27*e* causes the movable frame member 27*d* to swing. The illustrated drive cam 27*e* is an eccentric cam.

The lower clamping teeth 27*c* are arranged at the base frame member 27*a*, and the upper clamping teeth 27*b* are arranged at the movable frame member 27*d*. The lower clamping teeth 27*c* and the upper clamping teeth 27*b* are arranged at positions opposed to each other. An urging spring (not shown) is arranged between the base frame member 27*a* and the movable frame member 27*d*, and both clamping teeth 27*b* and 27*c* are urged in a direction of separating from each other.

As illustrated in the enlarged view of FIG. 13B, one of the upper clamping teeth 27*b* and the lower clamping teeth 27*c* has protrusion ridges, and another has recess grooves to be fitted to the protrusion ridges. Each of the protrusion ridges and the recess grooves has a ridge shape or a rib shape having a predetermined length. Thus, a sheet bundle clamped by the upper clamping teeth 27*b* and the lower clamping teeth 27*c* is deformed into a corrugated-sheet shape and brought into close contact. A position sensor (not shown) is arranged at the base frame member 27*a* (unit frame), and is configured to detect whether or not the upper clamping teeth 27*b* and the lower clamping teeth 27*c* are at pressing positions or separating positions.

[Rotation Application Mechanism and Posture Correction Mechanism]

After the stapleless binding (press-contact binding) by the stapleless binding unit 27, the first conveyance member 60A configured to reciprocate along a movement axis extending in a delivery direction of a sheet bundle functions as a push-out member of a rotation application mechanism. The rotation application mechanism applies a force to the sheet bundle so as to rotate the sheet bundle about the press-contact portion to separate the sheet bundle from the clamping teeth member 27*b* or 27*c* of the stapleless binding unit 27. The second conveyance members 60B configured to reciprocate along a movement axis extending in the delivery direction of the sheet bundle function as posture correction members of a posture correction mechanism configured to be brought into abutment against the sheet bundle, which has been rotated by the rotation application mechanism, to correct the sheet bundle to take a predetermined posture.

Figure 26:
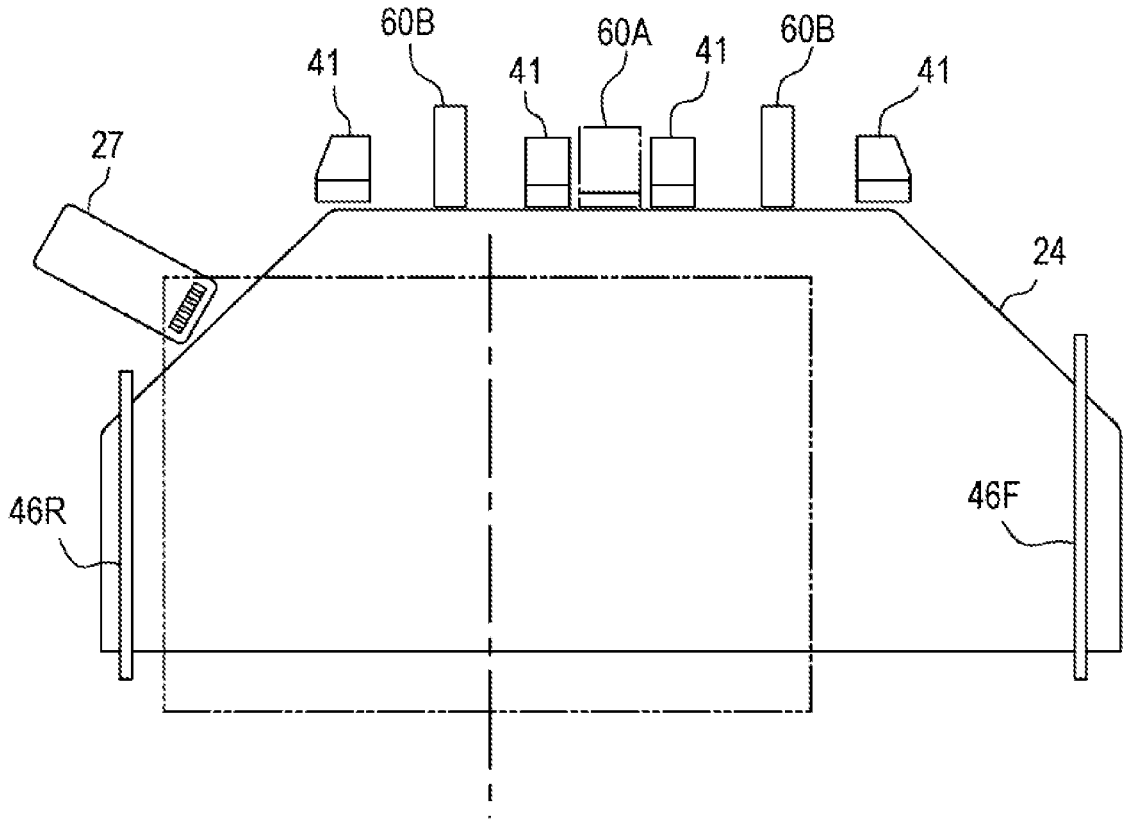
FIG. 26 is an explanatory view for illustrating another embodiment of components of the sheet bundle carry-out mechanism.

The first conveyance member 60A serves as the push-out member of the rotation application mechanism to apply rotation to the sheet bundle about the press-contact portion. Therefore, as illustrated in FIG. 26, the first conveyance member 60A is arranged so that the movement axis of the first conveyance member 60A extends to a position which is offset from the pair of clamping teeth members 27*b* and 27*c*, specifically, the press-contact portion formed by the clamping teeth members 27*b* and 27*c*. That is, the movement axis of the first conveyance member 60A is prevented from passing through the pair of clamping teeth members 27*b* and 27*c* of the stapleless binding unit 27. The movement axis of the first conveyance member 60A extends to a position offset from the pair of clamping teeth members 27*b* and 27*c*. Therefore, a force applied by the first conveyance member 60A to the sheet bundle through abutment against the sheet bundle reliably causes rotation about the press-contact portion to the sheet bundle adhered to one of the clamping teeth members 27*b* and 27*c* at the press-contact portion.

The second conveyance members 60B serve as the posture correction members of the posture correction mechanism to correct and stably maintain a posture of the sheet bundle. For that operation, as illustrated in FIG. 26, the second conveyance members 60B are arranged so as to apply a force to the sheet bundle at different positions over a center axis which passes through a gravity center position of the sheet bundle having been subjected to the press-contact binding by the stapleless binding unit 27 and extends in the delivery direction. In the illustrated embodiment, two second conveyance members 60B are arranged on sides opposite to each other over the center axis which passes through the gravity center position of the sheet bundle and extends in the delivery direction. When one of the second conveyance members 60B is brought into abutment against the rotated sheet bundle, the sheet bundle is rotated in a direction of causing the sheet bundle to be brought into abutment against another second conveyance member 60B so that the sheet bundle is corrected to a predetermined posture. Further, when the another second conveyance member 60B is brought into contact with the sheet bundle at a different position over the center axis of the sheet bundle, the sheet bundle is conveyed under a state of maintaining the posture without being rotated.

Figure 27:
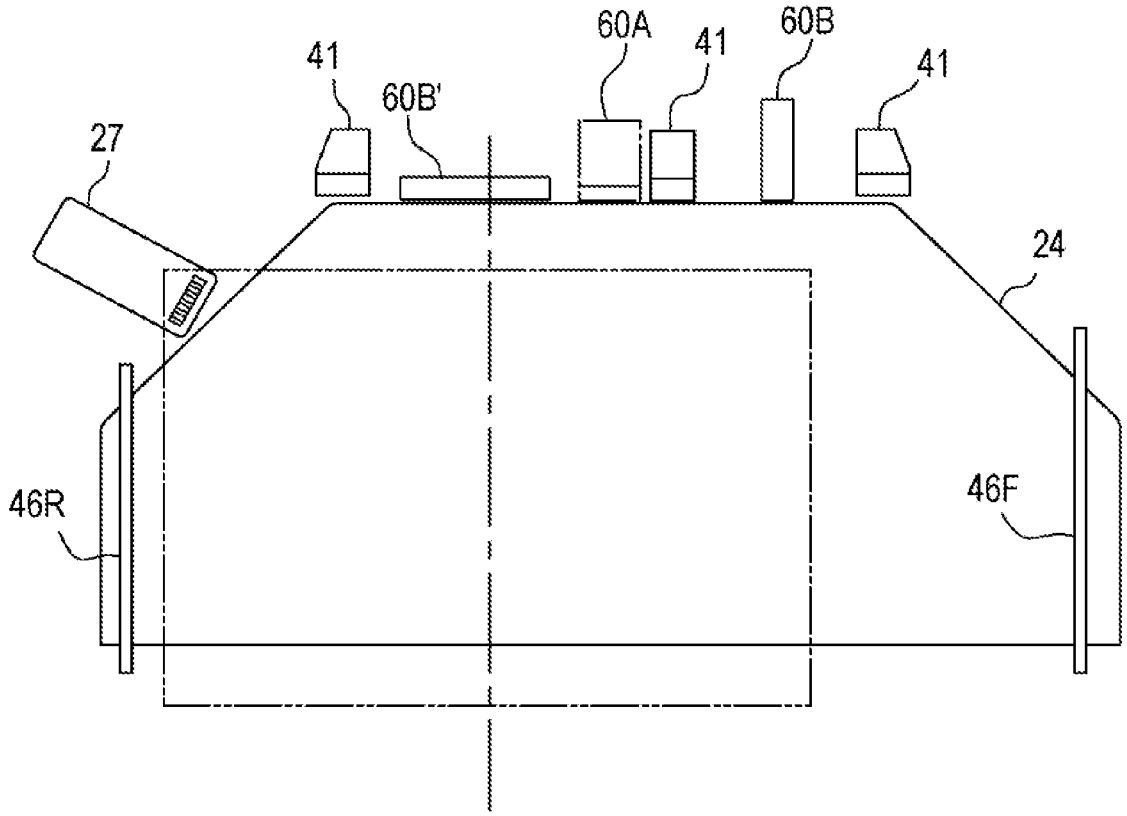
FIG. 27 is an explanatory view of a plate-like member as a posture correction member.

The posture correction members of the posture correction mechanism are not limited to the illustrated embodiment as long as the posture correction members are configured to apply a force to the sheet bundle at different positions over the center axis which passes through the gravity center position of the sheet bundle having been subjected to the press-contact binding by the stapleless binding unit 27 and extends in the delivery direction. For example, as illustrated in FIG. 27, a plate-like member 60B' may be provided as the posture correction member in place of the second conveyance member 60B or in addition to the second conveyance member 60B. The plate-like member 60B' extends over both sides of the center axis which passes through the gravity center position of the sheet bundle having been subjected to the press-contact binding and extends in the delivery direction. Also in a case where the plate-like member 60B' is used as the posture correction member, when the plate-like member 60B' is brought into abutment against part of the rotated sheet bundle, another part of the sheet bundle is also rotated in the direction of causing the sheet bundle to be brought into abutment against the plate-like member 60B' so that the sheet bundle is corrected to a predetermined posture. Further, when a side of the sheet bundle is entirely brought into abutment against the plate-like member 60B', the sheet bundle is conveyed under a state of maintaining the posture without being rotated.

[Stack Tray]

Figure 14:
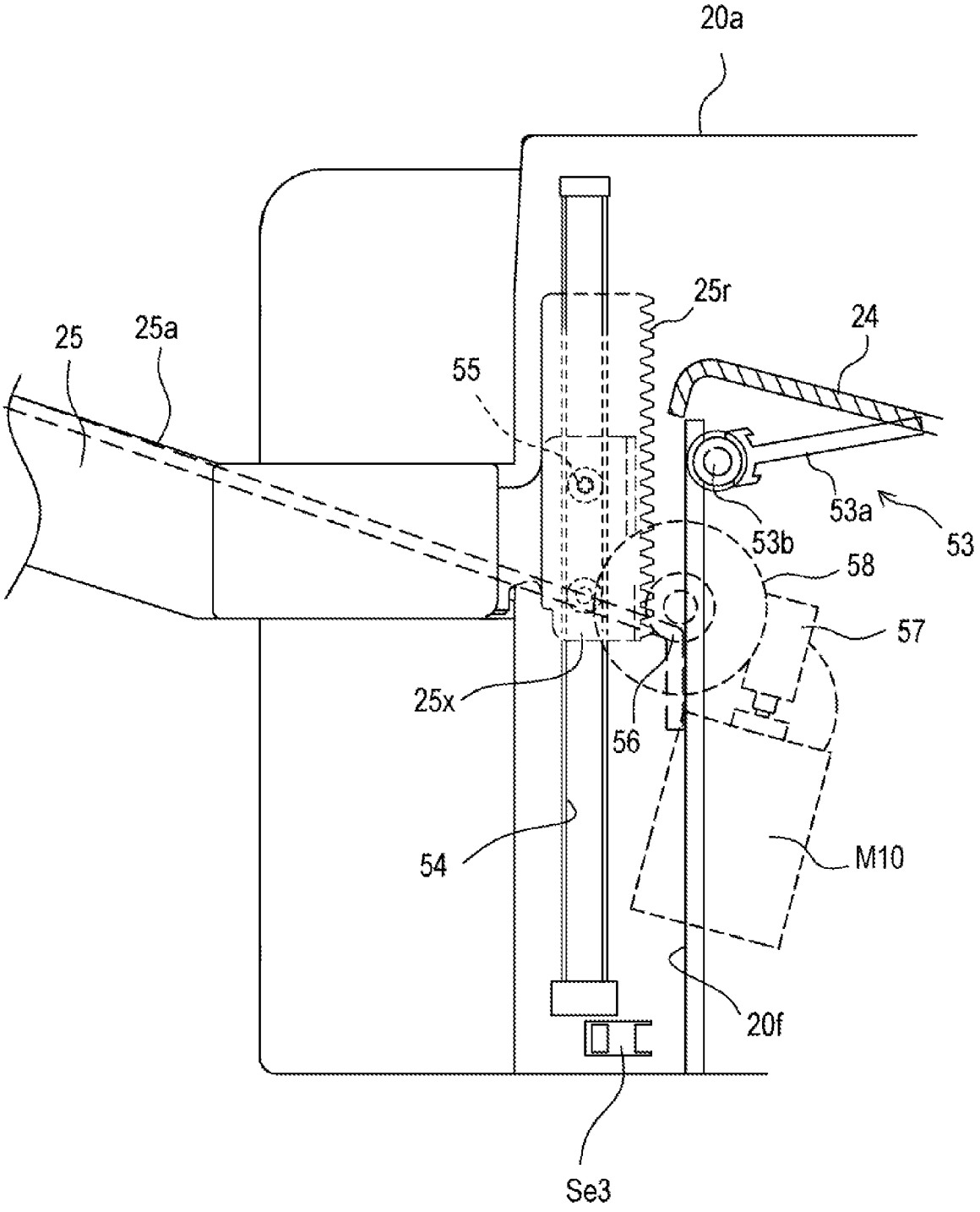
FIG. 14 is an explanatory view of a configuration of the stack tray in the apparatus of FIG. 2.

A configuration of the stack tray 25 is described with reference to FIG. 14. The stack tray 25 is arranged on downstream of the processing tray 24 and is configured to stack and receive a sheet bundle stacked on the processing tray 24. The post-processing unit B includes a tray lifting mechanism to sequentially lower the stack tray 25 in accordance with the amount of sheets stacked on the stack tray 25. A stack surface (uppermost sheet height) 25*a* of the stack tray 25 is controlled to a height position of being substantially in flush with the sheet placement surface of the processing tray 24. The stacked sheets are inclined at an angle of causing the trailing edge of the sheets in the sheet delivery direction to be brought into abutment against a tray alignment surface 20*f* (standing surface) by the own weight of the sheets.

A lifting rail 54 is fixed to the apparatus frame 20*a* so as to extend upward and downward in the stacking direction. A tray base 25*x* is fitted to the lifting rail 54 so that the tray base 25*x* can be lifted and slid with a slide roller 55. Further, a rack 25*r* is integrally formed in the tray base body 25*x*, and a drive pinion 56 axially supported on the apparatus frame 20*a* is in mesh with the rack 25*r*. A lifting motor M10 is connected to the drive pinion 56 through intermediation of a worm gear 57 and a worm wheel 58.

Forward and reverse rotations of the lifting motor M10 cause the rack 25*r*, which is connected to the drive pinion 56, to vertically move upward and downward in the apparatus frame. With this configuration, the tray base body 25*x* is lifted in a cantilevered state. As a tray lifting mechanism other than the rack-pinion mechanism, a pulley-stretch belt mechanism may be employed.

The stack tray 25 is integrally mounted to the tray base body 25*x*, and sheets are stacked and received on the stack surface 25*a* of the stack tray 25. In the apparatus frame 20*a*, a tray alignment surface 20*f*, which is configured to support the trailing edge of the sheets in the stacking direction of the sheets, is formed. The illustrated apparatus frame 20*a* forms the tray alignment surface with the outer casing.

The stack tray 25 integrally mounted to the tray base body 25*x* is formed with inclination in the illustrated angular direction. The angle (for example, 20 degrees to 60 degrees) is set so that the trailing edge of the sheets is brought into abutment against the tray alignment surface 20*f* by the own weight of the sheets.

[Sheet Pressing Mechanism]

The stack tray 25 is provided with a sheet pressing mechanism 53 configured to press an uppermost sheet of the stacked sheets. The illustrated sheet pressing mechanism 53 includes an elastic pressing member 53*a* configured to press the uppermost sheet, an axial support member 53*b* configured to axially support the elastic pressing member 53*a* on the apparatus frame 20*a* so that the elastic pressing member 53*a* is turnable, a drive motor M2 configured to rotate the axial support member 53*b* in a predetermined angular direction, and a transmission mechanism for a drive motor M2. As the drive motor M2, the drive motor for the sheet bundle carry-out mechanism is drive-connected as a drive source. When the sheet bundle is fed to or discharged from the stack tray 25, the elastic pressing member 53*a* is caused to retreat outward from the tray. After the trailing edge of the sheet bundle is received on the uppermost sheet on the stack tray, the elastic pressing member 53*a* is rotated from the waiting position in the illustrated counterclockwise direction to be engaged with the uppermost sheet to press the uppermost sheet.

Through an initial rotation operation of the drive motor M2 to discharge the sheet bundle on the processing tray 24 to the stack tray 25, the elastic pressing member 53*a* retreats from a sheet surface of the uppermost sheet on the stack tray 25 to a retreated position.

[Level Sensor]

A level sensor configured to detect a sheet surface height of the uppermost sheet is arranged at the stack tray 25. A reel-up motor is rotated in accordance with a detection signal of the level sensor to bring up and lift up the tray stack surface 25*a*. Various level sensor mechanisms have been known. In the illustrated embodiment, there is employed a detection method of irradiating detection light to above the tray from the tray alignment surface 20*f* of the apparatus frame 20*a* and detecting the reflected light to detect whether or not a sheet is present at the height position.

[Stacked Sheet Amount Sensor]

At the stack tray 25, there is arranged a sensor configured to detect that the sheets have been taken out from the tray, similarly to the level sensor. A structure of the sensor is not described in detail. However, for example, a sensor lever which is integrally rotated with the sheet-pressing elastic pressing member 53 is provided, and the sensor lever is detected by a sensor element, thereby being capable of detecting whether or not a sheet is present on the stack surface. When the height position of the sensor lever is differed or changed before and after the sheet bundle is discharged, for example, the control portion 75 stops the sheet delivery operation or lifts up the stack tray 25 to a predetermined position. This operation is an abnormal operation, and is a failure which occurs when a user carelessly takes out the sheets from the stack tray 25 during operation of the apparatus. A lower limit position is set for the stack tray 25 so that the stack tray 25 is prevented from being abnormally lifted down. A limit sensor Se3 configured to detect the stack tray 25 is arranged at the lower limit position.

[Image Forming System]

As illustrated in FIG. 1, the image forming unit A includes a sheet-feeding portion 1, an image forming portion 2, a sheet delivery portion 3, and a signal processing portion (not shown), and is accommodated in an apparatus housing 4. The sheet-feeding portion 1 includes cassettes 5 each configured to store sheets. The illustrated cassettes 5 include a plurality of cassettes 5*a*, 5*b*, and 5*c* each configured to store sheets. Each of the cassettes 5*a* to 5*c* includes a sheet-feeding roller 6 configured to send out sheets and a separating portion (not shown), such as a separation claw or a separation roller, configured to separate the sheets one by one.

A sheet-feeding passage 7 is arranged in the sheet-feeding portion 1, and sheets are fed from each cassette 5 to the image forming portion 2. A registration roller pair 8 is arranged at a passage end of the sheet-feeding passage 7. The registration roller pair 8 is configured to align a leading edge of a sheet conveyed from each cassette 5 and hold the sheet until the sheet is fed in accordance with an image formation timing of the image forming portion 2.

The sheet-feeding portion 1 includes the plurality of cassettes 5*a* to 5*c* depending on an apparatus specification, and is configured to feed a sheet having a size selected by the control portion to the image forming portion 2 on downstream. Each of the cassettes 5*a* to 5*c* is removably mounted to the apparatus housing 4 to enable replenishment of sheets.

For the image forming portion 2, various image forming mechanisms configured to form an image on a sheet may be employed. FIG. 1 is an illustration of an electrostatic image forming mechanism. As illustrated in FIG. 1, a plurality of drums 9*a* to 9*d* each constructed by a photosensitive member (photoconductor) are arranged for respective color components in the apparatus housing 4. For each of the drums 9*a*, 9*b*, 9*c*, and 9*d*, there are arranged a light emitting device (such as a laser head) 10 and a developing device 11. The light emitting devices 10 form latent images (electrostatic images) on the drums 9*a* to 9*d*, respectively, and the developing devices 11 cause toner ink to adhere to the latent images. The ink images adhered to the drums 9*a* to 9*d* are transferred for respective color components to a transfer belt 12 and image-combined thereon.

The transferred images formed on the transfer belt 12 are transferred as an image by a charger 13 to a sheet having been fed from the sheet-feeding portion 1, and are fixed by the fixing device (heating roller) 14. After that, the sheet is delivered to the sheet delivery portion 3.

The sheet delivery portion 3 includes a sheet delivery port 16 and a sheet delivery passage 17. The sheet delivery port 16 is configured to convey the sheet to the sheet delivery space 15 formed in the apparatus housing 4. The sheet delivery passage 17 is configured to guide the sheet from the image forming portion 2 to the sheet delivery port 16. A duplex passage 18 is continuously provided to the sheet delivery portion 3, and the sheet having the image formed on a front surface thereof is reversed front and back and is again fed to the image forming portion 2.

The duplex passage 18 is configured to reverse front and back the sheet having the image formed by the image forming portion 2 on the front surface side and feed the sheet again to the image forming portion 2. After an image is formed on the back surface side by the image forming portion 2, the sheet is discharged from the sheet delivery port 16. Thus, the duplex passage 18 includes a switch-back path for reversing a conveyance direction of the sheet, which has been delivered from the image forming portion 2, and returning the sheet to the apparatus, and a U-turn path 18*a* configured to reverse front and back the sheet having been returned to the apparatus. In the illustrated apparatus, the switch-back path is formed in the sheet delivery passage 22 of the post-processing unit B.

[Image Reading Unit]

The image reading unit C includes a platen 19*a* and a reading carriage 19*b* which reciprocates along the platen. The platen 19*a* is formed of a transparent glass and includes a stationary image reading surface and a traveling image reading surface. The stationary image reading surface is for use in scanning a stationary image by movement of the reading carriage 19*b*. The traveling image reading surface is for use in reading an original image which travels at a predetermined velocity.

The reading carriage 19*b* includes a light source lamp, a reflection mirror configured to change reflected light from an original, and a photoelectric conversion element (not shown). The photoelectric conversion element includes line sensors arrayed in a width direction of an original, which is a main scanning direction, on the platen. The reading carriage 19*b* reciprocates in a sub-scanning direction orthogonal to the line sensors. With this, an original image is sequentially read by lines. An automatic original feeding unit D configured to cause the original to travel at a predetermined velocity is mounted above the traveling image reading surface of the platen 19*a*. The automatic original feeding unit D includes a feeder mechanism configured to feed original sheets, which are set on the sheet-feeding tray, one by one to the platen 19*a* and place the original sheets to a sheet delivery tray after images have been read.

[Description of Control Configuration]

Figure 15:
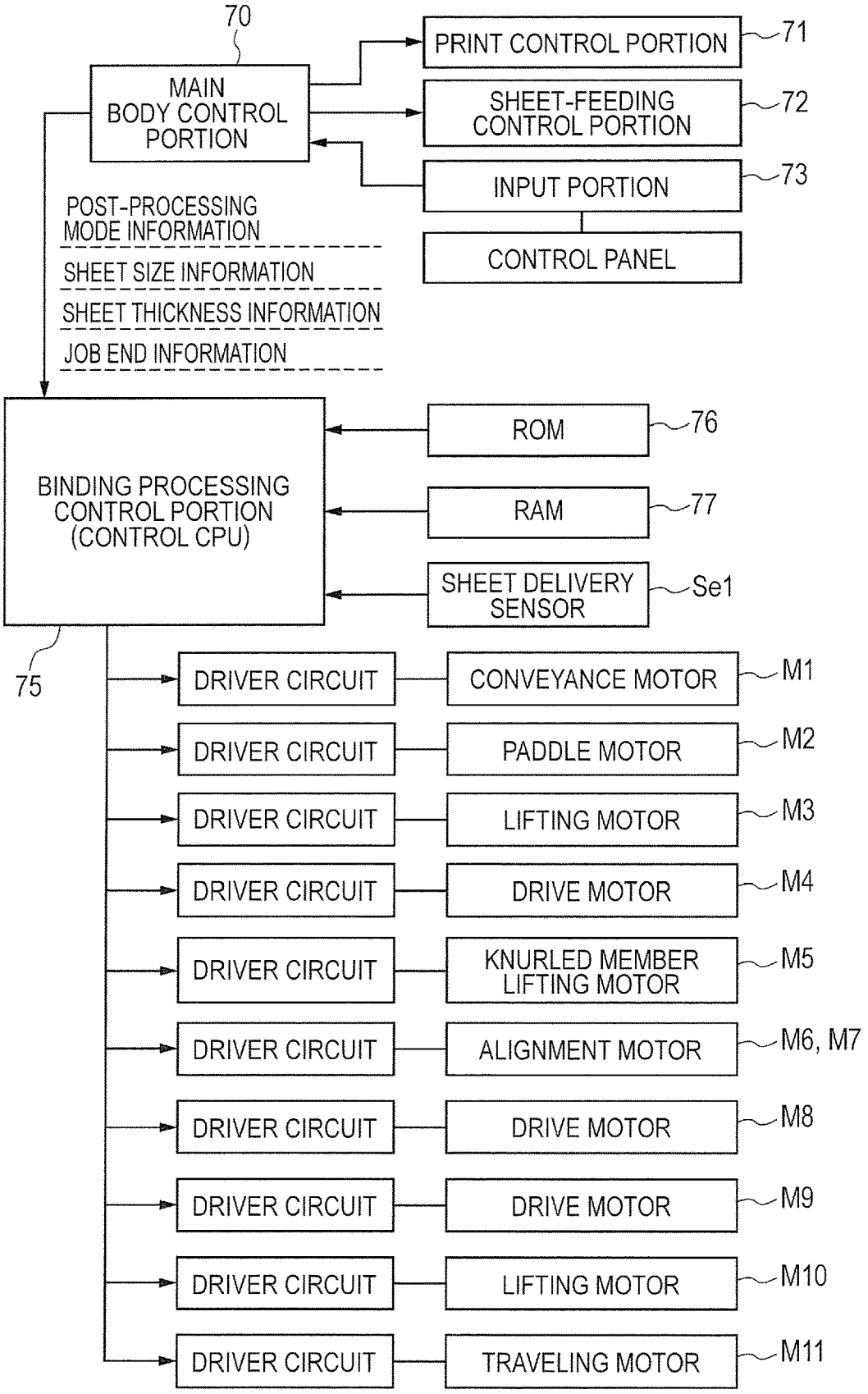
FIG. 15 is an explanatory view of a control configuration in the apparatus of FIG. 1.

A control configuration of the image forming system is described with reference to a block diagram of FIG. 15. The image forming system illustrated in FIG. 15 includes a control portion 70 (hereinafter referred to as "main body control portion") for the image forming unit A and a control portion 75 (hereinafter referred to as "binding processing control portion") for the post-processing unit B (sheet bundle binding apparatus, as similarly applied hereinafter). The main body control portion 70 includes a print control portion 71, a sheet-feeding control portion 72, and an input portion 73 (control panel).

An operator performs setting of "an image forming mode" and "a post-processing mode" through the input portion 73 (control panel). In the image forming mode, mode setting such as color or monochromatic printing and duplex or simplex printing, and image forming conditions such as a sheet size, a sheet quality, the number of prints, and enlargement or contraction printing are set. In "the post-processing mode", for example, "a print-out mode", "a staple binding mode", "an eco-binding mode", and "a jog-sorting mode" are set. In the illustrated apparatus, "a manual binding mode" is provided. In the manual binding mode, a binding operation for a sheet bundle is performed off-line separately from the main body control portion 70 for the image forming unit A.

The main body control portion 70 transfers data of information related to the post-processing mode, the number of sheets, and the number of bundles and information such as a thickness of a sheet to be subjected to image formation to the binding processing control portion 75. Further, every time the image formation is terminated, the main body control portion 70 transfers a job end signal to the binding processing control portion 75.

The post-processing mode is described. In "the print-out mode", the sheet from the sheet delivery port 23 is received on the stack tray 25 through the processing tray 24 without being subjected to the binding. In this case, the sheets are stacked in superposition on the processing tray 24, and the stacked sheet bundle is discharged to the stack tray 25 based on a jog termination signal from the main body control portion 70.

In the staple binding mode (second sheet delivery mode), the sheets from the sheet delivery port 23 are stacked on the processing tray 24 to form a sheet bundle, and the sheet bundle is subjected to the binding and thereafter received on the stack tray 25. In this case, sheets having equal thickness and size are generally designated by an operator as the sheets to be subjected to the image formation. In the staple binding mode, any one of "multi-binding", "right corner binding", and "left corner binding" is selected and designated. The binding positions are described above.

In "the jog-sorting mode", the sheets having been subjected to the image formation by the image forming unit A are separated into a group of sheets to be offset and stacked on the processing tray 24, and a group of sheets to be stacked without being offset. On the stack tray 25, sheet bundles which are alternately offset and sheet bundles which are not offset are stacked. Particularly in the illustrated apparatus, an offset area (see FIG. 5) is provided on the apparatus front side, and the sheets are separated into a group of sheets having been discharged with the center reference Sx from the sheet delivery port 23 and stacked on the processing tray 24 in that posture, and a group of sheets having been similarly discharged with the center reference Sx and stacked with an offset by a predetermined amount on the apparatus front side Fr.

The offset area is arranged on the apparatus front side Fr to provide a working area for the manual binding and replacement processing for the staple cartridge 39 on the apparatus front side. This offset area is set to a dimension of about several centimeters to sort the sheet bundles.

[Manual Binding Mode]

On the apparatus front side of the outer casing 20*b*, the manual feed set portion 29 configured to allow an operator to set a sheet bundle to be subjected to the binding is provided. On the set surface 29*a* of the manual feed set portion 29, a sensor configured to detect a set sheet bundle is arranged. In accordance with a signal from this sensor, the binding processing control portion 75 controls the stapler unit 26 to move to the manual binding position. When the operator presses an actuation switch 30, the binding is performed.

In this manual binding mode, the binding processing control portion 75 and the main body control portion 70 are controlled off-line. However, a mode is set so that, when the manual binding mode and the staple binding mode are to be executed at the same time, any one of the manual binding mode and the staple binding mode is preferentially executed.

[Binding Processing Control Portion]

The binding processing control portion 75 controls the post-processing unit B to operate in accordance with the post-processing mode set by the image formation control portion 70. The illustrated binding processing control portion 75 includes a control CPU (hereinafter simply referred to as "control portion"). A ROM 76 and a RAM 77 are connected to the control CPU 75. The control CPU 75 executes a sheet delivery operation with a control program stored in the ROM 76 and control data stored in the RAM 77. Thus, drive circuits for all of the drive motors are connected to the control CPU 75, and the control CPU 75 controls start, stop, and forward and reverse rotation of each motor.

[Description of Operation in Post-processing]

The control portion 75 including the control CPU 75 executes operations of flowcharts illustrated in FIG. 16A, FIG. 16B, FIG. 17A, FIG. 17B, and FIG. 21 to FIG. 24. Now, operation states in the binding are described with reference to the flowcharts. As a matter of convenience in description, the term "paddle" represents the sheet carry-in portion such as the paddle rotary members 36. The term "knurled member" represents the raking rotary member 33. The term "alignment plate" represents the sheet alignment mechanism 45. The term "assist member" represents the first conveyance member 60A and the second conveyance members 60B. The term "button" represents an operation switch of a staple device. The term "LED" represents an indication lamp for indication that the staple operation is being performed.

[Staple Mode]

Figure 16A:
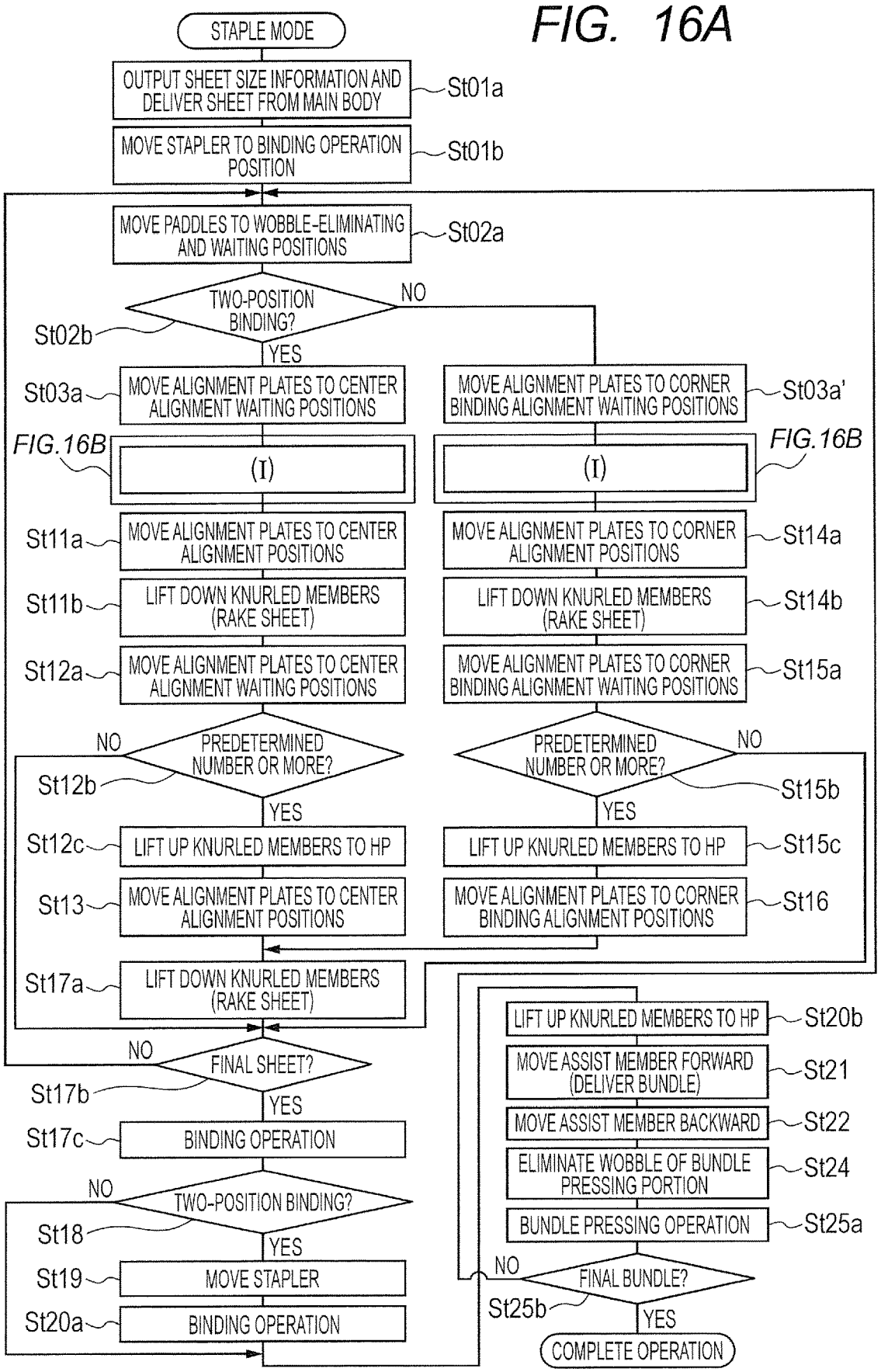
FIG. 16A is an illustration of part of an operation flow in a staple binding mode.
Figure 16B:
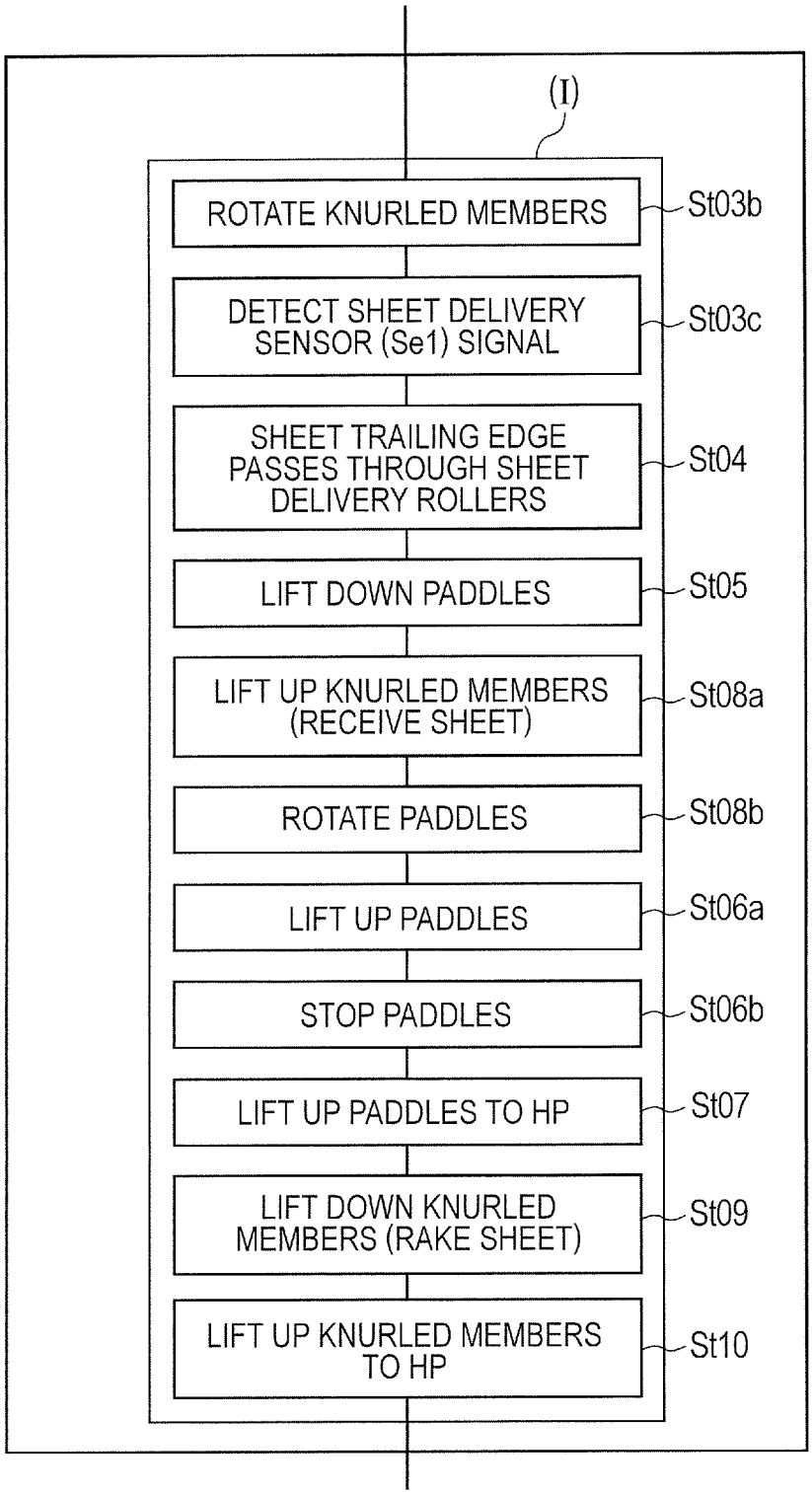
FIG. 16B is an illustration of part of the operation flow in the staple binding mode.

In FIG. 16A, an image is formed on a final sheet subjected to the image formation, and the final sheet is discharged from an upper image forming unit main body (Step St01*a*). At this time, a job end signal is sent from the image forming unit A, and the binding operation control portion 75 causes the paddles 36 to be positioned and held at predetermined positions, that is, causes the paddle blades to wait (Step St02*a*). Together with this, a left alignment plate 46R and a right alignment plate 46F move to waiting positions. The waiting positions at this time correspond to waiting positions with the center alignment reference in the case of two-position binding (Step St03*a*), or correspond to waiting positions close to the corner binding position in the case of the corner binding (Step St03*a*'). In FIG. 16B, the sheets having been thrusted out from the sheet delivery port 16 of the image forming unit A is fed from the carry-in port 21 of the sheet carry-in passage (sheet delivery passage) 22, and the sheet sensor Se1 detects that the sheet trailing edge is discharged from the sheet delivery rollers 32 (Step St03*c*).

When the sheet trailing edge leaves from the sheet delivery rollers 32 (Step St04), the control portion 75 causes the paddles 36 waiting on the processing tray 24 to be lifted down (Step St05). This operation is performed by starting the paddle lifting motor M3. At the same time with the paddle lift-down operation, the control portion 75 causes the knurled members 33 to be lifted up so that the knurled members 33 retreat upward from the uppermost sheet on the processing tray 24 (Step St08*a*).

With the above-mentioned operations, the sheets having been delivered from the image forming unit A is delivered to the sheet carry-in passage 22. After the sheet trailing edge passes through the sheet delivery rollers 32, the paddle 36 is rotated (Step St08*b*) in a direction opposite to the sheet delivery direction under a state in which the knurled members 33 retreat upward from the tray, with the result that the sheet is conveyed backward. With this, the conveyance direction of the sheets having been delivered to the sheet carry-in passage 22 is reversed at the sheet delivery port 23, and the sheet is received on the processing tray 24 below the sheet delivery port.

Next, the control portion 75 causes the sheets to be conveyed backward from the sheet delivery port 23 in a direction opposite to the sheet delivery direction, and thereafter controls the paddles to be lifted up to retreat from the sheet after elapse of a predetermined time period (Step St06*a*). At the same time, the control portion 75 causes the knurled members 33 being rotated in the direction opposite to the sheet delivery direction to be lifted down from the waiting positions to engage with the sheet having been conveyed to the processing tray 24 (Step St09).

With the above-mentioned operations, the sheet is delivered from the sheet delivery port 23 by the sheet delivery rollers 32, reversely conveyed in the direction opposite to the sheet delivery direction by the paddles 36 from the sheet delivery port 23, and conveyed to the processing tray 24. Then, the sheet is delivered by the knurled members 33 to a predetermined position of the processing tray, that is, to the trailing edge regulation members 41. With the above-mentioned sheet delivery operations, the sheet is discharged with the center reference Sx from the sheet delivery port 23. The sheet can be discharged with the one-side reference from the sheet delivery port 23. However, as a matter of convenience in description, description is made of the case where the sheet is discharged with the center reference Sx.

Next, with a detection signal of the sheet delivery sensor Se1 as a reference, the control portion 75 causes the knurled members 33 to move to home positions HP (Step St10) with an estimated time period in which the trailing edge of the sheet having been fed to the processing tray 24 is brought into abutment against the predetermined trailing end regulation stoppers (trailing edge regulation members) 41.

Next, in FIG. 16A, the control portion 75 causes the sheet alignment mechanism 45 to perform the widthwise alignment to the sheet under a state in which the trailing edge is held in abutment against the trailing edge regulation members 41. In this alignment operation, alignment positions of the sheet differ depending on designation of "the multi-binding mode" (two-position binding mode) and designation of "the corner binding mode" (one-position binding mode). When "the multi-binding mode" is designated, the control portion 75 causes the left side alignment member 46R and the right side alignment member 46F to reciprocate between alignment positions at which the sheet having been fed to the processing tray 24 conforms to the size width with the sheet delivery reference (center reference Sx) and waiting positions apart from the alignment positions outward (center alignment). That is, based on size information sent from the image forming unit A, the control portion 75 performs the widthwise alignment to the sheets by moving the side alignment members 46F and 46R from the waiting positions wider than the size width to the alignment positions conforming to the size width (Step St11*a* to Step St13).

When "the corner binding mode" is designated, the control portion 75 causes, based on the size information, one of the left side alignment member 46R and the right side alignment member 46F on the binding position side to move to the binding positions and stop thereat. With the size width of the sheet having been fed to the processing tray 24 as a reference, the side alignment member on the opposite side is moved to the alignment position from the waiting position retreated from the reference. A distance relationship conforming to the size width is set between the alignment position of the alignment member on the movable side and the stopped alignment position of the alignment member on the binding position side (corner binding position alignment). Thus, when the corner binding is to be performed, one side alignment member is moved to the designated binding position on the right or left and stopped thereat. Then, after the sheet enters the processing tray 24, the side alignment member on the opposite side is moved by the amount conforming to the size width to perform alignment with one-side reference (Step St14*a* to Step St16).

The control portion 75 differs the number of times of the alignment operation by the side alignment members 46F and 46R in accordance with the number of sheets conveyed to the processing tray (see FIG. 19A to FIG. 19D). This is for the purpose of enhancing the alignment for the sheets exceeding a predetermined number of sheets. This control is described in detail. When the number of sheets having been detected by the sheet delivery sensor Se1 and fed to the processing tray 24 exceeds a predetermined number, after the normal alignment operation, the side alignment members 46F and 46R are moved to the alignment reference positions again to perform the alignment.

A threshold of the predetermined number differs depending on the sheet size. For sheets exceeding a predetermined size, which is relatively less likely to move or less likely to be aligned, the control of differing the alignment operation is executed even when the number of the sheets is small. For example, for the sheets having a size equal to or less than the predetermined size, the alignment operation is performed again from the twenty-first sheet of the number of sheets having been fed to the processing tray 24. For the sheets having a size exceeding the predetermined size, the alignment operation is performed again from the eleventh sheet of the number of sheets having been conveyed to the processing tray 24. The counting of the number of delivered sheets may be determined based on the number information sent from the image forming apparatus main body, other than usage of the sheet delivery sensor Se1.

Next, the control portion 75 performs the binding operation (Step St17*c*). When the multi-binding is to be performed, the stapler unit 26 having been stopped at the binding position in advance is actuated to perform the binding at that position. Then, the stapler unit 26 is moved along the sheet trailing edge by a predetermined distance to perform the binding at the second binding position (Step St18 to Step St20*a*). When the corner binding is to be performed, the stapler unit 26 having been stopped at that binding position in advance is actuated to perform the binding.

Next, when a signal indicating termination of the operation is received from the stapler unit 26, the control portion 75 controls the sheet bundle carry-out portion 60 to actuate to discharge the sheet bundle from the processing tray 24 to the stack tray 25 on downstream (Step St21). When this sheet bundle carry-out operation is completed, the control portion 75 causes the sheet bundle carry-out portion 60 to move and return to the initial position (Step St22). The side alignment members 46 move and return to the initial positions, which are the waiting position when the sheet is fed to the processing tray 24.

Further, the control portion 75 causes the bundle pressing portion (elastic pressing member) 53 arranged on the stack tray 25 to rotate by the drive motor which is the common drive motor M2 for the paddle rotary members 36 (Step St24), and presses and holds the uppermost sheet of the sheet bundle having been fed to the stack tray 25 (Step St25*a*).

[Eco-binding Mode]

When the eco-binding operation is to be performed, similarly to the above-mentioned operation, the control portion 75 causes the sheet having been fed to the processing tray 24 to be brought into abutment against the trailing edge regulation members 41 and positioned thereat.

When the stapleless binding is designated, before the sheet is fed to the processing tray 24, the control portion 75 causes the left side alignment member 46R positioned on the binding unit side to move to the alignment position close to the eco-binding position Ep (eco-alignment position Ap2) and wait thereat in a state of being stopped (Step St26*a* to Step St26*d*). The control portion 75 causes a sheet bundle guide to move from the retreated position above the tray to the actuating position on the tray. With the shift of the guide in height, a height position of the guide surface is moved from a higher retreated position to a lower actuating position in conjunction with the movement of the stapler unit 26. Thus, in FIG. 17B, the control portion 75 causes the stapler unit 26 to move from a predetermined position (home position) to the position in engagement with the sheet bundle guide (Step St27). The stapler unit 26 of this embodiment is set so as to be engaged with the sheet bundle guide when the stapler unit 26 is at a position Gp between the left multi-binding position Ma2 and the left corner binding position Cp2 which are illustrated in FIG. 5.

The control portion 75 causes the opposed right side alignment member 46F on the opposite side to move to the waiting position which is apart from the side edge of the sheet to be fed to the tray. Further, the control portion 75 causes the alignment motor to drive to move the right side alignment member 46F to the alignment position. This alignment position is set to a position at which a distance with respect to the left side alignment member 46R being stopped at the eco-alignment position matches with the width size of the sheet.

This embodiment is characterized in that, when the eco-binding is to be performed, the sheet having been fed to the processing tray 24 is aligned to the eco-alignment position Ap2 apart from the binding position without alignment to the binding position of the sheets. When the eco-alignment position Ap2 is set to a reference for conveying the sheet from the sheet delivery port 23, for example, to the center reference, it becomes the same as the alignment position for the multi-binding. When the eco-alignment position Ap2 is set to a position close to the eco-binding position Ep, a sheet jam caused by interference of the sheet with the eco-binding unit 27 does not occur at the time of alignment. Accordingly, a distance of moving the sheet bundle to the eco-binding position Ep after the alignment can be shortened. Thus, it is preferred that the eco-alignment position Ap2 be set to a position as close as possible to the eco-binding position Ep within the range of not causing interference of the sheet with the binding unit.

Next, the control portion 75 causes the sheet bundle having been aligned at the eco-alignment position Ap2 to move with offset by the side alignment member 46 to the eco-binding position Ep (Step St30). Then, the control portion 75 causes the side alignment member 46F positioned on the apparatus front side to retreat in a state of being separated from the sheet by a predetermined amount (Step St31). Then, the sheet alignment mechanism 45 drives the sheet bundle conveyance portion 60 to move the sheet bundle by a predetermined amount to downstream in the sheet delivery direction (Step St32*a* and Step St32*b*).

Next, the control portion 75 causes the right side alignment member 46F to move to the home position (Step St34). Then, the control portion 75 transmits a command signal to the stapleless binding portion (press binder unit) 27 to perform the binding operation (Step St35). After that, when a processing end signal is received from the binder unit 27, the control portion 75 causes the left side alignment member 46R to move to the home position (Step St36). Then, the control portion 75 executes the processing of separating the sheet bundle, which has been clamped by the stapleless binding portion 27 and held in close contact with the clamping teeth 27*b* and 27*c* each having a corrugated shape, from the clamping teeth 27*b* or 27*c* (Step St37).

Figure 18A:
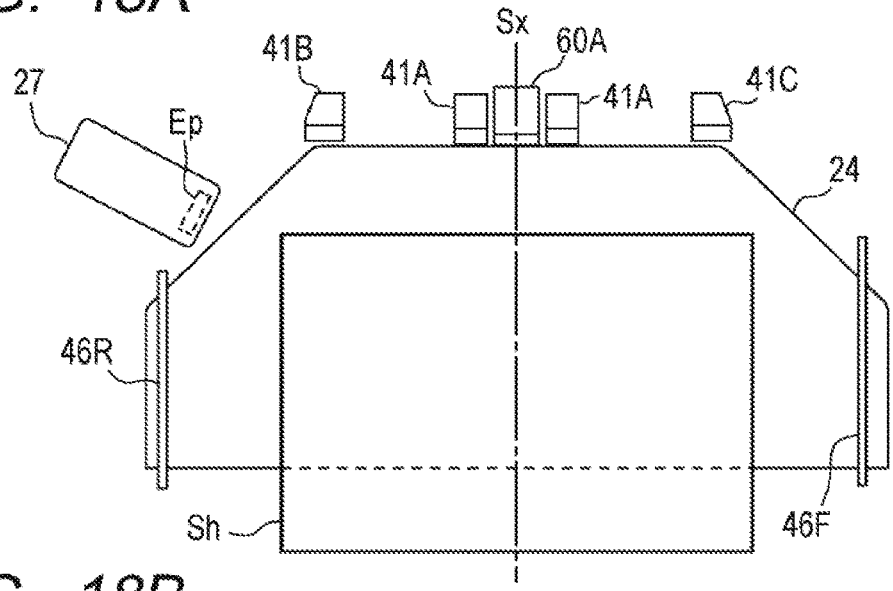
FIG. 18A is an explanatory schematic view for illustrating steps of stacking a sheet bundle, which has been discharged to the processing tray, and performing binding to the sheet bundle, as viewed from above in a direction perpendicular to a sheet placement surface of the processing tray.
Figure 18B:
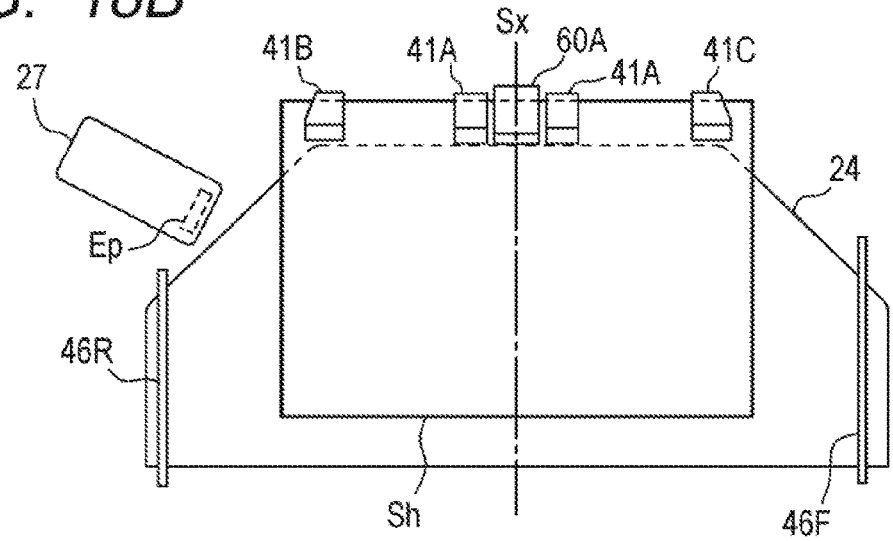
FIG. 18B is an explanatory schematic view for illustrating the steps of stacking a sheet bundle, which has been discharged to the processing tray, and performing binding to the sheet bundle, as viewed from above in the direction perpendicular to the sheet placement surface of the processing tray.

FIG. 18A to FIG. 18E are illustrations of steps from stacking the sheet bundle on the processing tray 24 to performing binding. As illustrated in FIG. 18A, each sheet Sh having been conveyed from the sheet delivery port 23 of the apparatus housing 20 to the processing tray 24 is moved by the paddle rotary members 36 of the sheet carry-in portion 35 in a direction opposite to the sheet delivery direction. Then, as illustrated in FIG. 18B, each sheet Sh is conveyed by the raking conveyance portion 33 until the sheet trailing edge is brought into abutment against the regulation stopper of the sheet edge regulation portion 40, that is, against the regulation surfaces 41*a* of the trailing edge regulation members 41.

Figure 18C:
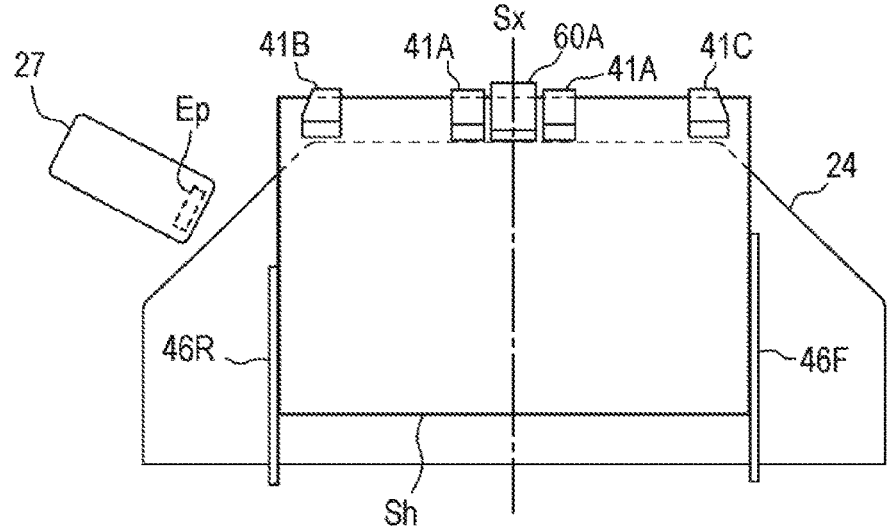
FIG. 18C is an explanatory schematic view for illustrating the steps of stacking a sheet bundle, which has been discharged to the processing tray, and performing binding to the sheet bundle, as viewed from above in the direction perpendicular to the sheet placement surface of the processing tray.

Next, the left side alignment member 46R and the right side alignment member 46F which are positioned at the retreated positions of FIG. 18B are moved inward so as to sandwich the sheet Sh from both sides, and the regulation surfaces 46*x* on the inner side are engaged with both side edges of the sheet. Then, as illustrated in FIG. 18C, the sheet Sh is moved so that a center in the right and left direction is aligned with the sheet center Sx on the processing tray 24. After that, the left side alignment member 46R and the right side alignment member 46F return to the retreated positions.

Until a predetermined number of sheets to be bound to form one sheet bundle are aligned in position and stacked on the processing tray 24, the steps of FIG. 18A to FIG. 18C are repeated. When a predetermined number of sheets Sh are stacked on the processing tray 24, the left side alignment member 46R and the right side alignment member 46F do not return to the retreated positions, and, as illustrated in FIG. 18D, sandwich the sheets as one sheet bundle Sb from both sides and conveys the sheet bundle Sb toward the stapleless binding position Ep side in a direction orthogonal to the sheet delivery direction.

Figure 18D:
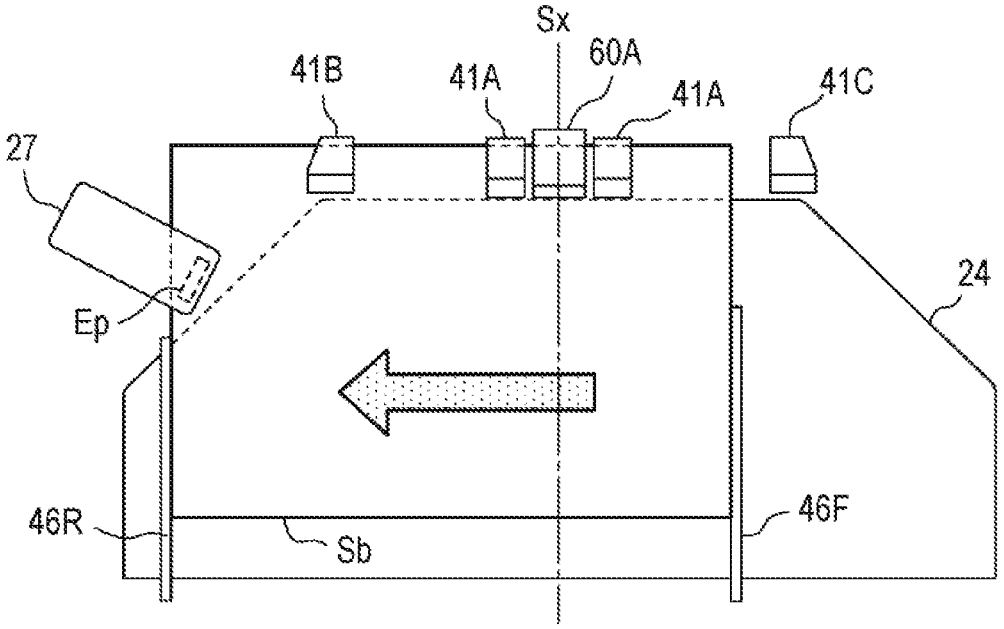
FIG. 18D is an explanatory schematic view for illustrating the steps of stacking a sheet bundle, which has been discharged to the processing tray, and performing binding to the sheet bundle, as viewed from above in the direction perpendicular to the sheet placement surface of the processing tray.
Figure 18E:
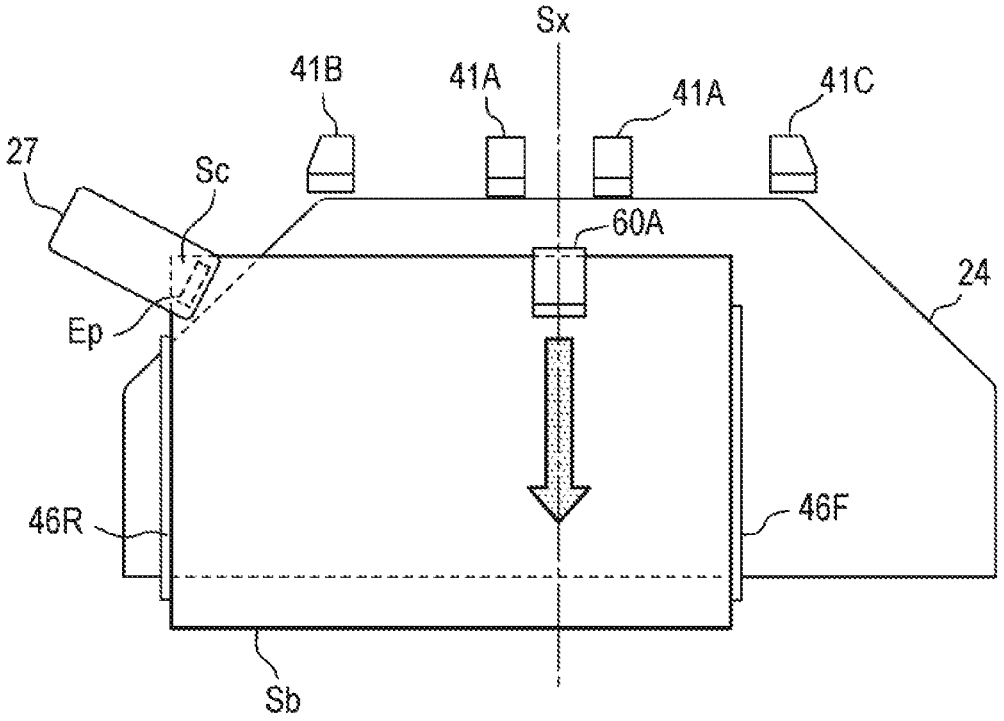
FIG. 18E is an explanatory schematic view for illustrating the steps of stacking a sheet bundle, which has been discharged to the processing tray, and performing binding to the sheet bundle, as viewed from above in the direction perpendicular to the sheet placement surface of the processing tray.

At the position of FIG. 18D, one side edge of the sheet bundle Sb is arranged between the upper clamping teeth 27*b* and the lower clamping teeth 27*c* of the stapleless binding portion 27 which are separated, while being sufficiently separated apart from the clamping teeth 27*b* and 27*c*. In this state, the first conveyance member 60A of the sheet bundle carry-out portion 60 is driven to push out the sheet bundle Sb from the trailing edge in the sheet delivery direction and move the sheet bundle Sb by a certain distance. With this, as illustrated in FIG. 18E, the corner portion Sc of the sheet bundle Sb to be bound is positioned at the stapleless binding position Ep. Then, the stapleless binding portion 27 is driven to perform the binding so that the corner portion Sc of the sheet bundle Sb is deformed by press contact and bound between the clamping teeth 27*b* and 27*c* which are in mesh with each other.

After the binding, separating processing for separating the corner portion Sc of the sheet bundle Sb, which is in close contact with one of the separated clamping teeth 27*b* and 27*c*, is performed. FIG. 19A to FIG. 19D are illustrations of steps of performing separating processing to the sheet bundle, conveying the sheet bundle along the processing tray 24, to deliver the sheet bundle to the stack tray 25, according to the first embodiment of the present invention.

Figure 19A:
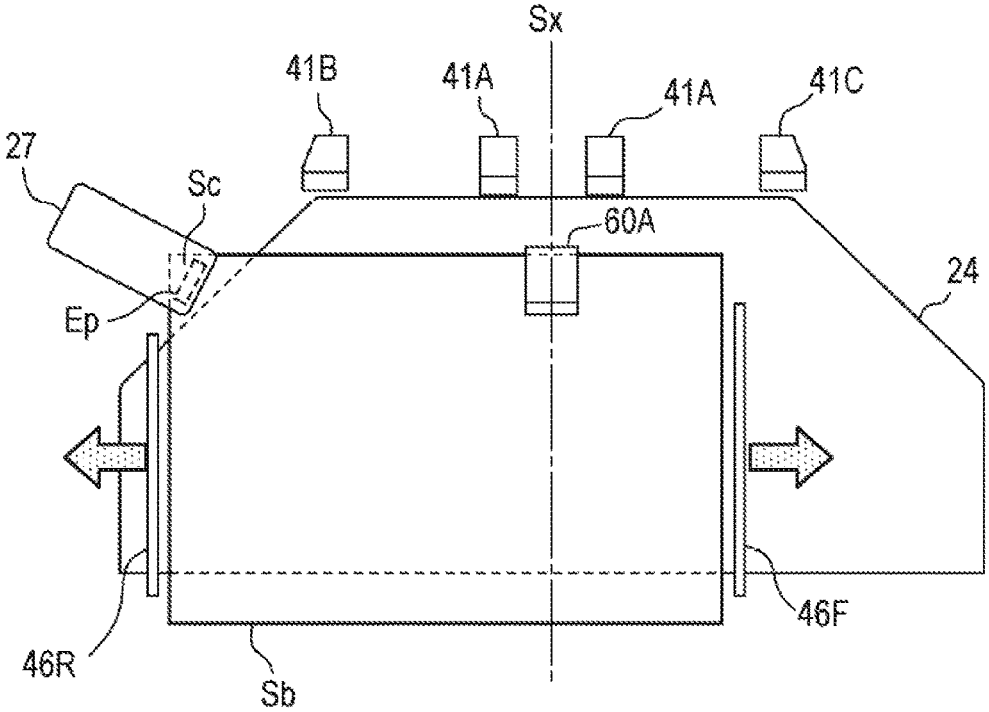
FIG. 19A is an explanatory schematic view, which is similar to FIG. 18A to FIG. 18C, for illustrating steps of separating the sheet bundle from the stapleless binding portion to deliver the sheet bundle to the stack tray, according to a first embodiment of the present invention.
Figure 19B:
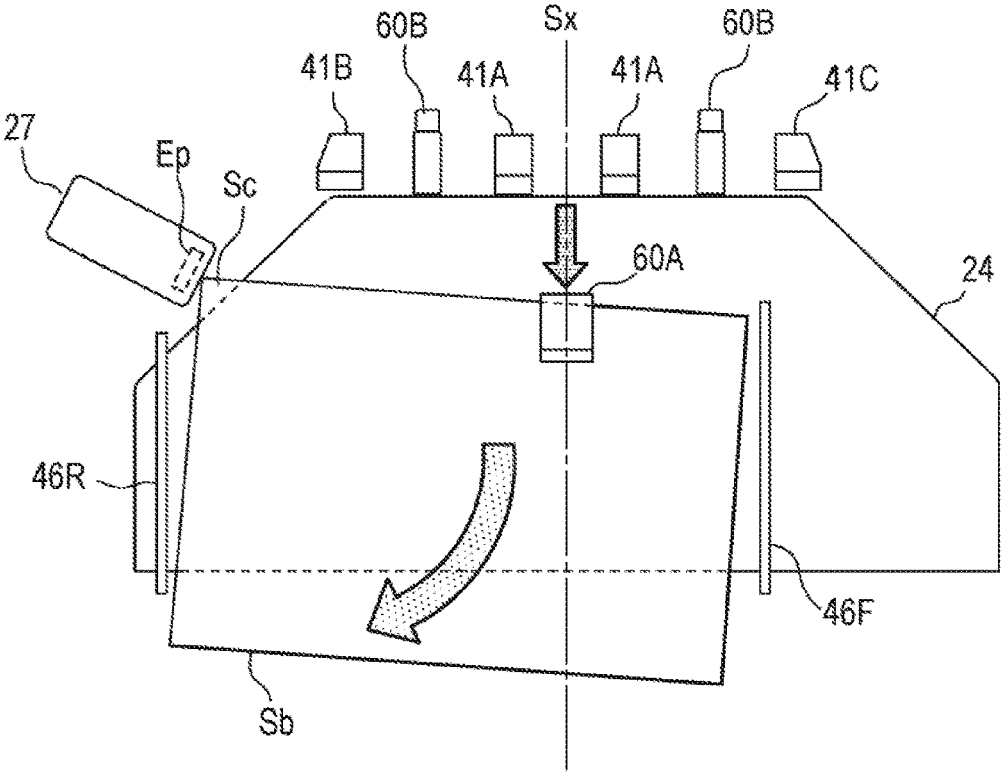
FIG. 19B is an explanatory schematic view, which is similar to FIG. 18A to FIG. 18C, for illustrating the steps of separating the sheet bundle from the stapleless binding portion to deliver the sheet bundle to the stack tray, according to the first embodiment of the present invention.
Figure 19C:
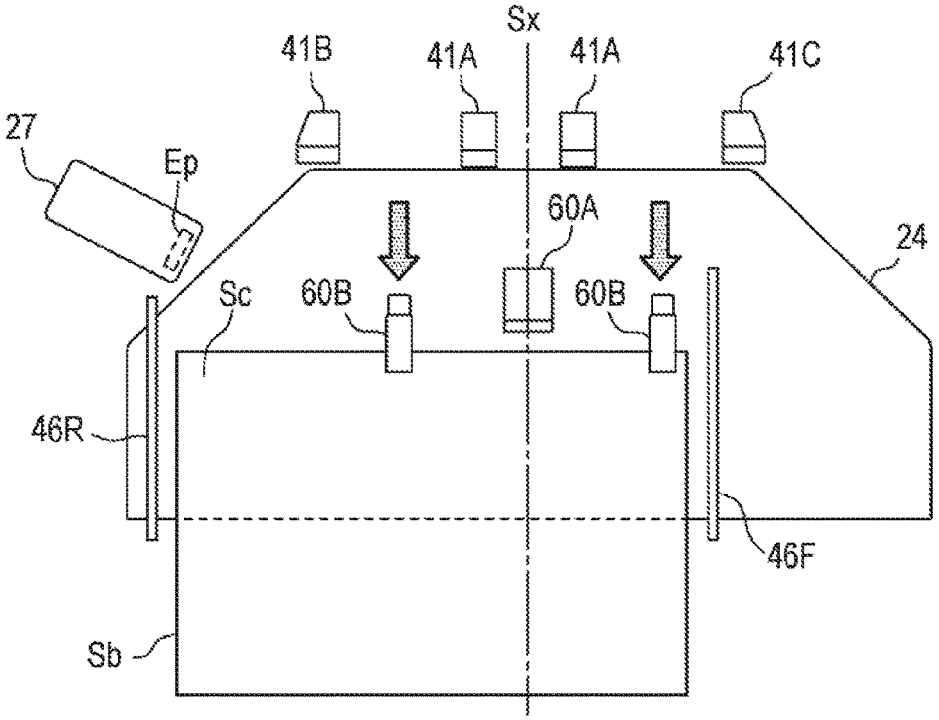
FIG. 19C is an explanatory schematic view, which is similar to FIG. 18D and FIG. 18E, for illustrating the steps of separating the sheet bundle from the stapleless binding portion to deliver the sheet bundle to the stack tray, according to the first embodiment of the present invention.

First, as illustrated in FIG. 19A, the upper clamping teeth 27*b* and the lower clamping teeth 27*c* of the stapleless binding portion 27 are separated from each other, and at the same time, the left side alignment member 46R and the right side alignment member 46F are moved outward so as to be separated by a small distance from the side edges of the sheet bundle Sb. Next, as illustrated in FIG. 19B, the first conveyance member 60A for the sheet bundle carry-out portion 60 is driven again to slightly push out the sheet bundle Sb from the trailing edge in the sheet delivery direction, thereby applying a rotational movement in the clockwise direction in FIG. 19B about the corner portion Sc, that is, the stapleless binding portion to the sheet bundle Sb. That is, the left side alignment member 46R and the right side alignment member 46F on the left and right side edges of the sheet bundle Sb are separated from the sheet bundle Sb, thereby releasing the sheet bundle Sb in the right and left direction. Then, a push-out force is applied only to the trailing edge side of the sheet bundle Sb held in abutment against the first conveyance member 60A, thereby causing the rotational movement. The range of rotation of the sheet bundle Sb is limited by the side edge of the sheet bundle Sb on the corner portion Sc side brought into abutment against the side alignment member 46R on the same side as the side edge.

This rotational movement is applied so as to twist the corner portion Sc of the sheet bundle Sb with respect to the one clamping teeth having been in close contact with the sheet bundle Sb. With this, the portion of the sheet bundle at the corner portion Sc which has been sandwiched between the upper clamping teeth 27*b* and the lower clamping teeth 27*c* and deformed into a corrugated shape is gradually separated while being rotated in the surface direction of the sheet bundle rather than be entirely separated instantly with a strong force. As a result, the corner portion Sc of the sheet bundle Sb can be separated from the clamping teeth 27*b* or 27*c* in a relatively easier manner. The rotational movement can be sufficiently performed with a relatively small force of the first conveyance member 60A, which is applied to deliver the sheet bundle Sb from the processing tray 24 to the stack tray 25. Thus, there is no need to use a large force for moving the binding tool and an additional structure unlike the related art, thereby being capable of avoiding upsizing of the entire apparatus, increase in weight, and increase in cost.

As illustrated in FIG. 19B, a posture of the sheet bundle Sb having been subjected to the separating processing remains inclined on the processing tray 24 with respect to the sheet delivery direction due to the rotational movement. In order to align and receive all of the sheet bundles Sb on the stack tray 25, each sheet bundle Sb can be corrected in posture to be straight with respect to the sheet delivery direction and delivered.

For that purpose, in this embodiment, the sheet delivery processing for the sheet bundle Sb is performed under a state in which the left side alignment member 46R and the right side alignment member 46F are stopped at an appropriate intermediate position between the retreated positions of FIG. 18A and the alignment positions of FIG. 18E. The sheet delivery processing for the sheet bundle Sb is performed through use of the sheet carry-out portion 60, which includes one first conveyance member 60A and a pair of second conveyance members 60B arranged on both right and left sides of the first conveyance member 60A.

First, the first conveyance member 60A travels while pushing the trailing edge of the sheet bundle Sb until it passes the first section Tr1 of FIG. 11A. When the first conveyance member 60A enters the second section Tr2, the second conveyance members 60B catch up and engage with the trailing edge of the sheet bundle Sb. Then, the second conveyance members 60B in place of the first conveyance member 60A further convey the sheet bundle Sb in the sheet delivery direction.

As illustrated in FIG. 19B, the first conveyance member 60A engages with the trailing edge of the sheet bundle Sb at a position of being offset from a center in the right and left direction to a side opposite to the stapleless binding portion, that is, the corner portion Sc. The displacement of the sheet bundle Sb to both right and left sides is restricted by the left side alignment member 46R and the right side alignment member 46F positioned at an intermediate position. Thus, while the sheet bundle Sb is being pushed by the first conveyance member 60A, a change in posture of the sheet bundle Sb occurs only within the range of being regulated by the left side alignment member 46R and the right side alignment member 46F. Thus, the posture of the sheet bundle Sb can be adjusted by the left side alignment member 46R and the right side alignment member 46F so that the sheet bundle Sb is rotated only by a necessary amount when the sheet bundle Sb is separated from the stapleless binding portion 27, without causing unnecessary rotation.

One of the second conveyance members 60B, that is, the second conveyance member 60B on a side closer to the corner portion Sc of the sheet bundle Sb engages with the trailing edge of the sheet bundle Sb earlier than another and before catching up the first conveyance member 60A. This engagement position is offset from the center of the sheet bundle Sb in the right and left direction to the corner portion Sc side. Therefore, the one of the second conveyance members 60B acts on the sheet bundle Sb toward a direction of returning the posture of the sheet bundle Sb to be straight.

When one second conveyance member 60B proceeds beyond the first conveyance member 60A, and the posture of the sheet bundle Sb is straightened, as illustrated in FIG.

Figure 19D:
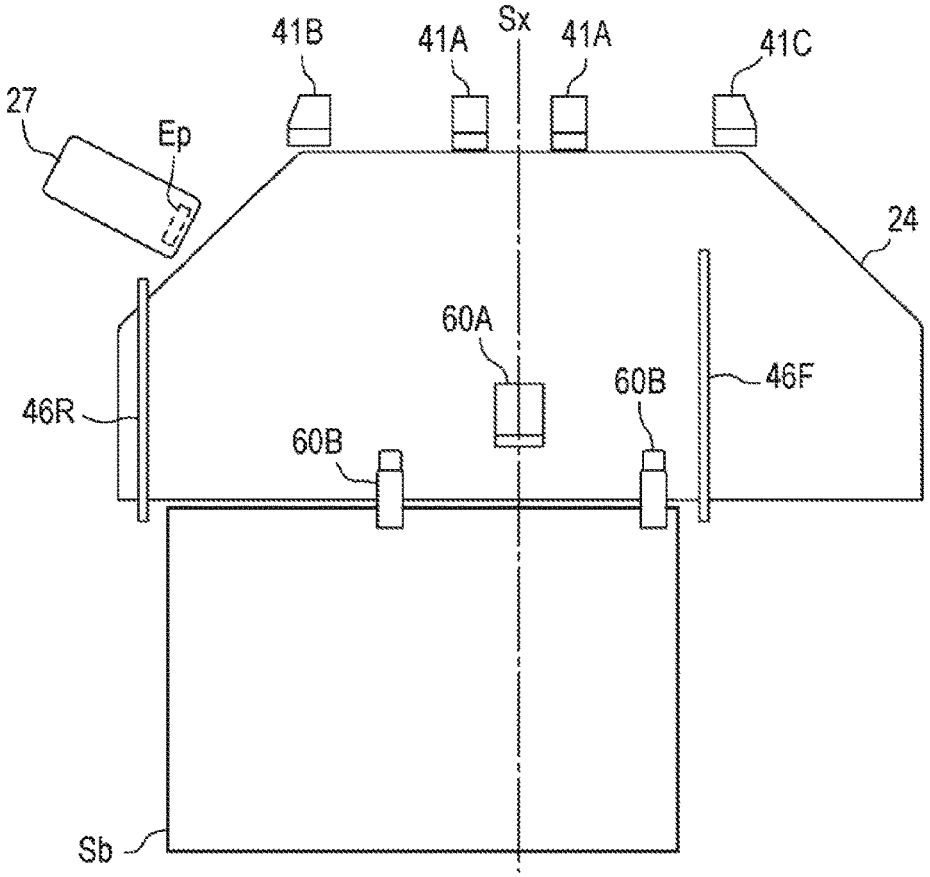
FIG. 19D is an explanatory schematic view, which is similar to FIG. 18D and FIG. 18E, for illustrating the steps of separating the sheet bundle from the stapleless binding portion to deliver the sheet bundle to the stack tray, according to the first embodiment of the present invention.

19C, another second conveyance member 60B catches up the trailing edge of the sheet bundle Sb to be brought into engagement therewith. As illustrated in FIG. 19D, the sheet bundle Sb is conveyed while maintaining the straight posture and delivered from the processing tray 24 to the stack tray 25.

Figure 20A:
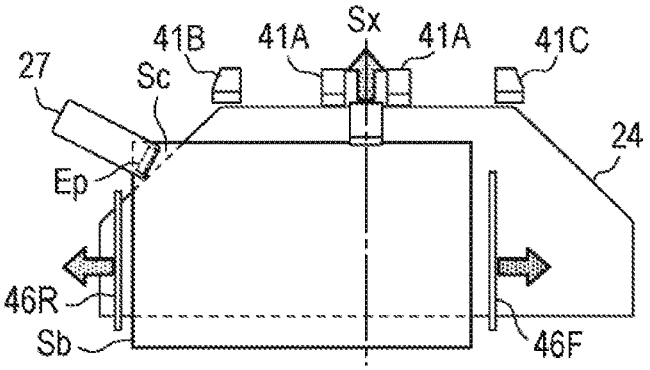
FIG. 20A is an explanatory schematic view, which is similar to FIG. 18A to FIG. 18C, for illustrating steps of separating the sheet bundle from the stapleless binding portion to deliver the sheet bundle to the stacking tray, according to a second embodiment of the present invention.

FIG. 20A to FIG. 20D are views for illustrating the steps of separating the sheet bundle Sb from the clamping teeth 27*b* or 27*c* to convey the sheet bundle Sb on the processing tray 24 and deliver the sheet bundle Sb to the stack tray 25, according to a second embodiment of the present invention. In this embodiment, after the binding, the clamping teeth 27*b* and 27*c* of the stapleless binding portion 27 are separated from each other, and at the same time, as illustrated in FIG. 20A, the left side alignment member 46R and the right side alignment member 46F are moved outward so as to be separated by a small distance from the side edges of the sheet bundle Sb. Further, the first conveyance member 60A is moved backward to a side opposite to the sheet delivery direction.

Figure 20B:
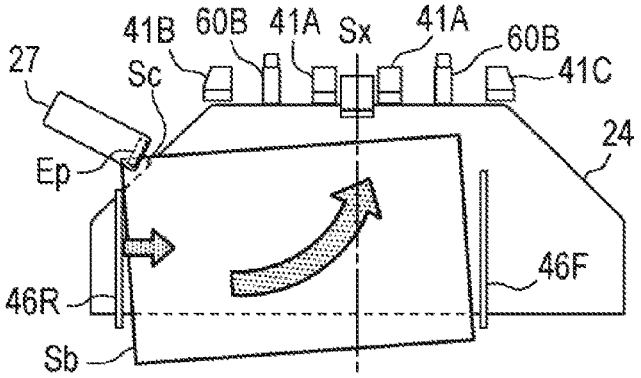
FIG. 20B is an explanatory schematic view, which is similar to FIG. 18A to FIG. 18C, for illustrating the steps of separating the sheet bundle from the stapleless binding portion to deliver the sheet bundle to the stacking tray, according to the second embodiment of the present invention.

Next, as illustrated in FIG. 20B, the side alignment member 46R on the same side as the corner portion Sc is moved inward to be brought into engagement with the adjacent side edge of the sheet bundle Sb. Further, the side alignment member 46R slightly pushes the sheet bundle Sb in a direction orthogonal to the sheet delivery direction, to thereby apply the rotational movement to the sheet bundle Sb in the counterclockwise direction in FIG. 20B about the corner portion Sc, that is, the stapleless binding portion. The range of the rotation of the sheet bundle Sb is restricted by abutment of the trailing edge of the sheet bundle Sb against the first conveyance member 60A or the trailing edge regulation members 41, or by abutment of the side edge of the sheet bundle Sb on a side opposite to the corner portion Sc against another side alignment member 46F.

This rotational movement is applied so as to twist the corner portion Sc of the sheet bundle Sb with respect to the one clamping teeth having been in close contact with the sheet bundle Sb. With this, the portion of the sheet bundle at the corner portion Sc, which has been sandwiched between the upper clamping teeth 27*b* and the lower clamping teeth 27*c* and deformed into a waveform, is gradually separated while being rotated in the surface direction of the sheet bundle rather than be entirely separated instantly with a strong force. As a result, the corner portion Sc of the sheet bundle Sb can be separated from the clamping teeth 27*b* and 27*c* in a relatively easier manner. The rotational movement can be sufficiently performed with a relatively small force of the side alignment member 46R, which is applied to move the sheet bundle Sb in the direction orthogonal to the sheet delivery direction on the processing tray 24. Thus, similarly to the first embodiment, there is no need to use a large force for moving the binding tool and an additional structure, thereby being capable of avoiding upsizing of the entire apparatus, increase in weight, and increase in cost.

At this time, as illustrated in FIG. 20B, a posture of the sheet bundle Sb having been subjected to the separating processing is inclined on the processing tray 24 with respect to the sheet delivery direction due to the rotational movement. Thus, similarly, in order to align and receive all of the sheet bundles Sb on the stack tray 25, each sheet bundle Sb can be corrected in posture to be straight with respect to the sheet delivery direction and delivered.

The correction and sheet delivery processing to the stack tray 25 for the sheet bundle Sb are, similarly to the first embodiment, performed through use of the sheet carry-out portion 60, which includes one first conveyance member 60A and a pair of second conveyance members 60B arranged on both right and left sides of the first conveyance member 60A. First, the first conveyance member 60A travels along the first section Tr1 of FIG. 11A while pushing the trailing edge of the sheet bundle Sb. When the first conveyance member 60A enters the second section Tr2, the second conveyance members 60B catch up and engage with the trailing edge of the sheet bundle. Then, the second conveyance members 60B in place of the first conveyance member 60A further convey the sheet bundle Sb in the sheet delivery direction.

The first conveyance member 60A engages with the trailing edge of the sheet bundle Sb at a position of being offset from a center of the sheet bundle Sb in the right and left direction to the side opposite to the corner portion Sc. The displacement of the sheet bundle Sb to both right and left sides is restricted by the left side alignment member 46R and the right side alignment member 46F. In this embodiment, the sheet bundle Sb is rotated in the counterclockwise direction in FIG. 20B by the separating operation. However, it is expected that the sheet bundle Sb be returned to some extent by being pushed by the first conveyance member 60A so that the inclined posture is corrected to some extent.

Figure 20C:
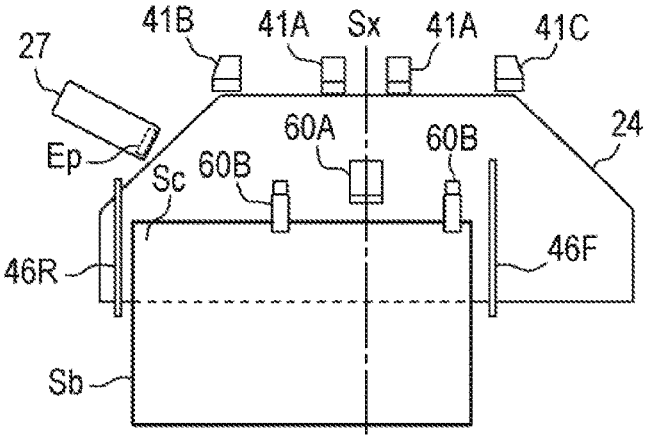
FIG. 20C is an explanatory schematic view, which is similar to FIG. 18A to FIG. 18C, for illustrating the steps of separating the sheet bundle from the stapleless binding portion to deliver the sheet bundle to the stacking tray, according to the second embodiment of the present invention.
Figure 20D:
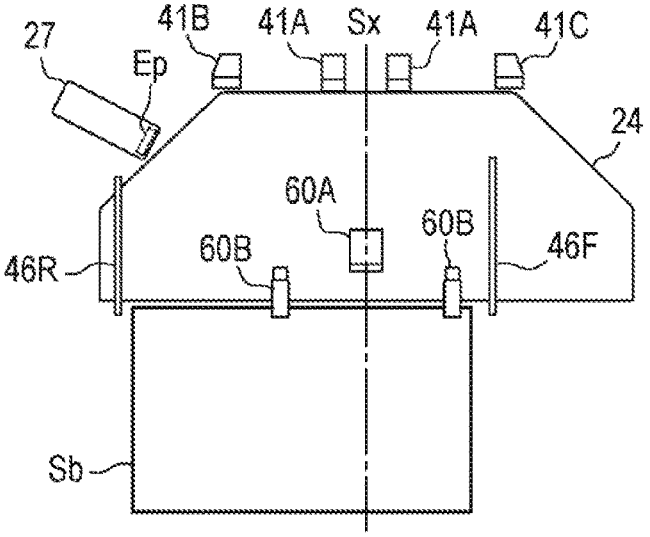
FIG. 20D is an explanatory schematic view, which is similar to FIG. 18A to FIG. 18C, for illustrating the steps of separating the sheet bundle from the stapleless binding portion to deliver the sheet bundle to the stacking tray, according to the second embodiment of the present invention.

The pair of second conveyance members 60B are arranged on both sides of the sheet bundle Sb with respect to a center in the right and left direction. Thus, even when the sheet bundle Sb is inclined in any direction, any one of the pair of second conveyance members 60B engages with the trailing edge of the sheet bundle Sb earlier than another and before catching up the first conveyance member 60A. Then, when the posture of the sheet bundle Sb is straightened by one second conveyance member 60B, as illustrated in FIG. 20C, another second conveyance member 60B catches up the trailing edge of the sheet bundle Sb to be brought into engagement therewith. As illustrated in FIG. 20D, similarly, the sheet bundle Sb is conveyed while maintaining the straight posture and delivered from the processing tray 24 to the stack tray 25.

At this time, the left side alignment member 46R and the right side alignment member 46F are held at the positions of being separated from the right and left edges of the sheet bundle Sb at the time of the separating processing. According to another embodiment, at substantially the same timing as or at a slightly later than the engagement of the second conveyance members 60B to the trailing edge of the sheet bundle Sb, both or one of the side alignment members 46R and 46F can be moved to approach the side edges of the sheet bundle Sb. The sheet bundle Sb can be delivered to the stack tray 25 in a better posture by correcting the sheet bundle Sb from the right and left direction by the side alignment members 46R and 46F.

According to another embodiment, the movement velocity of the first conveyance member 60A for the processing of separating the sheet bundle Sb can be set different depending on a surface state, that is, a surface roughness or a degree of slippage of the sheet bundle Sb. For example, depending on the roughness and hardness of paper fibers forming the sheet, the degree of holding or biting of the sheet with respect to the clamping teeth 27*b* and 27*c* may differ. Thus, in a case of a sheet having a rough surface which is held relatively strongly, the first conveyance member 60A is moved at relatively low velocity so as to relatively slowly rotate the sheet bundle. With this, the load of the motor for driving the first conveyance member 60A can be prevented from being excessively increased. In contrast, in a case of a sheet having a smoothed surface such as a so-called coated paper, the sheet is less liable to be held by the clamping teeth 27*b* and 27*c*. Thus, the sheet can be easily separated from the clamping teeth 27*b* or 27*c*. Accordingly, without application of an excessive load to the motor, the first conveyance member 60A can be moved at relatively high velocity, thereby being capable of efficiently delivering the sheet bundle Sb and improving productivity.

The posture correction operation by the posture correction mechanism is described more in detail. After the removal by the rotational movement has been completed, the second conveyance members 60B serving as the posture correction members are moved in the delivery direction of the sheet bundle. Then, the second conveyance members 60B take over the first conveyance member 60A serving as the push-out member in the delivery direction of the sheet bundle so that the second conveyance members 60B are brought into abutment against the sheet bundle, thereby performing the posture correction operation (see FIG. 29A). Through the removal by the rotational movement, the sheet bundle is inclined in a manner that the sheet bundle on the side separated from the stapleless binding portion 27 in the width direction proceeds in the delivery direction (see FIG. 29B). The two second conveyance members 60B are arranged on sides opposite to each other over the center axis, which passes through the gravity center position of the sheet bundle and extends in the delivery direction. According to this, when the two second conveyance members 60B are moved toward the sheet bundle which is inclined by the rotation, first, the second conveyance member 60B positioned on the stapleless binding portion 27 side with respect to the center axis of the sheet bundle is brought into contact with the sheet bundle. Then, the sheet bundle on the stapleless binding portion 27 side in the width direction is pushed to proceed in the delivery direction. Next, the second conveyance members 60B take over the first conveyance member 60A, and the second conveyance member 60B at a position on a side opposite to the stapleless binding portion 27 with respect to the center axis of the sheet bundle is also brought into abutment against the sheet bundle. Then, the two second conveyance members 60B are brought into abutment against the edge portion of the sheet bundle so that the sheet bundle is corrected to a predetermined posture (see FIG. 29C). The two second conveyance members 60B are arranged on sides opposite to each other over the center axis, which passes through the gravity center position of the sheet bundle and extends in the delivery direction. Therefore, under a state in which the two second conveyance members 60B are brought into abutment against the sheet bundle, the sheet bundle is not rotated but is conveyed in a state of maintaining the predetermined posture. As described above, in the series of sheet bundle delivery operations, both the separating operation through the rotation and the operation of correcting and returning the posture of the rotated sheet bundle are performed, thereby being capable of improving the productivity.

The operation in which the first conveyance member 60A is brought into abutment against the sheet bundle and thereafter the second conveyance members 60B take over the first conveyance member 60A to be brought into abutment against the sheet bundle can be achieved with the sheet bundle carry-out mechanism 60 having the structure as illustrated in, for example, FIG. 11A to FIG. 11D and FIG. 25A to FIG. 25C even in a case where the same drive source is used. As a matter of course, the above-mentioned operation can be achieved also by driving of the first conveyance member 60A and the second conveyance members 60B with independent drive sources.

In the description above, the second conveyance members 60B are used as the posture correction members. However, in place of the second conveyance members 60B, or in addition to the second conveyance members 60B, the plate-like member 60B' extending across both sides of the center axis, which passes through the gravity center position of the sheet bundle having been subjected to the stapleless binding and extends in the delivery direction, may be provided to use the plate-like member 60B' as the posture correction member.

A force required for the first conveyance member 60A serving as the push-out member to separate the sheet bundle, which is held by the clamping teeth members 27*b* or 27*c*, from the clamping teeth members 27*b* or 27*c* is larger than a force required for the second conveyance members 60B serving as the posture correction members to correct the posture of the sheet bundle which has been separated. Thus, a torque for driving the first conveyance member 60A serving as the push-out member can be set higher than a torque for driving the second conveyance members 60B serving as the posture correction members. Further, after the first conveyance member 60A serving as the push-out member is brought into abutment against the sheet bundle, it is required that the second conveyance members 60B serving as the posture correction members be brought into contact with the sheet bundle. Therefore, in a case where the first conveyance member 60A and the second conveyance members 60B of the sheet bundle carry-out mechanism 60 are to be used also as the push-out member and the posture correction members, it is required that the movement velocity of the second conveyance members 60B be set higher than the movement velocity of the first conveyance member 60A.

Figure 17A:
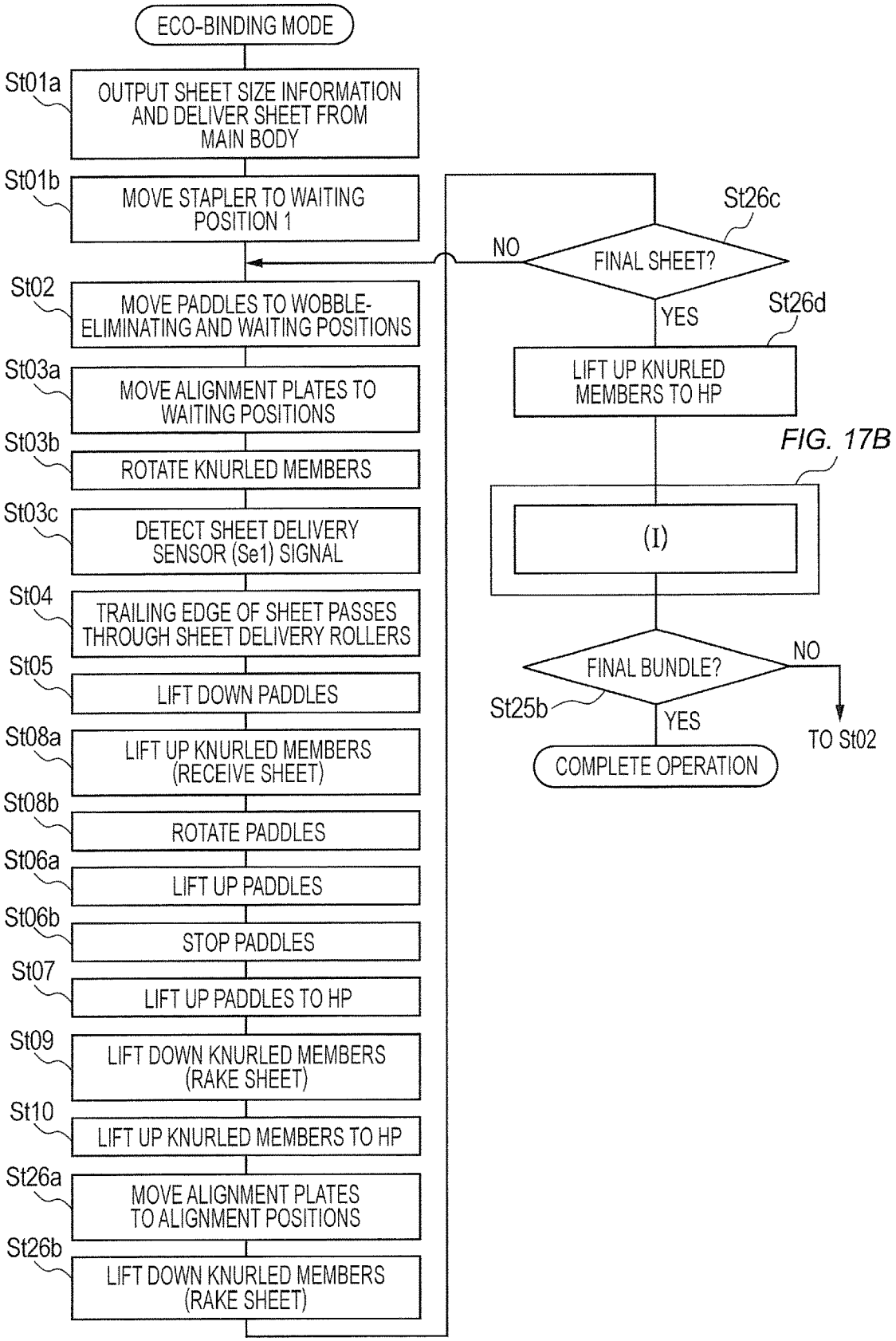
FIG. 17A is an illustration of part of an operation flow in an eco-binding mode.
Figure 17B:
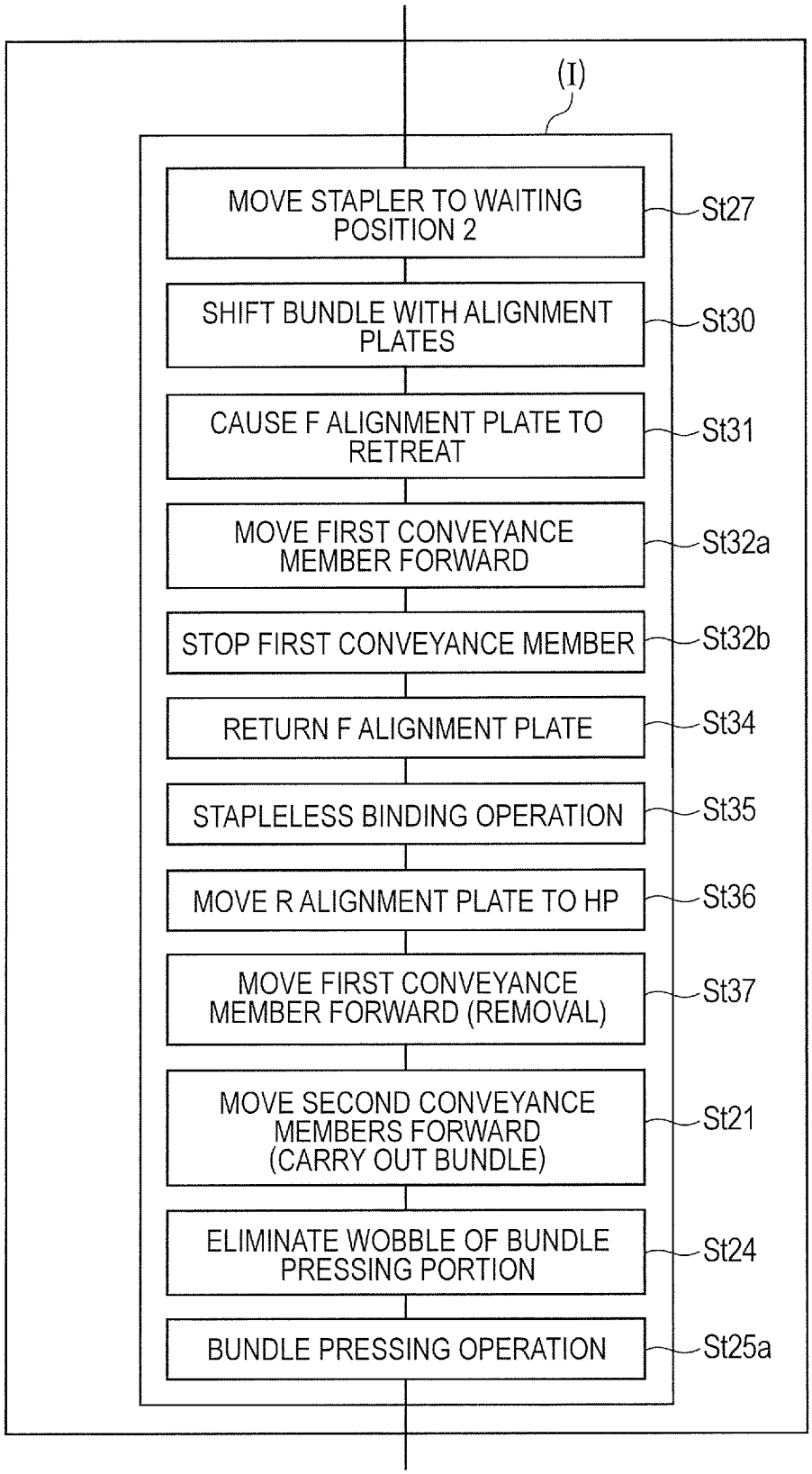
FIG. 17B is an illustration of part of the operation flow in the eco-binding mode.
Figure 28A:
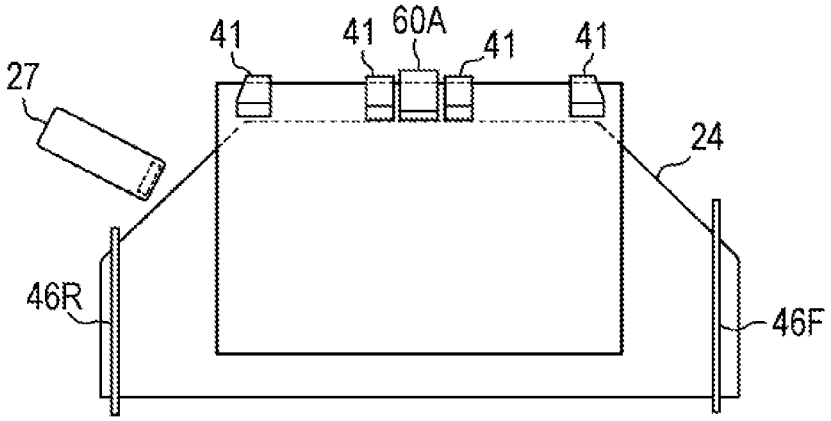
FIG. 28A is an explanatory view for illustrating another embodiment of a separating operation by rotation in the sheet processing apparatus, and is an illustration of a state immediately after a sheet bundle is fed.
Figure 28B:
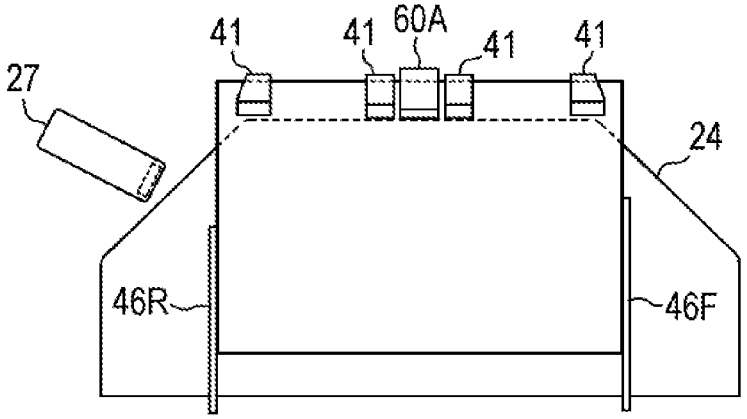
FIG. 28B is an explanatory view for illustrating another embodiment of the separating operation by rotation in the sheet processing apparatus, and is an illustration of a state in which the sheet bundle is aligned to take a predetermined posture.
Figure 28C:
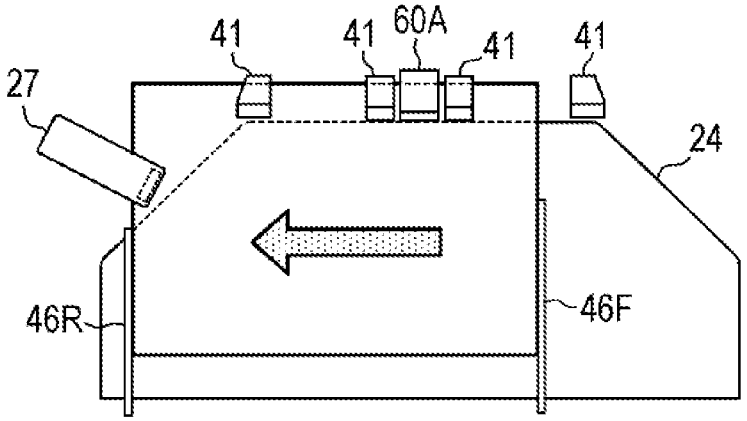
FIG. 28C is an explanatory view for illustrating another embodiment of the separating operation by rotation in the sheet processing apparatus, and is an illustration of a step of moving the sheet bundle to an eco-binding position for the stapleless binding.
Figure 28D:
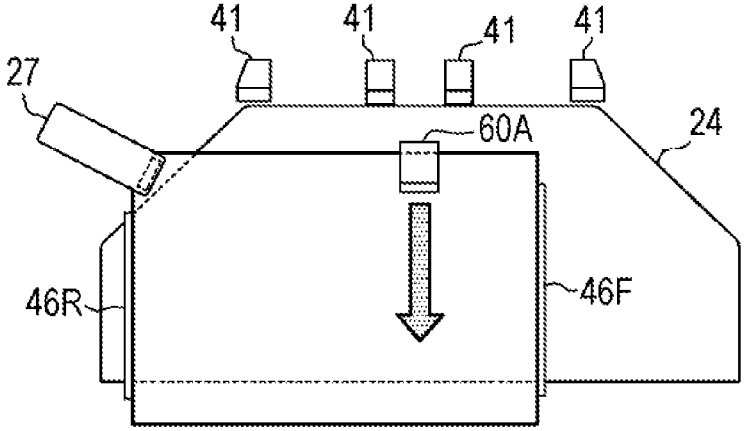
FIG. 28D is an explanatory view for illustrating another embodiment of the separating operation by rotation in the sheet processing apparatus, and is an illustration of the step of moving the sheet bundle to the eco-binding position for the stapleless binding.

The separating operation by the rotation application mechanism and the posture correction operation by the posture correction mechanism are applied not only to the operation of the eco-binding mode illustrated in FIG. 17A and FIG. 17B but can also be applied after any stapleless binding by the press-contact binding. For example, the operations can also be applied after the stapleless binding as illustrated in, for example, FIG. 28A to FIG. 28D. In the stapleless binding illustrated in FIG. 28A to FIG. 28D, first, the control portion 75 causes sheets having been fed to the processing tray 24, as illustrated in FIG. 28A to be stacked. After that, as illustrated in FIG. 28B, the control portion 75 moves the left side alignment member 46R and the right side alignment member 46F from the waiting positions wider than the width of the sheet to alignment positions conforming to the sheet width based on the sheet size information, thereby aligning the sheet in the widthwise direction. Next, as illustrated in FIG. 28C, the control portion 75 causes the side alignment members 46F and 46R to shift, while maintaining an interval therebetween, in a direction orthogonal to the delivery direction of the sheet bundle toward the stapleless binding portion 27. After that, as illustrated in FIG. 28D, the control portion 75 causes the first conveyance member 60A of the sheet bundle carry-out mechanism 60 to move the sheet bundle by a predetermined amount to downstream in the delivery direction, thereby arranging the aligned sheet bundle at the eco-binding position Ep. When the sheet bundle is arranged at the eco-binding position Ep, the stapleless binding portion 27 performs stapleless binding to the sheet bundle.

Figure 29A:
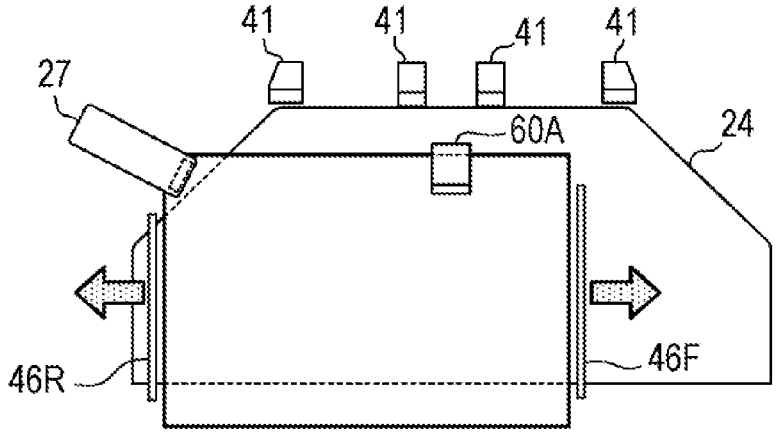
FIG. 29A is an explanatory view for illustrating another embodiment of the separating operation by rotation in the sheet processing apparatus, and is an illustration of a state in which alignment plates are separated from the sheet bundle after the stapleless binding.
Figure 29B:
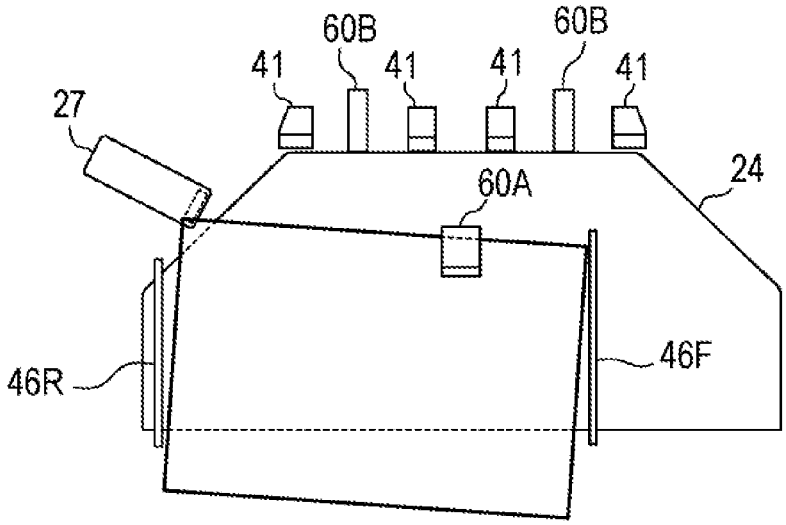
FIG. 29B is an explanatory view for illustrating another embodiment of the separating operation by rotation in the sheet processing apparatus, and is an illustration of a state in which the sheet bundle is separated through application of rotation to the sheet bundle by a rotation application device.
Figure 29C:
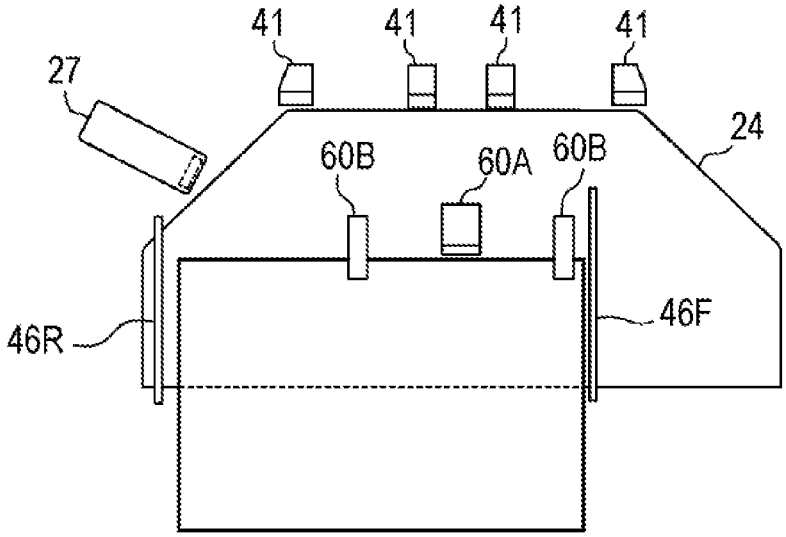
FIG. 29C is an explanatory view for illustrating another embodiment of the separating operation by rotation in the sheet processing apparatus, and is an illustration of a state in which the sheet bundle is delivered.

After the stapleless binding to the sheet bundle has been performed by the stapleless binding portion 27, the control portion 75 causes the side alignment members 46F and 46R to retreat to positions apart from the side edges of the sheet bundle. Further, as illustrated in FIG. 29A, the control portion 75 causes the first conveyance member 60A to move further in the delivery direction to apply rotation to the sheet bundle as the push-out member of the rotation application mechanism. Then, as illustrated in FIG. 29B, the control portion 75 causes the sheet bundle to be separated from the clamping teeth member 27*b* or 27*c* of the stapleless binding portion 27. When the sheet bundle is separated from the clamping teeth member 27*b* or 27*c*, the control portion 75 causes the second conveyance members 60B to take over the first conveyance member 60A to be brought into abutment against the sheet bundle. Then, as illustrated in FIG. 29C, the control portion 75 causes the sheet bundle, which is in the inclined posture due to the rotation, to be corrected to the predetermined posture and delivered in the delivery direction. After that, the first conveyance member 60A and the second conveyance members 60B are moved to return to the initial positions.

[Print-out Sheet Delivery]

Figure 21:
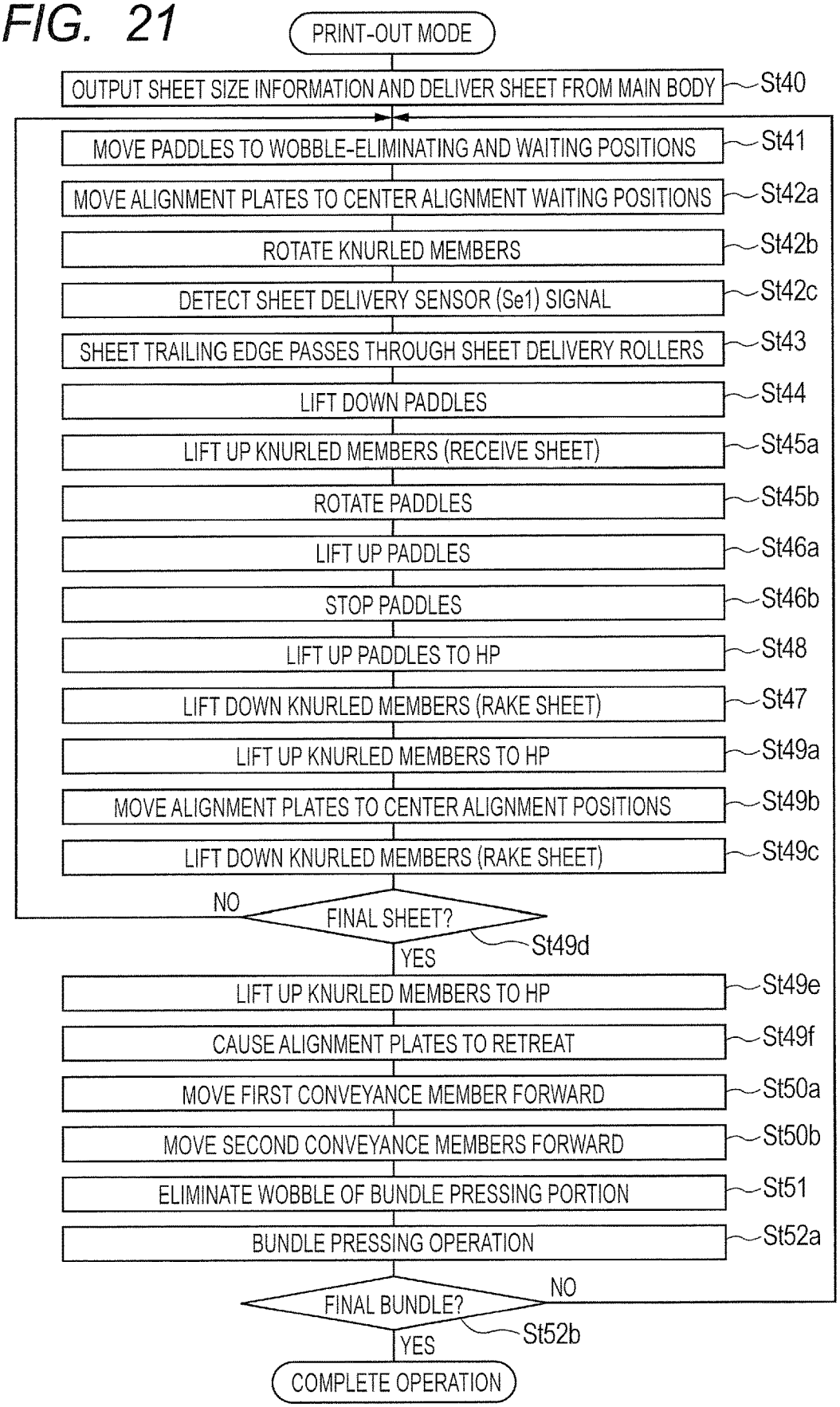
FIG. 21 is an operation flow in a print-out mode.
Figure 22:
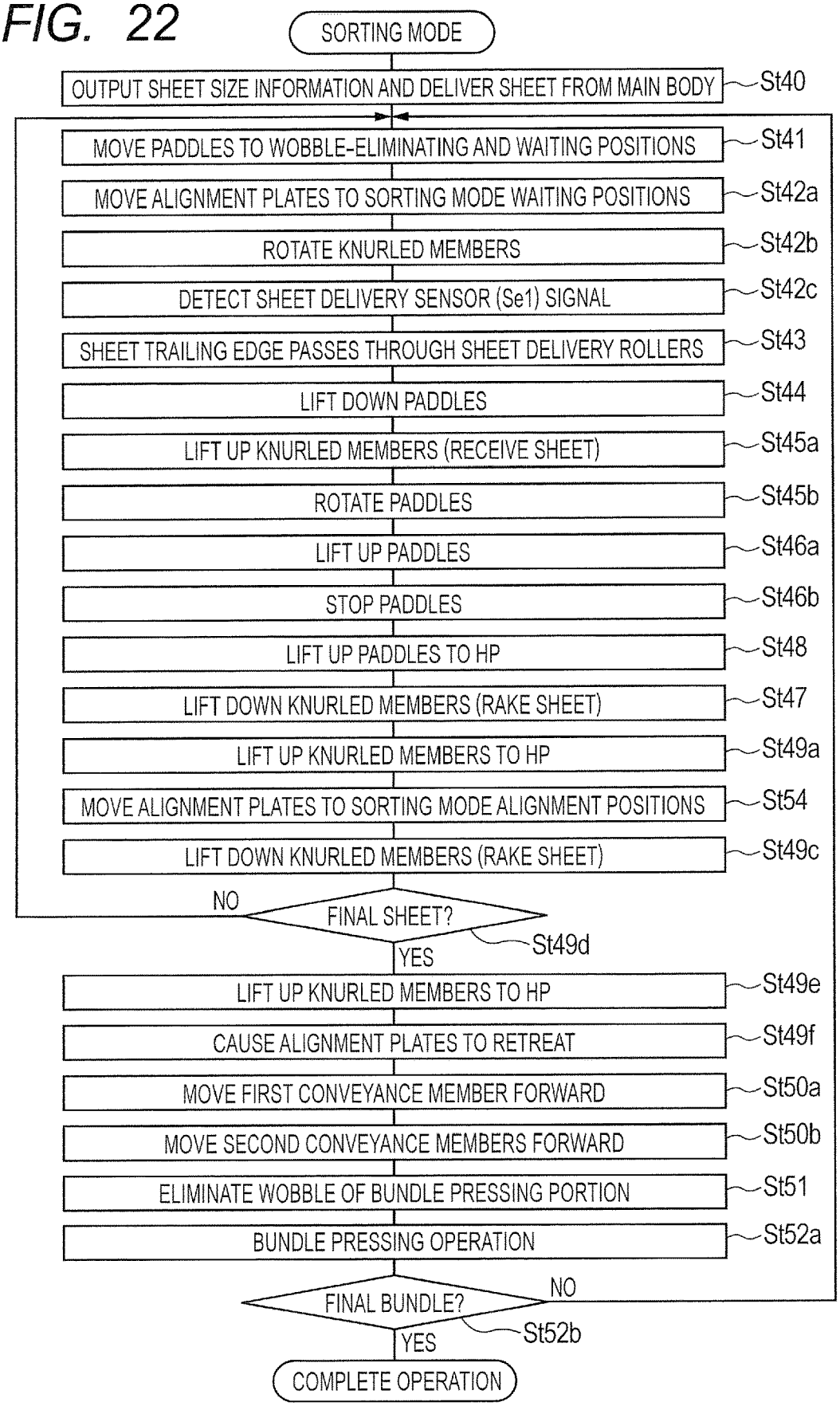
FIG. 22 is an operation flow in a sorting mode.

Description is made with reference to FIG. 21. When a sheet is conveyed from the image forming unit A (Step St40), the sheet sensor detects a leading edge of the sheet, and the paddle rotary members 36 are moved to waiting positions (Step St41). At the same time, the side alignment members 46 are moved to the waiting positions (Step St42*a*). Next, when the sheet trailing edge passes through the sheet delivery rollers 32 (Step St42*c* to Step St43), the control portion 75 causes the paddle rotary members 36 to be lifted down to the actuating positions (Step St44). Together with this, the control portion 75 causes the knurled rotary members 33 to be lifted up to retreat (Step St45*a*).

After the sheet trailing edge passes through the sheet delivery rollers 32, and a predetermined time period has elapsed, the control portion 75 causes the paddle rotary members 36 to be lifted up to move to retreated positions (Step St46*a* and Step St46*b*). Together with this, the control portion 75 causes the knurled rotary members 33 to be lifted down to actuating positions to cause the sheet to be delivered to the trailing edge regulation member 41 (Step St47). At an estimated time at which the sheet trailing edge has reached the regulation member 41, the control portion 75 causes the paddle rotary members 36 to move to home positions (Step St48). Further, the control portion 75 causes the knurled rotary members 33 to move to the home positions (Step St49*a*).

The control portion 75 causes the sheet alignment mechanism 45 to move to the alignment positions to perform the alignment operation. In this alignment operation, the sheets are stacked with the sheet center as a reference, and the sheets are delivered to the stack tray 25 by the carry-out operation. In this print-out sheet delivery operation, when a large size sheet is conveyed to the tray, an out-of-specification size sheet delivery operation is performed.

The control portion 75 aligns and stacks the sheets on the processing tray 24, and delivers the sheet bundle to the stack tray 25 on downstream. In that operation, the first conveyance member 60A of the sheet bundle carry-out mechanism 60 is moved in the sheet delivery direction (St50*a* and St50*b*). Next, the tray sheet pressing member 53 is moved to a waiting position (St51). Then, at a timing at which the sheet bundle is fed to the stack tray 25, the tray sheet pressing member 53 is rotated by a predetermined angle to press the uppermost sheet (St52*a*). After that, the control portion 75 causes the sheet alignment mechanism 45 to return to the sheet carry-in positions.

Sorting (Jog) Mode

A jog mode is performed with substantially the same steps as those of the print-out mode. Thus, the same steps are denoted by the same reference symbols, and description thereof is omitted. Different steps are described with reference to FIG. 22. When the sheets are fed to the processing tray 24, the control portion 75 causes the sheets to be stacked at different positions according to a group of sheets to be aligned with the center reference Sx, and a group of sheets to be aligned with a right-side reference (St54), and then causes the sheets to move in that posture to the stack tray 25 on downstream. The sheets are aligned with the right-side reference. This is because the processing tray 24 is arranged at a position deviated to the apparatus front side, and sheets with the center reference and sheets with the right-side reference closer to an operator are stacked on the sheet placement surface. With this, the sheet bundle can easily be taken out from the stack tray 25.

[Common Operation for Each Mode]

Figure 23:
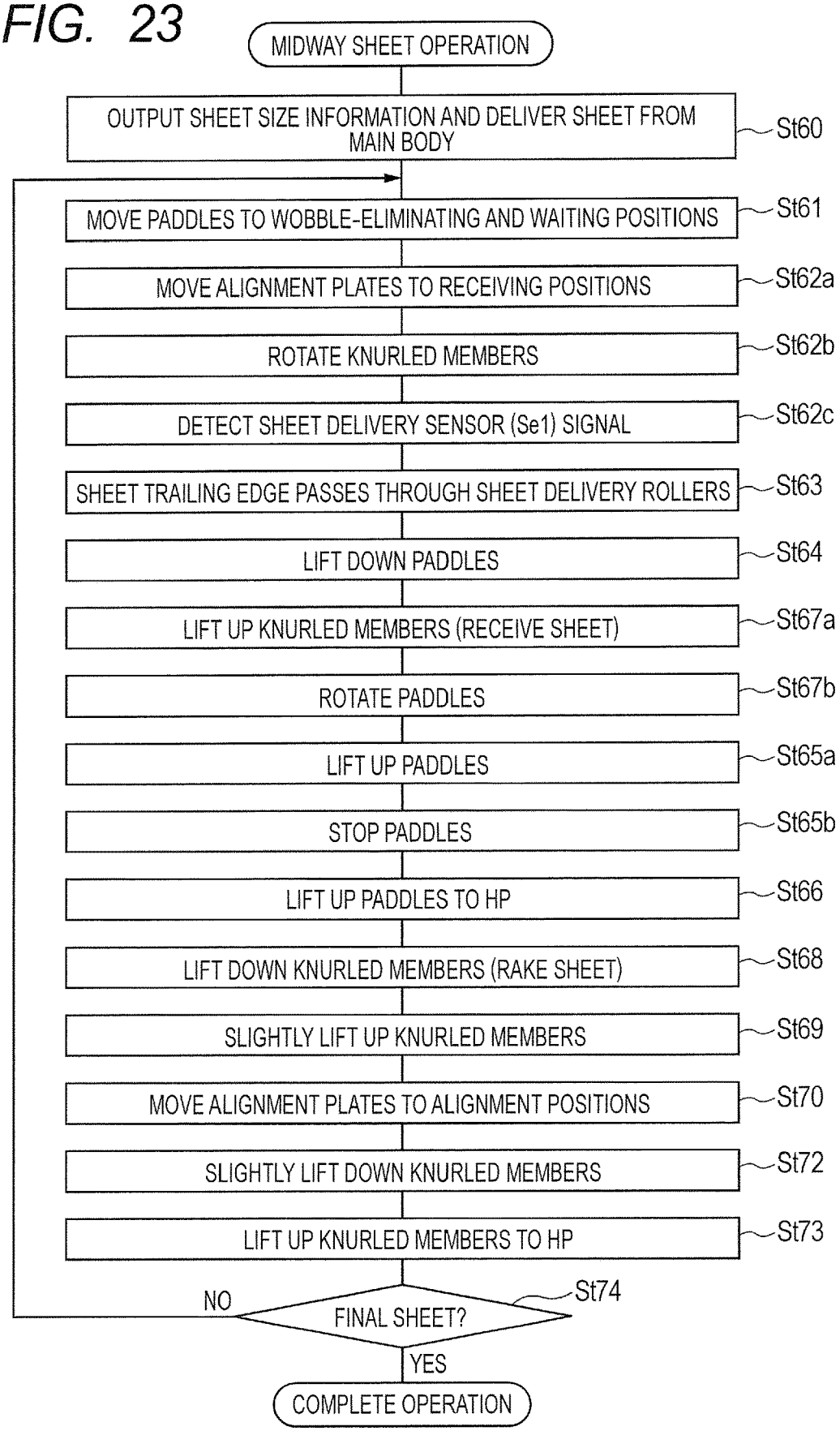
FIG. 23 is a common operation flow of feeding sheets to the processing tray.

With reference to FIG. 23, description is made of a common operation of conveying sheets to the processing tray 24, which is performed when the post-processing mode is performed. When a sheet is delivered from the image forming unit A (St60), the control portion 75 causes the paddle rotary members 36 to be positioned at waiting positions based on a leading edge detection signal from the sheet sensor Se1 (St61), and causes the alignment members 45 to move to predetermined waiting positions (St62*a*). In this operation, the alignment members 45 are positioned at waiting positions with a slightly larger width size based on a sheet size signal sent from the image forming unit A.

Next, at a timing at which the sheet trailing edge passes through the sheet delivery rollers 32 (St63), the control portion 75 causes the paddle rotary members 36 to be lifted down from the upper waiting positions to the lower actuating positions (St64). Together with this, the control portion 75 causes the knurled rotary members 33 to be lifted down from the waiting positions above the sheet placement surface to the actuating positions on the sheet placement surface (St67*a*). At this time, both the paddle rotary members 36 and the knurled rotary members 33 are rotated in the direction opposite to the sheet delivery direction (St67*b*).

After elapse of a predetermined time period, that is, after passage of an estimated time at which the sheet trailing edge reaches the knurled rotary members, the control portion 75 causes the paddle rotary members 36 to be lifted up from the actuating positions to the waiting positions (St65*a*). After elapse of a predetermined time period, that is, after passage of an estimated time at which the sheet leading edge reaches the trailing edge regulation member, the control portion 75 causes the knurled rotary members 33 to be lifted up by a small amount (St69). The amount of lifting up the paddle rotary members is set in advance based on experiment values which may cause reduction in pressing force with respect to the sheets.

Next, the control portion 75 causes the sheet alignment mechanism 45 to move to the alignment positions (St70). The alignment positions are set to different positions in the binding mode, and the sheets are stacked at the reference position in each mode. That is, (1) when the multi-binding is performed in the staple binding mode, the sheets having been fed to the processing tray 24 are aligned with the center reference. When the right corner binding is performed, the sheets having been fed to the processing tray 24 are aligned with a right-side reference Ap1. When the left corner binding is performed, the sheets having been fed to the processing tray 24 are aligned with the left side reference Ap2. In any of those cases, the stapler unit 26 waits at a binding position to be in standby for subsequent binding operation. (2) When the stapleless binding mode is performed, the control portion 75 causes the sheets to be aligned at the stapleless alignment position Ap3 which is determined at a position closer to the sheet center from the stapleless binding position, or causes the sheets to be aligned with the center reference. (3) When the print-out processing mode is performed, the control portion 75 causes the sheets to be aligned with the center reference. (4) When the jog processing mode is performed, the control portion 75 alternately and repeatedly causes the group of sheets aligned with the center reference and the group of sheets aligned with the right-side reference to be aligned, and causes the sheets to be discharged to the stack tray 25 in that posture.

Next, after the alignment operation is terminated, the control portion 75 causes the sheet alignment mechanism 45 to move to the initial positions, and then causes the knurled rotary members 33 to be lifted down in a direction of pressing the sheets (St72). Together with this, the control portion 75 causes the paddle rotary members 36 to the waiting positions being the home positions and retains the paddle rotary members 36 at those positions (St73).

[Manual Staple Operation]

Figure 24:
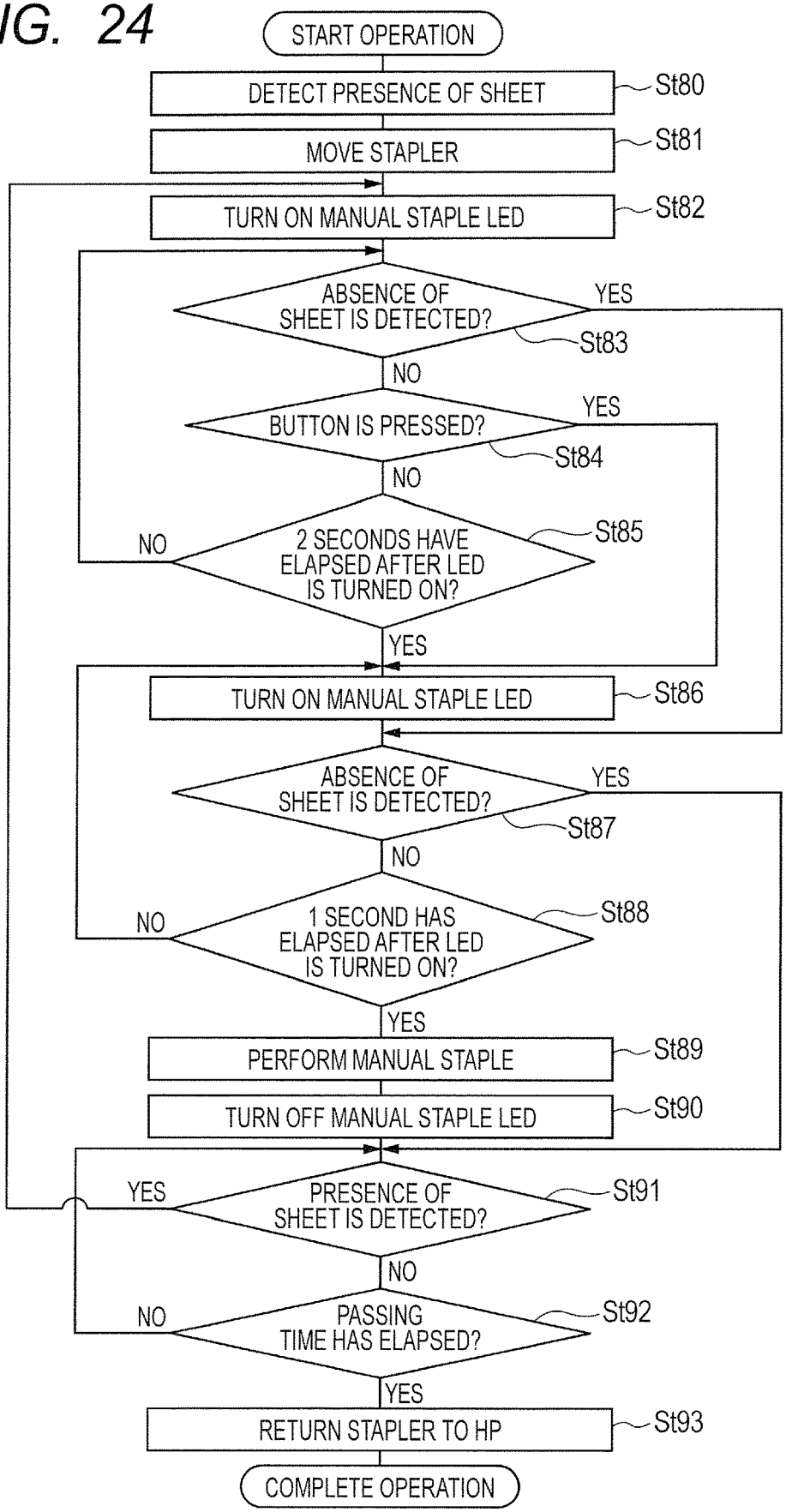
FIG. 24 is an operation flow of manual staple binding.

With reference to the flowchart in FIG. 24, description is made of the manual binding operation. In the manual feed set portion 29, a sheet presence sensor is arranged. When the sheet presence sensor Sm (hereinafter referred to as "sensor Sm") detects a sheet, the control portion 75 causes the staple binding operation to be performed.

The control portion 75 determines whether or not the stapler unit 26 performs the binding operation based on an ON signal of the sensor Sm (Step St80). When it is determined that the binding operation can be suspended, the control portion 75 causes the stapler 26 to move to the manual binding position Mp (Step St81). When the stapler is already at the binding position Mp, the stapler is stopped thereat. Then, the control portion 75 turns on the LED lamp which indicates that the manual operation is being performed (Step St82).

Next, the control portion 75 verifies that the sensor Sm is in an ON-state (NO in Step St83) and determines whether or not an operation button 30 has been operated (Step St84). When the sensor is in the ON-state, or even when the sensor is in an OFF-state, after elapse of a predetermined time period, which is set to 2 seconds in the illustrated flowchart, from the time at which the LED lamp is turned on (Step St85), the control portion 75 turns on the LED lamp again (Step St86). The control portion 75 verifies that the sensor Sm is in the ON-state (NO in Step St87), and then further determines whether or not a predetermined time period has elapsed after the time at which the LED lamp is turned on (Step St88). Then, the control portion 75 performs the staple operation (Step St89).

Next, when the sensor Sm is in the ON-state after the staple operation is performed, the control portion 75 returns to a predetermined step and performs again the staple operation. This is for the purpose of performing the binding to a plurality of positions of the sheet bundle. Further, when a sheet-absent state continues even after elapse of a predetermined time period from detection of the sheet-absent state by the sensor Sm, the control portion 75 causes the stapler unit 26 to return to the home position (Step St93) with assumption that a sheet has been removed from the set surface 29*a*. Further, when the manual binding position of the stapler unit 26 is set to the home position, the control portion 75 maintains the stapler unit 26 at that position.

In this embodiment, the processing operation of the manual staple operation is performed based on the ON or OFF signal of the sensor Sm during the execution of the print-out processing, the jog-sorting processing, or the stapleless binding on the processing tray 24, or during the preparation thereof. During the multi-binding operation or the corner binding operation on the processing tray 24, when the operation of stacking sheets is being performed, and the jog end signal is not transmitted from the image forming unit A, the manual operation can be performed. When the jog end signal is transmitted, but interruption processing is instructed, the manual staple processing is performed.

It is preferred that preference in the manual staple operation and the staple operation on the processing tray 24 be set at the time of device-designing, or be selected by an operator through arrangement of a preference execution key.

As described above, the press binder portion 27 is arranged on the apparatus rear side Re of the processing tray 24 so that the sheet bundle can be guided to the binding position (eco-binding position) Ep of the press binder portion 27 in the following manner. That is, sheets are delivered with the center reference to the processing tray 24 from the sheet delivery passage 22, and the sheets are aligned by the side alignment mechanism (side alignment members 46) with the sheet side edge closer to the eco-binding position Ep as a reference (one-side reference). The sheet bundle stacked at the alignment position Ap2 is moved and set to the eco-binding position Ep, and the sheet bundle is conveyed backward in the sheet center direction after the binding and discharged.

The sheet alignment position on the processing tray 24 is set to the corner binding position Cp2 of the stapler portion 26 at which the sheet side edge matches. With this, selection can be made between the staple binding to the sheet bundle aligned on the processing tray 24 and the eco-binding with the sheet bundle offset by a predetermined amount. When the sheet bundle is set at the eco-binding position Ep, the sheet bundle stacked at the alignment position Ap2 is moved or offset by a predetermined amount in a direction orthogonal to the sheet delivery direction, and at the same time, the sheet bundle is moved by a predetermined amount in the sheet delivery direction to be set to the eco-binding position Ep.

The sheet bundle having been subjected to the binding at the eco-binding position Ep is moved by a predetermined amount in the sheet center direction or offset backward to be discharged in the sheet delivery direction. With this, the sheet bundle to be discharged do not rub against the clamping teeth 27*b* and 27*c* of the press binder portion 27.

In the above, the present invention is described in relation to preferred embodiments. However, the present invention is not limited to the above-mentioned embodiments. As a matter of course, various changes or modifications can be made for practice within the technical scope of the present invention. For example, in the sheet bundle carry-out mechanism, in place of the structure of the above-mentioned embodiments in which the first and second conveyance members perform the relay conveyance, the conveyance members may have the same structure. By cooperating with the side alignment members, the sheet bundle carry-out mechanism can similarly and favorably correct the posture of the sheet bundle and discharge the same.

This application is a national stage entry of International Application No. PCT/JP2016/001998, filed on Apr. 13, 2016, which claims the benefit of priority from Japanese Patent Application No. 2015-082872, filed on Apr. 14, 2015 and Japanese Patent Application No. 2015-082873, filed on Apr. 14, 2015, the content of which is incorporated herein by reference.

The invention claimed is:

1. A sheet binding apparatus, comprising:

a sheet placement portion on which sheets are placed;

a conveyance portion which conveys a sheet to the sheet placement portion by conveying the sheet in a conveyance direction, the sheet conveyed by the conveyance portion being placed on the sheet placement portion;

a pair of alignment members configured to align, in a sheet width direction orthogonal to the conveyance direction, the sheets placed on the sheet placement portion, by sandwiching the sheets;

a binding member configured to bind the sheets aligned by the pair of alignment members by deforming the sheets without using a staple; and a separating member configured to apply a rotational force to the sheets, which have been bound by the binding member and have adhered to the binding member, to separate the sheets and the binding member from each other, the separating member applying the rotational force to the sheets by moving in the conveyance direction, the separating member contacting an upstream edge of the sheets in the conveyance direction when applying the rotational force to the sheets, wherein the pair of alignment members and the separating member are constructed by different members.

2. A sheet binding apparatus according to claim 1, further comprising a posture correction member configured to correct a posture of the sheets rotated by the rotational force.

3. A sheet binding apparatus according to claim 2, wherein the posture correction member is brought into abutment against the sheets at a plurality of different positions over a center axis, which passes through a gravity center position of the sheets and extends in the conveyance direction, of the sheets.

4. A sheet binding apparatus according to claim 1, wherein the separating member includes a push-out member which is movable along a movement axis extending in the conveyance direction, of the sheets placed on the sheet placement portion, the push-out member moving the sheets to an outside of the sheet placement portion by moving in the conveyance direction, and wherein the push-out member is constructed so that the movement axis extends to a position offset from a pair of clamping teeth members of the binding member.

5. A sheet binding apparatus according to claim 4, further comprising a delivery unit configured to move the sheets placed on the sheet placement portion in the conveyance direction, wherein the delivery unit includes the push-out member and a posture correction member which is configured to correct a posture of the sheets rotated by the rotational force.

6. A sheet binding apparatus according to claim 5, wherein the posture correction member includes two claw-shaped conveyance members which are movable in the conveyance direction of the sheets, and wherein the two claw-shaped conveyance members are arranged on sides opposite to each other over a center axis, which passes through a gravity center position of the sheets and extends in the conveyance direction, of the sheets.

7. A sheet binding apparatus according to claim 5, wherein the posture correction member is brought into abutment against the sheets at a plurality of different positions over a center axis, which passes through a gravity center position of the sheets and extends in the conveyance direction, of the sheets.

8. A sheet binding apparatus according to claim 5, wherein a torque for the push-out member is higher than a torque for the posture correction member.

9. A sheet binding apparatus according to claim 5, wherein the push-out member and the posture correction member are driven by the same drive source.

10. A sheet binding apparatus according to claim 5, wherein a movement velocity of the posture correction member is set higher than a movement velocity of the push-out member.

11. A sheet binding apparatus according to claim 1, further comprising a stack tray which stacks sheets and is located downstream of the sheet placement portion in the conveyance direction, the sheets, separated from the binding member by the separating member, being conveyed in the conveyance direction and then being discharged from the sheet placement portion to the stack tray.

12. An image forming apparatus, comprising:

an image forming portion configured to form an image on a sheet; and the sheet binding apparatus of claim 1, the sheet binding apparatus being configured to align a sheet bundle, which is formed of sheets fed from the image forming portion to the sheet placement portion, to a predetermined posture, perform post-processing to the sheet bundle, and deliver the sheet bundle.

* * * * *